US008213632B2

(12) United States Patent
Yamagishi et al.

(10) Patent No.: US 8,213,632 B2
(45) Date of Patent: Jul. 3, 2012

(54) ELECTROACOUSTIC TRANSDUCER AND EAR SPEAKER DEVICE

(75) Inventors: Makoto Yamagishi, Tokyo (JP); Toru Sasaki, Tokyo (JP)

(73) Assignee: Sony Corporation, Tokyo (JP)

( * ) Notice: Subject to any disclaimer, the term of this patent is extended or adjusted under 35 U.S.C. 154(b) by 971 days.

(21) Appl. No.: 11/910,321

(22) PCT Filed: Feb. 1, 2007

(86) PCT No.: PCT/JP2007/052164

§ 371 (c)(1),
(2), (4) Date: Oct. 1, 2007

(87) PCT Pub. No.: WO2007/089033

PCT Pub. Date: Aug. 9, 2007

(65) Prior Publication Data

US 2009/0154755 A1 Jun. 18, 2009

(30) Foreign Application Priority Data

Feb. 1, 2006 (JP) ..... 2006-024957
Dec. 5, 2006 (JP) ..... 2006-328603

(51) Int. Cl.
*H04R 1/02* (2006.01)

(52) U.S. Cl. ..... 381/87; 381/303; 381/337; 381/338

(58) Field of Classification Search ..... 381/303, 381/87, 337, 338
See application file for complete search history.

(56) References Cited

U.S. PATENT DOCUMENTS

| | | | | |
|---|---|---|---|---|
| 6,101,259 | A * | 8/2000 | Rapps | 381/330 |
| 6,307,943 | B1 * | 10/2001 | Yamagishi | 381/312 |
| 6,681,022 | B1 * | 1/2004 | Puthuff et al. | 381/338 |
| 7,082,207 | B2 * | 7/2006 | Rapps | 381/381 |
| 7,110,563 | B2 * | 9/2006 | Bergere | 381/380 |
| 7,920,902 | B2 * | 4/2011 | Carroll | 455/569.1 |
| 2003/0002700 | A1 * | 1/2003 | Fretz et al. | 381/330 |
| 2003/0112991 | A1 * | 6/2003 | Rapps | 381/330 |
| 2003/0112992 | A1 * | 6/2003 | Rapps | 381/381 |
| 2004/0160571 | A1 | 8/2004 | Jannard et al. | |
| 2004/0264727 | A1 | 12/2004 | Kim | |

FOREIGN PATENT DOCUMENTS

JP 2-020199 1/1990

(Continued)

*Primary Examiner* — David S. Warren
(74) *Attorney, Agent, or Firm* — Finnegan, Henderson, Farabow, Garrett & Dunner, L.L.P.

(57) ABSTRACT

A reproduced sound of high quality is allowed to be listened to by a listener while natural sound image localization is provided. By providing a housing 4L having internal space mounted at a predetermined position of the head of the listener, a speaker unit 7L mounted on one surface of the housing 4L and positioned away from an entrance of an external acoustic meatus of the listener for a predetermined distance when the housing 4L is mounted on the head 100 of the listener, and a tubular duct 8L extended so as to allow a sound generated by the housing 4L to reach the vicinity of the entrance of the external acoustic meatus of the listener, the sound generated by the housing 4L can be directly reached to an eardrum 103L in the inside of the external acoustic meatus from the vicinity of the entrance of the external acoustic meatus of the listener via a tubular duct 8L. In this manner, a sound at an sufficient level can be listened to by the listener while the natural sound image localization is provided as an open type.

30 Claims, 35 Drawing Sheets

FOREIGN PATENT DOCUMENTS

| | | |
|---|---|---|
| JP | 3-117999 | 5/1991 |
| JP | 3-162099 | 7/1991 |
| JP | 4-227396 | 8/1992 |
| JP | 3-162099 | 4/2000 |
| JP | 3054295 | 4/2000 |
| JP | 2003-018693 | 1/2003 |
| JP | 2005-501496 | 1/2005 |
| JP | 2005-117594 | 4/2005 |
| JP | 2005-269585 | 9/2005 |
| JP | 2005-534269 | 11/2005 |
| WO | WO 2004-052050 A1 | 6/2004 |
| WO | WO 2005-029909 A1 | 3/2005 |

* cited by examiner

ELECTROACOUSTIC TRANSDUCER AND EAR SPEAKER DEVICE

TECHNICAL FIELD

The present invention relates to an electroacoustic transducer and an ear speaker device, and is preferably applied to a head-mounted wearable speaker device, for example.

BACKGROUND ART

Conventionally, as a headphone device which is an example of a head-mounted wearable speaker device, there has been widely used the headphone device that is used in a state of being mounted on the head of a listener, and converts an audio signal expressing a reproduced voice of a CD (Compact Disc) to a sound (hereinafter, referred to as a reproduced sound) so as to make the listener capable of listening to the reproduced sound.

In the headphone device generally used, a speaker unit that generates the reproduced sound is positioned in the vicinity of the front of an entrance of an external acoustic meatus of the listener. Although a sound is allowed to reach an eardrum directly from the speaker unit to possibly improve sound quality, a sound image is localized in the head of the listener and this has provided an unnatural impression to the listener.

For the above reason, there has been devised the headphone device in which the speaker unit is positioned at a location somewhat distant from the entrance of the external acoustic meatus (ear hole) and closer to a parietal region. In this manner, the sound image is localized outside the head just like a general stationary speaker to remove the unnaturalness. At the same time, the headphone device is made as a closed type to form enclosed space around an ear of the listener in consideration of making the listener capable of listening to a low-pitched sound sufficiently.

Pat. Document: Jpn. Pat. No. 3054295 (page 3, FIG. 1)

With respect to the headphone device with the above configuration, it has been requested to provide the listener with a sense of liberation by making the headphone device to be an open type while excellent sound quality including a sufficient low-pitched sound is maintained. However, since the speaker unit is isolated from the ear hole, the sound quality becomes deteriorated with insufficient low frequencies when nothing further than changing the closed type to the open type is carried out, and there has been a problem that the above request cannot be fulfilled.

In addition, in the headphone device with the above configuration, the speaker unit is positioned at the location somewhat distant from the entrance of the external acoustic meatus (ear hole) and closer to the parietal region. For this reason, middle-pitched and high-pitched sounds do not reach the ear hole smoothly as well, and there has been a problem that the listener is not capable of listening to the middle-pitched and high-pitched sounds at a sufficient level.

DISCLOSURE OF THE INVENTION

The present invention has been made in consideration of the above point. An object of the present invention is to suggest an electroacoustic transducer and an ear speaker device that make the listener capable of listening to the reproduced sound with high quality while providing natural sound image localization.

In order to achieve the above object, according to an aspect of the present invention, there is provided a housing mounted at a predetermined position of the head of a listener, a speaker unit that is mounted in the housing and is positioned away from an entrance of an external acoustic meatus of the listener for a predetermined distance when the housing is mounted on the head of the listener, and a tubular duct that is extended so as to allow a sound generated by the housing to reach the vicinity of the entrance of the external acoustic meatus of the listener.

In the above manner, the sound generated by the housing can be allowed to directly reach an eardrum in the external acoustic meatus from the vicinity of the entrance of the external acoustic meatus of the listener via the tubular duct. Therefore, a sound at a sufficient level can be listened to by the listener, while natural sound image localization is provided as an open type.

In addition, according to an aspect of the present invention, there is provided a housing mounted at a predetermined position of the head of a listener, a speaker unit that is mounted on one surface of the housing and is positioned away from an entrance of an external acoustic meatus of the listener for a predetermined distance when the housing is mounted on the head of the listener, and a tubular duct that is extended so as to allow a sound generated in inside space of the housing to reach the vicinity of the entrance of the external acoustic meatus of the listener.

In the above manner, middle-pitched and high-pitched sounds emitted from the speaker unit positioned away from the entrance of the external acoustic meatus for the predetermined distance can be allowed to reach the inside of the external acoustic meatus, and also a low-pitched sound emitted from the vicinity of the entrance of the external acoustic meatus of the listener via the tubular duct can be allowed to reach the eardrum in the external acoustic meatus efficiently. Therefore, the middle-pitched and the high-pitched sounds that can localize the sound image outside the head of the listener and the low-pitched sound having an increased sound pressure level can all together be listened by the listener.

Further, according to the present invention, there is provided a housing mounted at a predetermined position of the head of a listener, a speaker unit that is mounted on one surface of the housing and is positioned away from an entrance of an external acoustic meatus of the listener for a predetermined distance when the housing is mounted on the head of the listener, and a tubular duct that is extended so as to allow a sound generated by a front surface of the speaker unit to reach the vicinity of the entrance of the external acoustic meatus of the listener.

In the above manner, mainly middle-pitched and high-pitched sounds generated by the speaker unit can be allowed to directly reach the eardrum in the external acoustic meatus from the vicinity of the entrance of the external acoustic meatus of the listener via the tubular duct. Therefore, the listener can listen to the middle-pitched and the high-pitched sounds at a sufficient level, while being provided with the natural sound image localization as the open type.

According to the present invention, the sound generated by the housing can be allowed to directly reach the eardrum in the external acoustic meatus from the vicinity of the external acoustic meatus of the listener via the tubular duct. Therefore, it is possible to achieve the electroacoustic transducer and the ear speaker device that can make the listener capable of listening to the sound at a sufficient level while providing the natural sound image localization as the open type. In this manner, it is possible to achieve the electroacoustic transducer and the ear speaker device that can make the listener capable of listening to a reproduced sound with high quality while providing the natural sound image localization.

In addition, according to the present invention, the middle-pitched and the high-pitched sounds emitted from the speaker unit that is positioned away from the entrance of the external acoustic meatus for a predetermined distance can be allowed to reach the inside of the external acoustic meatus, and also the low-pitched sound emitted from the vicinity of the entrance of the external acoustic meatus of the listener can be allowed to efficiently reach the eardrum in the external acoustic meatus via the tubular duct. Therefore, it is possible to make the listener capable of listening to the middle-pitched and the high-pitched sounds that can localize the sound image outside the head of the listener and the low-pitched sound with a higher sound pressure level all together. In this manner, it is possible to achieve the electroacoustic transducer and the ear speaker device that can make the listener capable of listening to the reproduced sound with high quality, while providing the natural sound image localization.

Further, according to the present invention, mainly middle-pitched and high-pitched sounds generated by the speaker unit can be allowed to directly reach the eardrum in the external acoustic meatus from the vicinity of the entrance of the external acoustic meatus of the listener via the tubular duct. Therefore, it is possible to achieve the electroacoustic transducer and the ear speaker device that can make the listener capable of listening to the middle-pitched and the high-pitched sounds at a sufficient level, while providing the natural sound image localization as the open type.

BEST MODE FOR CARRYING OUT THE INVENTION

Hereinafter, an embodiment of the present invention will be classified into a first embodiment and a second embodiment, and described in detail with reference to the accompanying drawings.

(1) First Embodiment (1-1) Configuration of Ear Speaker Device

Figure 1:
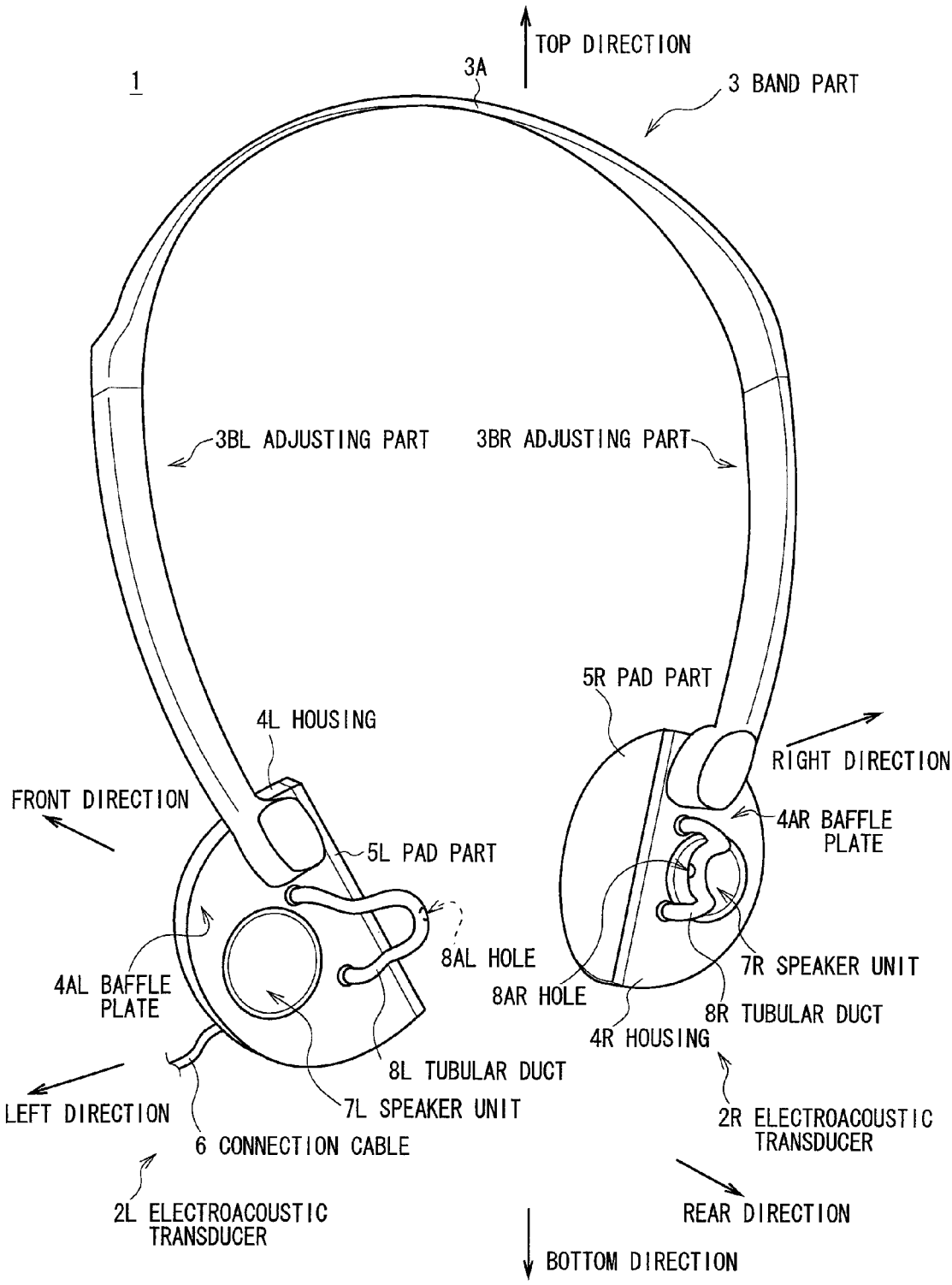
FIG. 1 is a schematic perspective view showing an entire configuration of an ear speaker device according to a first embodiment.
Figure 2:
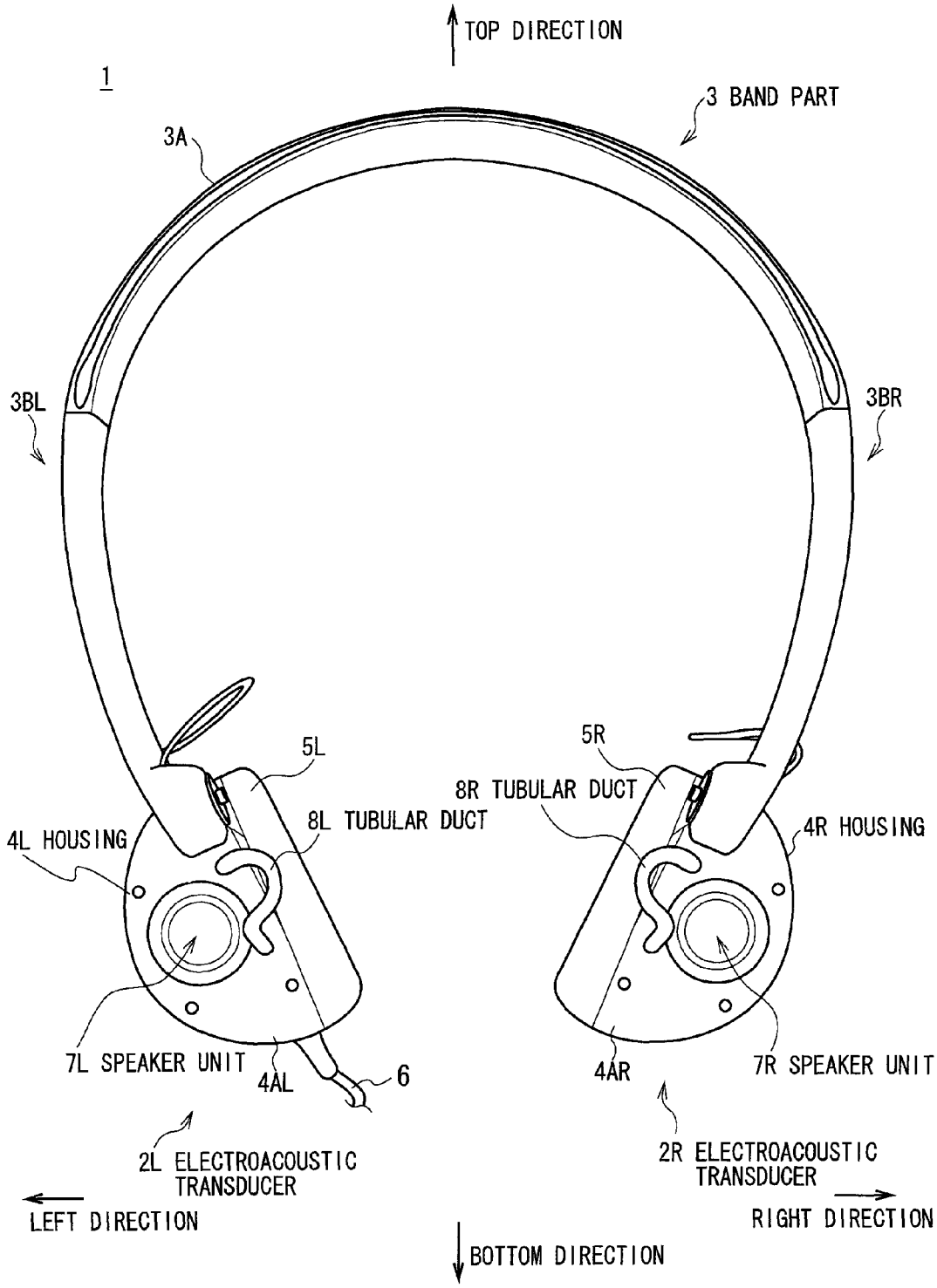
FIG. 2 is a schematic rear view showing the entire configuration of the ear speaker device according to the first embodiment.
Figure 3:
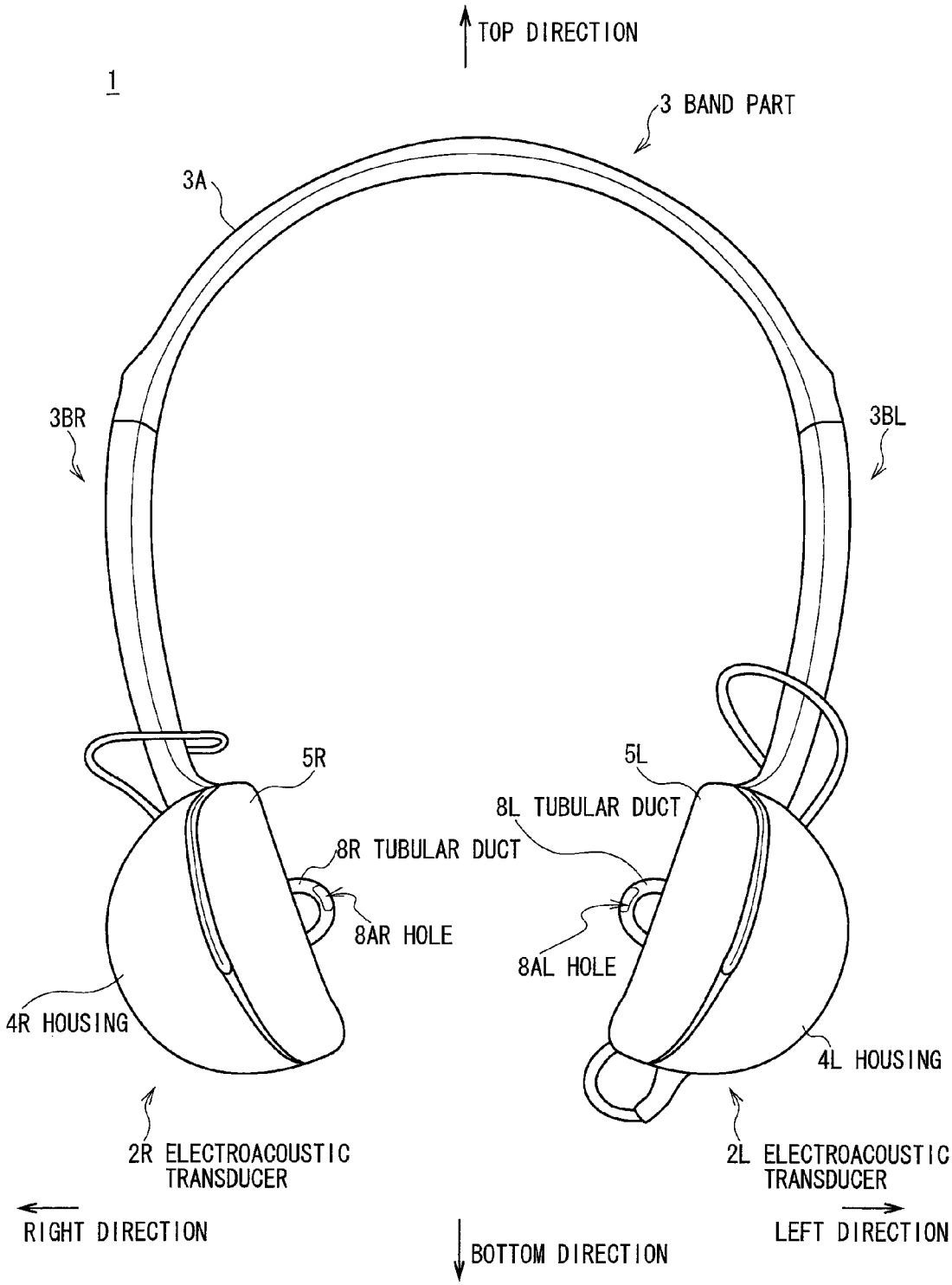
FIG. 3 is a schematic front view showing the entire configuration of the ear speaker device according to the first embodiment.

With respect to FIGS. 1, 2, and 3, the numerical number 1 refers to an entire ear speaker device according to the first embodiment. The ear speaker device is configured so as to convert an audio signal generated by reproduction processing and the like of a portable CD (Compact Disc) player and a DMP (Digital Music Player) to a reproduced sound, and make a listener capable of listening to the reproduced sound.

Unlike a box-shaped speaker device generally used, the ear speaker device 1 is premised to be mounted on the head of the listener as similar to a headphone device. The ear speaker device 1 is configured with a electroacoustic transducers 2L and 2R that convert the audio signal to the reproduced sound, and a band part 3 for mounting and fixing the electroacoustic transducers 2L and 2R on the head of the listener, according to a rough classification.

The electroacoustic transducers 2L and 2R are mainly configured with housings 4L and 4R having a shape of a ball being quartered along a vertical direction. Each of the housings 4L and 4R has plane surfaces formed on a rear side, and a left or a right inner side, respectively. Pad parts 5L and 5R for softening side pressure to the head of the listener are provided on inner sides on the left and the right.

Baffle plates 4AL and 4AR that are the plane surfaces on the rear side of the housings 4L and 4R are provided with speaker units 7L and 7R that convert the audio signal to the reproduced sound. The speaker units 7L and 7R are configured so as to emit sound by vibrating a diaphragm according to the audio signal supplied from the portable CD player, the DMP, and the like via a connection cable 6.

In addition, the baffle plates 4AL and 4AR of the housings 4L and 4R are provided with tubular ducts 8L and 8R that are made of metal such as aluminum having predetermined rigidity, or plastic, resin, or the like having predetermined rigidity, and have a hollow member having predetermined thickness being curved in a substantial U-shape on sides. As shown in FIG. 1, the tubular ducts 8L and 8R have outer ends that are curved in the inner side direction on the left or the right, respectively. Further, holes 8AL and 8AR are provided on a substantial center of each of end parts on the rear side.

The band part 3 is formed in a substantial arch shape corresponding to a shape of the head of a general person, centering on a center part 3A. Also, the band part 3 is configured so that an entire length of the band part 3 can be adjusted by adjusting parts 3BL and 3BR that can slide in an extensible manner with respect to the center part 3A.

The band part 3 is formed in the arch shape with a diameter smaller than the shape of the head of the general person, and also has an elastic force. When the ear speaker device 1 is mounted on the listener while the housings 4L and 4R are stretched to the left and the right, the band part 3 tends to return to an original shape by action of the elastic force after the mounting. In this manner, the ear speaker device 1 is held in a state that the housings 4L and 4R are made in contact with the head of the listener.

The ear speaker device 1 is configured in substantial symmetry as shown in FIGS. 1 to 3. Therefore, the electro acoustic transducer 2L on the left side will be mainly described hereinafter.

Figure 4:
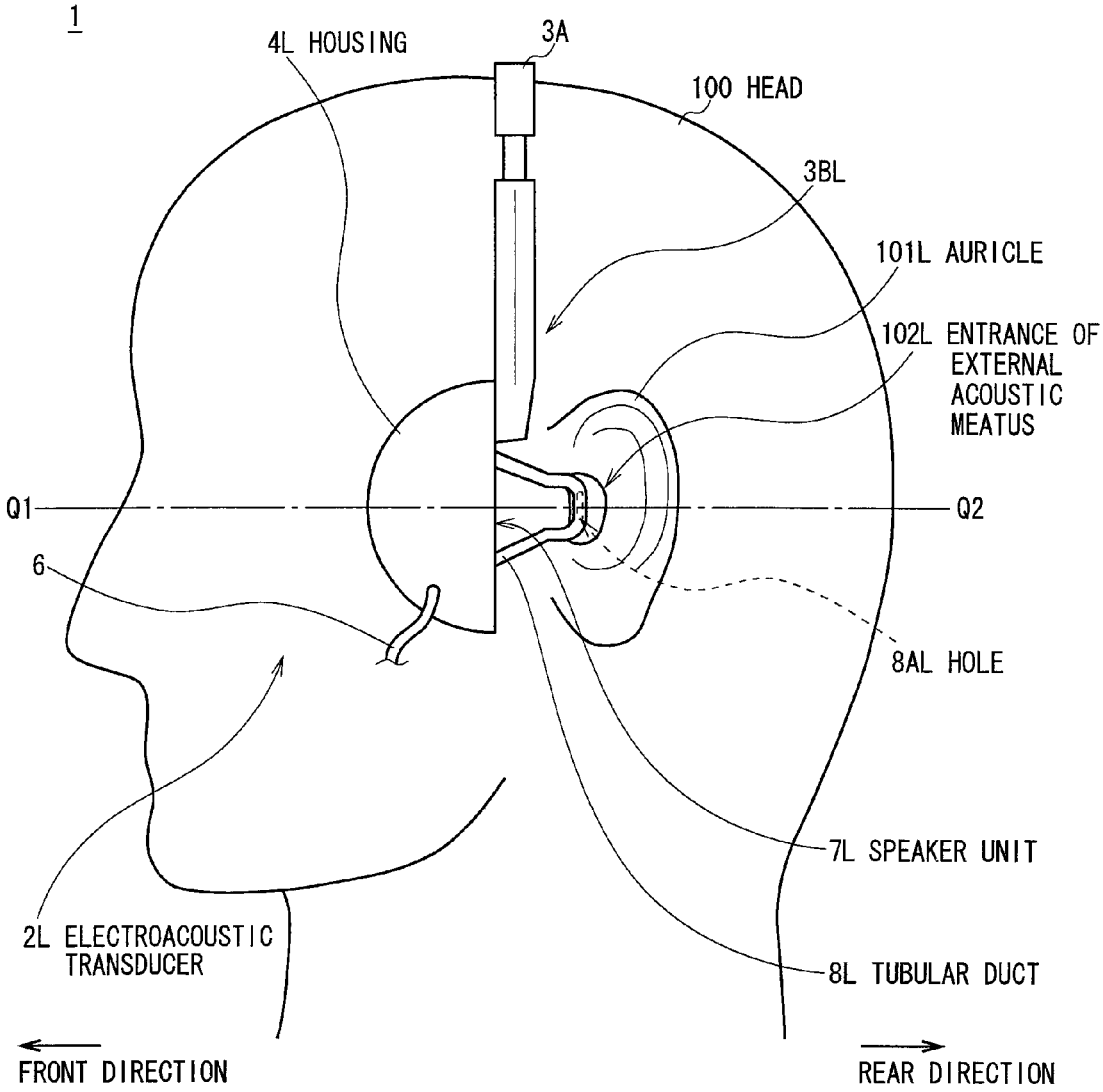
FIG. 4 is a schematic side view showing a mounting state of the ear speaker device according to the first embodiment.

In practice, as shown in a left side view of FIG. 4, the ear speaker device 1 is mounted on a head 100 of the listener after length of the band part 3 is adjusted, thereby the electroacoustic transducer 2L attached to a lower end side of the adjusting part 3BL is positioned somewhat closer to the front than an auricle 101L on the head of the listener.

In the above manner, the electroacoustic transducer 2L of the ear speaker device 1 allows middle-pitched and high-pitched sounds emitted from the speaker unit 7L to directly reach the inside of an external acoustic meatus of the listener, and also allows a reflected sound reflected by a cheek and the auricle 101L of the listener to reach the inside of the external acoustic meatus. Therefore, the ear speaker device 1 is configured to be capable of providing natural sound image localization that is similar to a case of listening to a sound via a general stationary speaker.

When the ear speaker device 1 is mounted on the listener in a normal manner, the speaker unit 7L is positioned somewhat closer to the front than the auricle 101L and an entrance 102L of the external acoustic meatus, and the hole 8AL of the tubular duct 8L is positioned in the vicinity of the entrance 102L of the external acoustic meatus.

The tubular duct 8L has its end formed in a substantial U-shape, and therefore is configured so as to be put in contact with the entrance 102L of the external acoustic meatus of the listener and not to enter into the inside of the external acoustic meatus. In this manner, the ear speaker device 1 is configured so as to be able to prevent the tubular duct 8L from hurting the inside of the external acoustic meatus in error when the listener mounts the ear speaker device 1, and so on.

Figure 5:
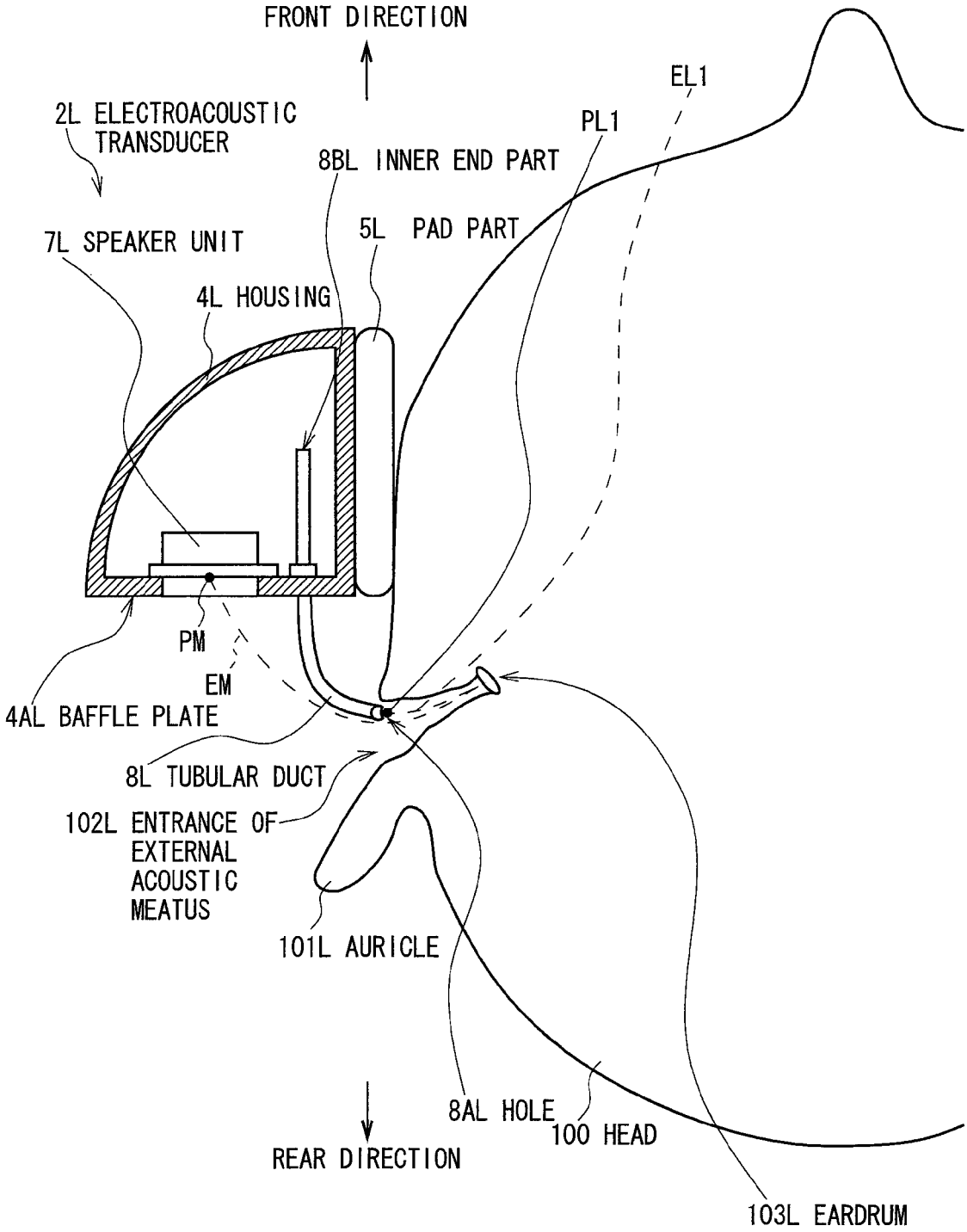
FIG. 5 is a schematic cross-sectional top view showing the mounting state of the ear speaker device according to the first embodiment.

Here, as a cross section cut along the line Q1-Q2 in FIG. 4 is shown in FIG. 5, the housing 4L forms closed space excluding the tubular duct 8L in a state where the speaker unit 7L is attached. In this manner, the housing 4L and the tubular duct 8L form a resonant circuit with respect to the speaker unit 7L.

In addition, the tubular duct 8L reaches the vicinity of the entrance 102L of the external acoustic meatus of the listener by penetrating through the baffle plate 4AL of the housing 4L from the inside of the housing 4L. In practice, the electroacoustic transducer 2L makes the tubular duct 8L working as a bass reflex duct, thereby the electroacoustic transducer 2L as a whole operates as a bass reflex speaker.

Figure 6:
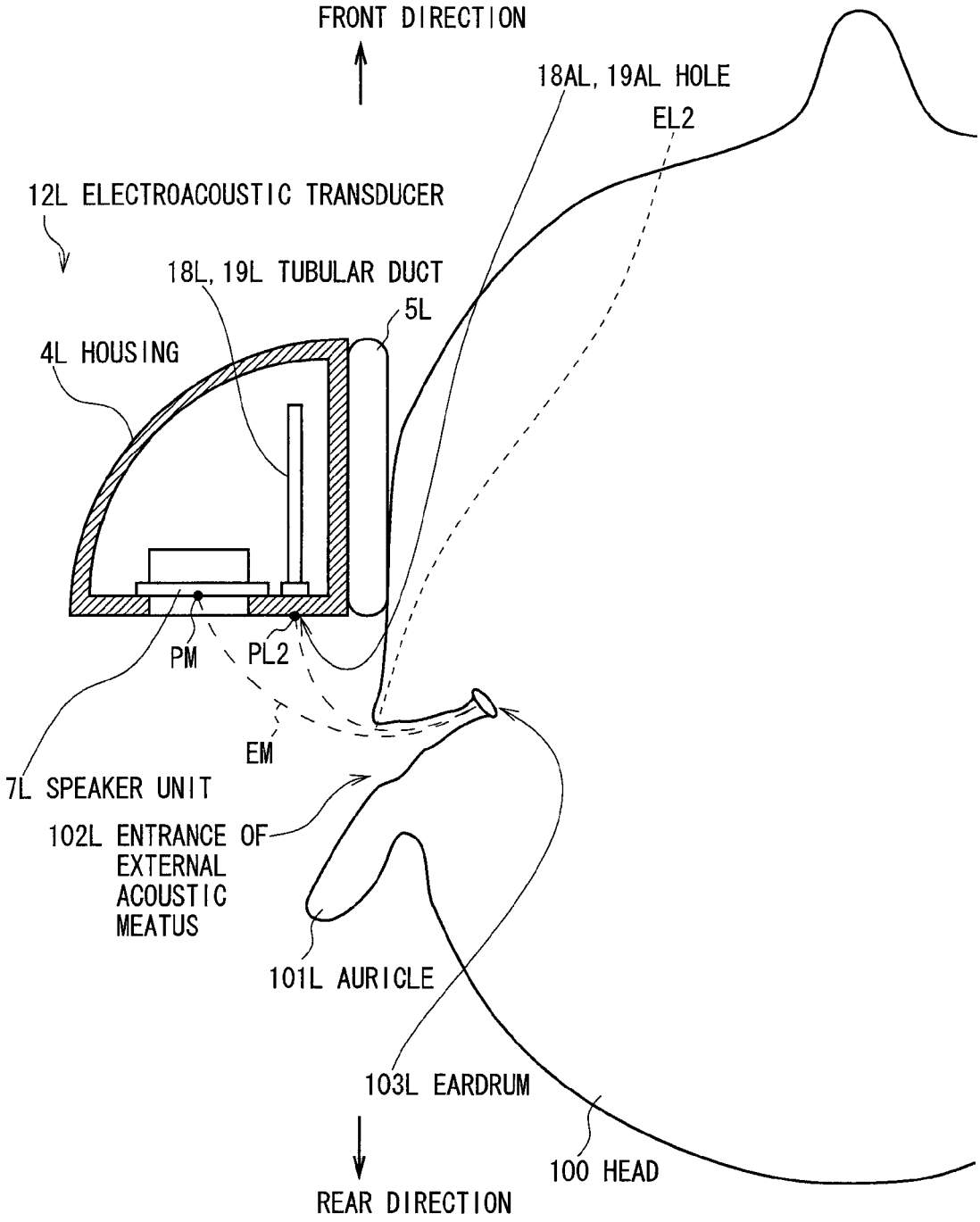
FIG. 6 is a schematic cross-sectional top view showing a bass reflex ear speaker generally used.

In a general bass reflex speaker, a duct is provided only inside a housing and does not extend to the outside. Therefore, for comparison with the electroacoustic transducer 2L, an electroacoustic transducer 12L as shown in FIG. 6 in which a corresponding part with FIG. 5 is attached to with the same numerical number is assumed.

The electroacoustic transducer 12L (FIG. 6) is configured in a similar manner as the general bass reflex speaker, and has two tubular ducts 18L and 19L only on an inner side of the housing 4L in place of the tubular duct 8L (FIG. 5) of the electroacoustic transducer 2L.

In a case of the electroacoustic transducer 12L, in a comparison between path length EM in which the middle-pitched and the high-pitched sounds emitted from the speaker unit 7L reach an eardrum 103L of the listener when a position of the speaker unit 7L is regarded as a position (hereinafter referred to as the virtual sound source position) PM of a virtual sound source, and path length EL2 in which the low-pitched sound emitted from holes 18AL and 19AL through the tubular ducts 18L and 19L reach the eardrum 103L of the listener when the holes 18AL and 19AL are regarded as a virtual sound source position PL2, a relationship of the path length EM≈the path length EL2 is obtained.

Figure 7:
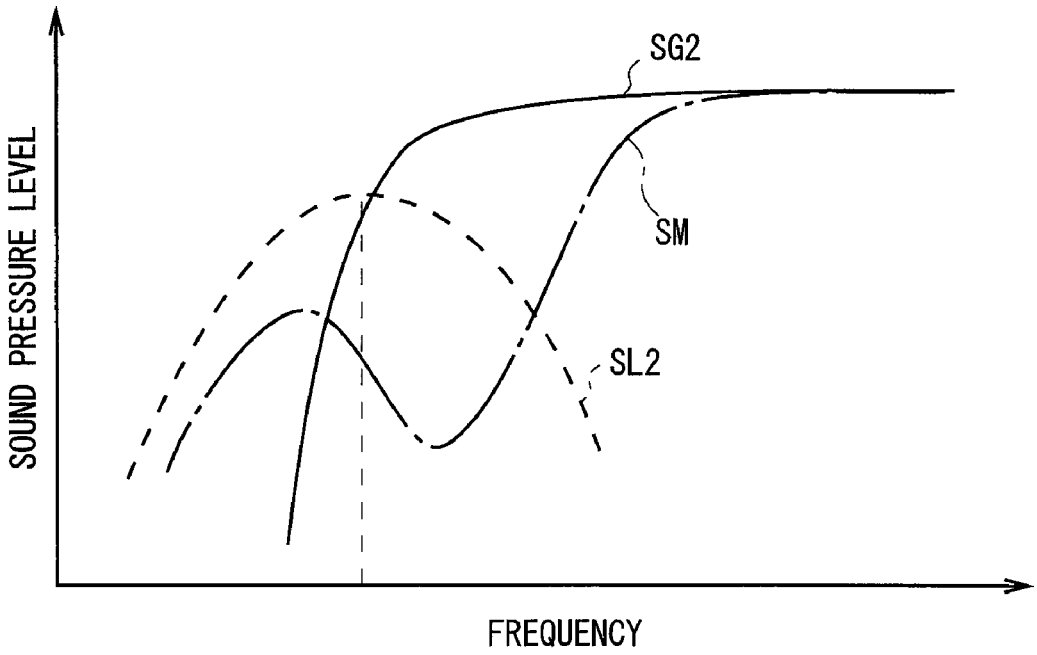
FIG. 7 is a schematic view showing a frequency characteristic in a conventional bass reflex speaker.

Here, a frequency characteristic of a sound reaching the eardrum 103L by the electroacoustic transducer 12L is shown in FIG. 7. As shown in FIG. 7, the bass reflex electroacoustic transducer 12L generally used allows the middle-pitched and the high-pitched sounds having a frequency characteristic as shown in a characteristic curve SM and emitted from the speaker unit 7L and the low-pitched sound having a frequency characteristic as shown in a characteristic curve SL2 emitted from the holes 18AL and 19AL after transmitting through the tubular ducts 18L and 19L to reach all together the eardrum 103L of the listener.

In the above manner, the electroacoustic transducer 12L can make the listener capable of listening to the reproduced sound having the sound pressure level in the low frequencies in the characteristic curve SM increased to some extent, as shown in a characteristic curve SG2 in which the characteristic curve SM and the characteristic curve SL2 are synthesized.

On the other hand, in the electroacoustic transducer 2L (FIG. 5) according to the present invention, in a comparison between the path length EM in which the middle-pitched and the high-pitched sounds emitted from the speaker unit 7L reach an eardrum 103L of the listener when the speaker unit 7L is regarded as the virtual sound source position PM, and path length EL1 in which the low-pitched sound emitted from a hole 8AL through a tubular duct 8L reach the eardrum 103L of the listener when the hole 8AL is regarded as a virtual sound source position PL1, a relationship of the path length EM>the path length EL1 is obtained.

Figure 8:
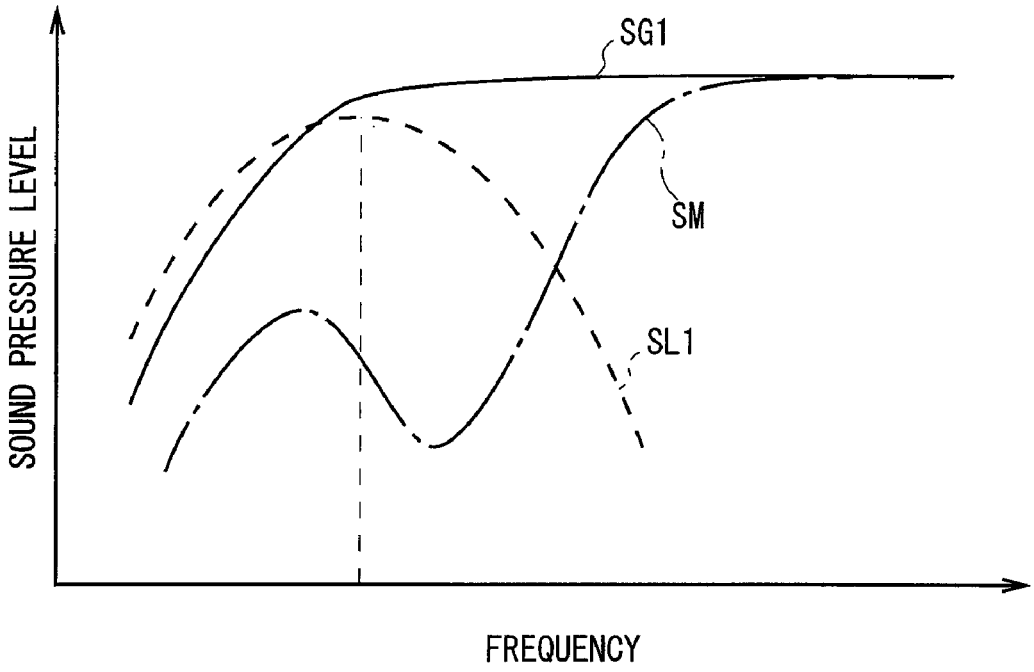
FIG. 8 is a schematic view showing a frequency characteristic of the ear speaker device according to the first embodiment.

Here, a frequency characteristic of the sound reaching the eardrum 103L by the electroacoustic transducer 2L is shown in FIG. 8. The electroacoustic transducer 2L is a type of the bass reflex speakers as described above, and therefore, as similar to the case shown in FIG. 7, the electroacoustic transducer 2L allows the middle-pitched and the high-pitched sounds having the frequency characteristic as shown in the characteristic curve SM and emitted from the speaker unit 7L and the low-pitched sound having a frequency characteristic as shown in a characteristic curve SL1 emitted from the hole 8AL after transmitting through the tubular duct 8L to reach all together the eardrum 103L of the listener.

In general, distance from the sound source and the sound pressure level are in a relationship of inverse proportion. Here, when the path length of the electroacoustic transducer 2L (FIG. 5) and that of the electroacoustic transducer 12L (FIG. 6) are compared, a relationship of the path length EL1<the path length EL2 is obtained.

That is, in the electroacoustic transducer 2L (FIG. 5), the virtual sound source position PL1 is positioned closer to the vicinity of the entrance 102L of the external acoustic meatus of the listener than the virtual sound source position PL2 of the electroacoustic transducer 12L (FIG. 6). Therefore, the electroacoustic transducer 2L allows the low-pitched sound emitted from the hole 8AL (virtual sound source position PL1) after transmitting through the tubular duct 8L to reach the eardrum 103L with the sound pressure level higher than when the electroacoustic transducer 12L is used.

Figure 9:
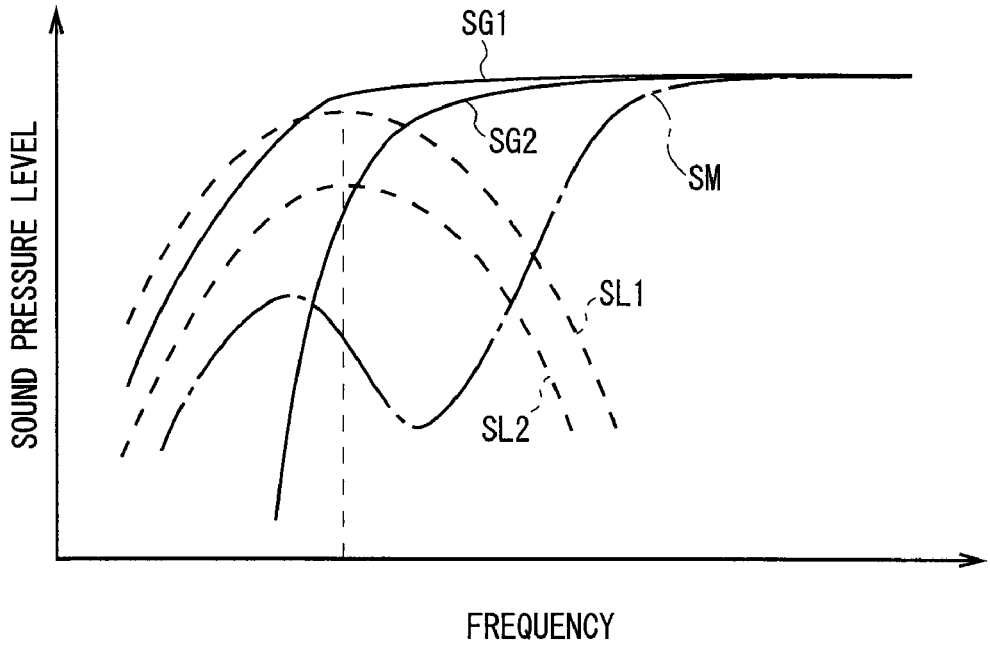
FIG. 9 is a schematic view showing a theoretical frequency characteristic.

That is, as shown in FIG. 9 in which two of the characteristic curves SL1 and SL2 are overlapped, the characteristic curve SL1 of the low-pitched sound by the tubular duct 8L has an entire sound pressure level higher as compared with the characteristic curve SL2 of the low-pitched sound by the tubular ducts 18L and 19L due to the relationship of the path length EL1<the path length EL2.

As a result, as shown in the characteristic curve SG1 in which the characteristic curve SM and the characteristic curve SL1 are synthesized, the electroacoustic transducer 2L in the first embodiment can make the listener capable of listening to the reproduced sound at a sufficient sound pressure level to an extent of a comparatively low frequency band where the sound pressure level in the low frequencies in the characteristic curve SM is increased higher than when the electroacoustic transducer 12L is used (characteristic curve SG2).

Here, when the characteristic curve SG1 and the characteristic curve SG2 are compared, the sound pressure level lowers comparatively steeply as it progresses to a low frequencies side in the characteristic curve SG2, whereas degree of the lowering of the sound pressure level is moderate as it progresses to the low frequencies side in the characteristic curve SG1.

That is, the electroacoustic transducer 2L can allow an excellent reproduced sound having the high sound pressure level extending to a wide frequency band, that is, including the sufficient low frequencies to be transmitted to the eardrum 103 of the listener and can make the listener capable of listening to the excellent reproduced sound.

In this case, as shown in FIGS. 4 and 5, although the electroacoustic transducer 2L makes the end part of the tubular duct 8L in contact with the vicinity of the entrance 102L of the external acoustic meatus of the listener, the electroacoustic transducer 2L does not completely block the entrance 102L of the external acoustic meatus.

For the above reason, the electroacoustic transducer 2L allows a sound generated around the listener (hereinafter referred to as the surround sound) to reach the eardrum 103L of the listener without blocking the surround sound and makes the listener capable of listening to the surround sound, in addition to the reproduced sound made up of combination of the middle-pitched and the high-pitched sounds emitted from the speaker unit 7L and the low-pitched sound emitted from the hole 8AL of the tubular duct 8L.

As for the electroacoustic transducer 2L, an internal volume of the housing 4L is 10 [ml], an external diameter of the speaker unit 7L is 21 [mm], an effective vibration radius in a diaphragm of the speaker unit 7L is 8.5 [mm], equivalent mass of a vibration system is 0.2 [g], a minimum resonance frequency f0 is 360 [Hz], and a resonance frequency Q0 is 1.0.

As for the tubular duct 8L, an inner diameter is 1.8 [mm], effective length from an internal end 8BL positioned in the housing 4L of the tubular duct 8L to the hole 8AL is 50 [mm], and a distance from a surface of the baffle plate 4AL to the hole 8AL is around 35 [mm].

Here, the tubular duct 8L has its side surface formed in a U-shape, and the hole 8AL provided on the center of the outer end part. Therefore, it is substantially same as that two bass reflex ducts of the top half and the bottom half make up the tubular duct 8L, and the inner diameter and the effective length of the tubular duct 8L are determined after the inner diameter (equivalent to 2.5 [mm] in this case) when the tubular duct 8L is converted to one tubular duct is considered.

That is, the tubular duct 8L has the side surface formed in the U-shape, thereby the effective length of the tubular duct 8L can be set to be short as compared with the case when the tubular duct 8L is configured with one tubular duct, and design and safety of the tubular duct 8L are significantly improved.

With respect to the electroacoustic transducer 2L (FIG. 5) and the electroacoustic transducer 12L (FIG. 6), an actual frequency characteristic was measured by using a jig for measurement that imitated an auricle and an external acoustic meatus of a human being. As a result, a characteristic curve SG11 (in a case of the electroacoustic transducer 2L) and a characteristic curve SG12 (in a case of electroacoustic transducer 12L) as shown in FIG. 10 were obtained.

Figure 10:
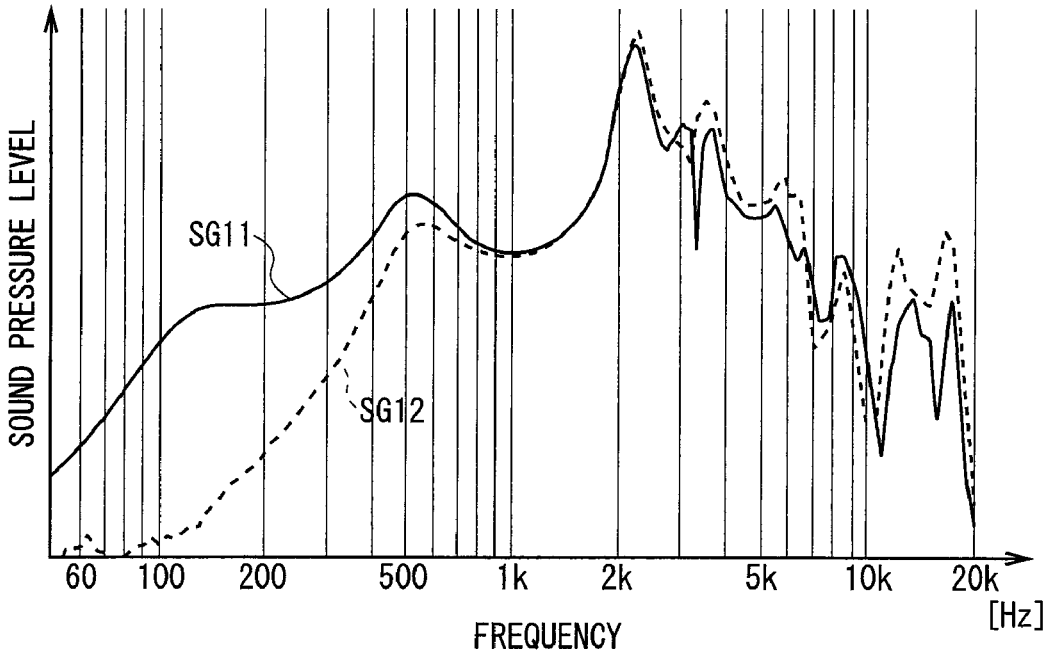
FIG. 10 is a schematic view showing a frequency characteristic based on actual measurement.

In FIG. 10, the characteristic curve SG11 of the electroacoustic transducer 2L has the sound pressure level higher than the characteristic curve SG12 of the electroacoustic transducer 12L in low frequencies of around 500 [Hz] or below, as similar to the ideal frequency characteristic shown in FIG. 9. That is, FIG. 10 shows that the electroacoustic transducer 2L can make the listener capable of listening to the excellent reproduced sound including a sufficient low-pitched sound.

In the electroacoustic transducer 2L, the tubular duct 8L is formed by metal such as aluminum having predetermined rigidity or plastic, resin, and so on having predetermined rigidity. The end part of the tubular duct 8L is made in contact with the vicinity of the entrance 102L of the external acoustic meatus. Thereby, a vibration component in the low frequencies generated at the end part of the tubular duct 8L can be allowed to reach the eardrum 103L of the listener mainly by transmission via the skin and the listener can listen to the sound.

In particular, a sense of the low frequencies can be experienced by the user in a manner that the skin of the human being vibrates due to the vibration in the low frequencies generated at the end part of the tubular duct 8L since the tubular duct 8L is made in contact with the vicinity of the entrance 102L of the external acoustic meatus, and such vibration of the skin is transmitted from a nerve of the skin to the brain.

Figure 11:
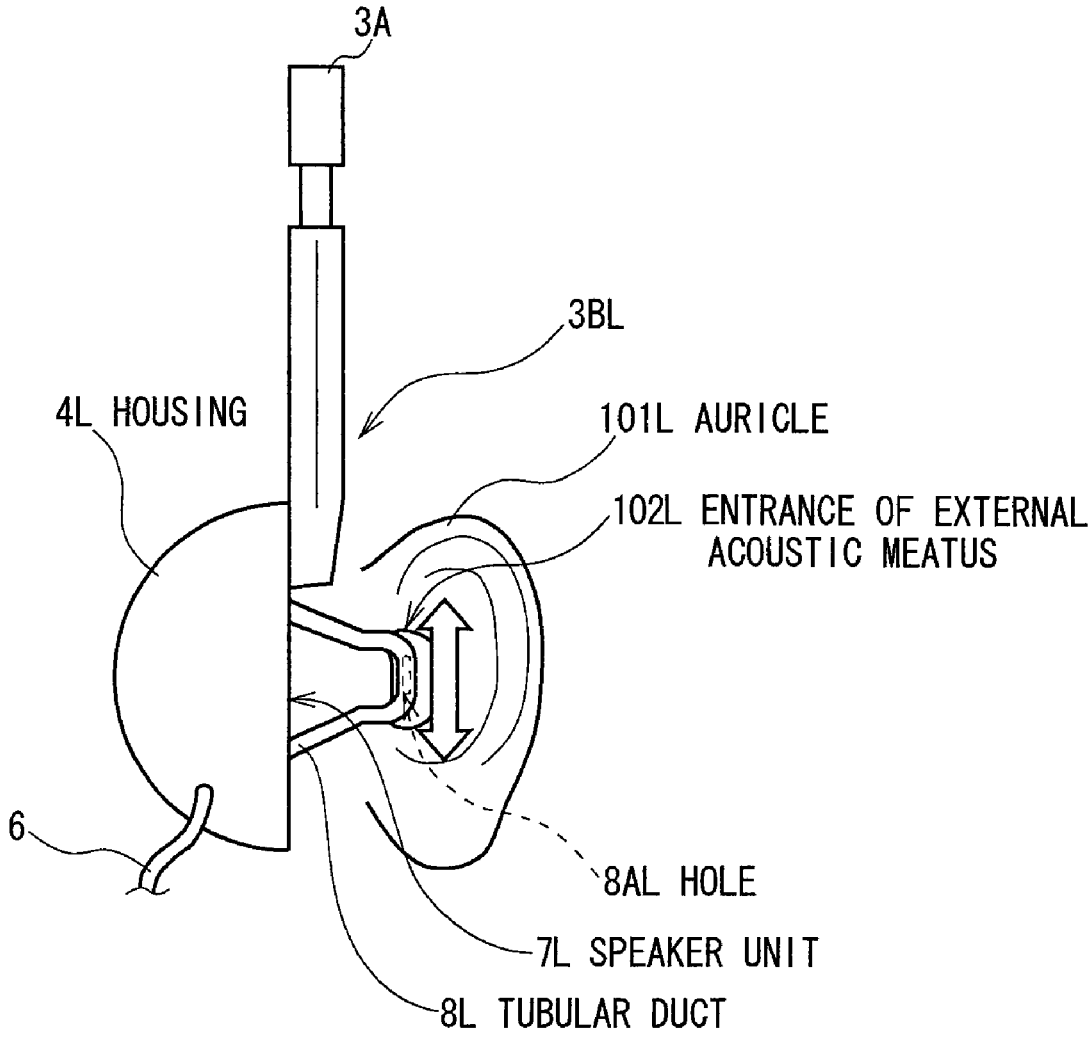
FIG. 11 is a schematic view showing a top-to-bottom amplitude direction.
Figure 12:
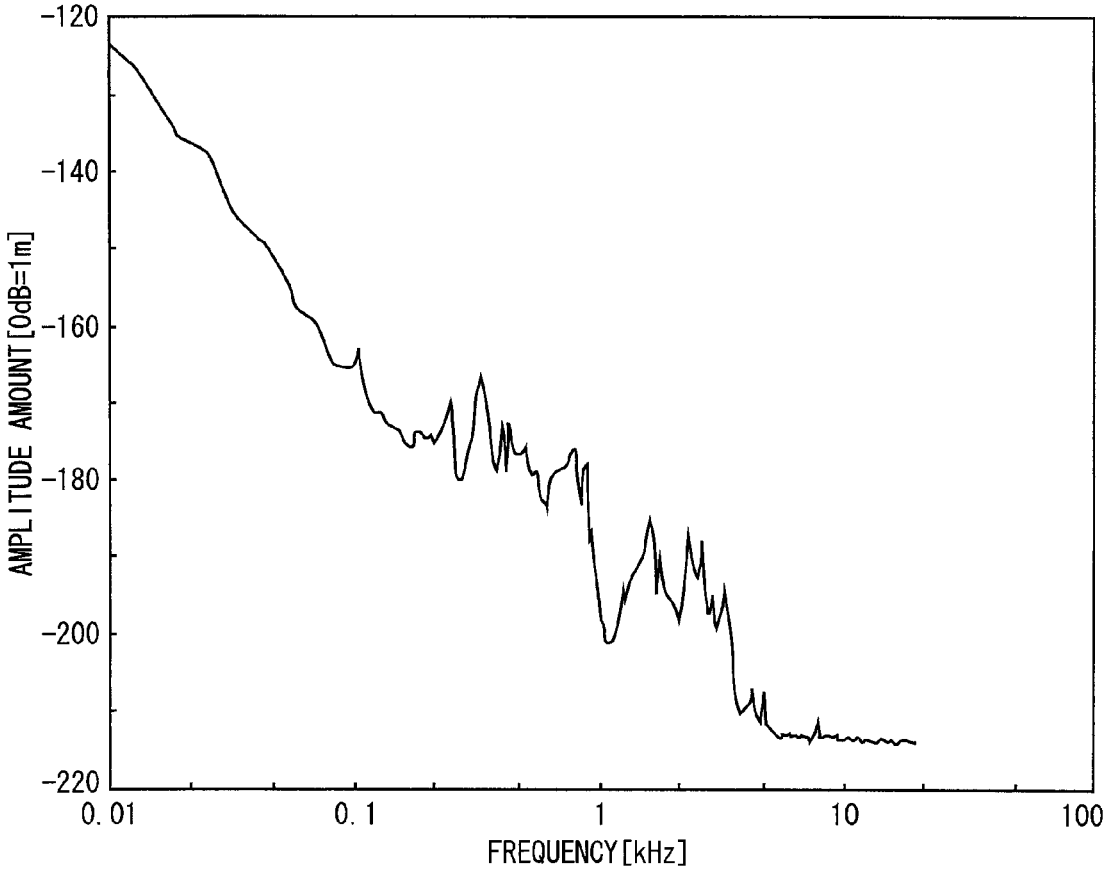
FIG. 12 is a characteristic curve showing an amplitude characteristic of low frequencies by a tubular duct.

As shown in FIG. 11, the above is shown in a result of measuring an amplitude amount in a top-to-bottom direction (bold arrow) at the end part of the tubular duct 8L. As shown in FIG. 12, it can be understood that the vibration in the top-to-bottom direction (bold arrow), that is, the amplitude amount in the top-to-bottom direction, generated at the end part of the tubular duct 8L made of hard metal such as aluminum is significantly large particularly at around 100 [Hz] or below.

Figure 13:
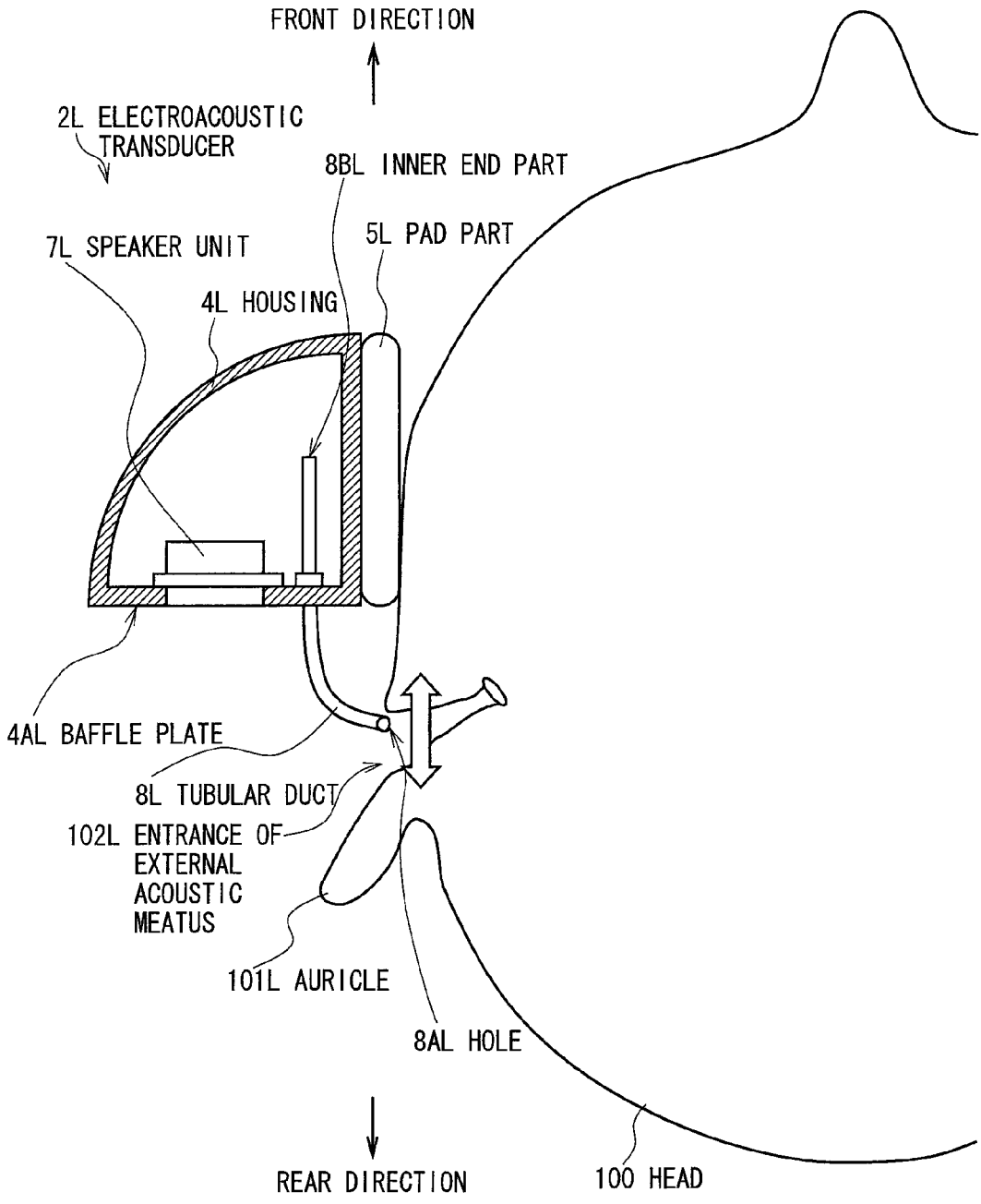
FIG. 13 is a schematic view showing a front-to-rear amplitude direction.
Figure 14:
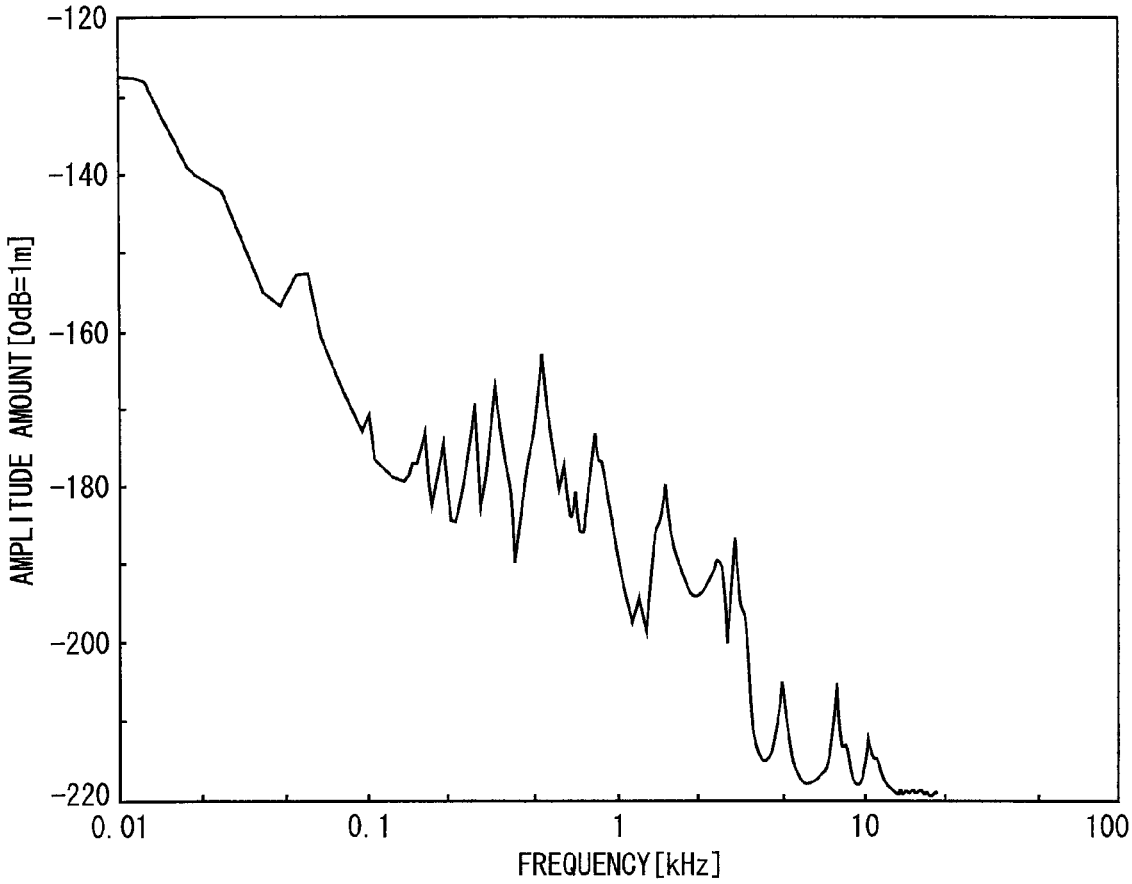
FIG. 14 is a characteristic curve showing the amplitude characteristic of low frequencies by the tubular duct.

In addition, as shown in FIG. 13, an amplitude amount of a front-to-rear direction (bold arrow) at the end part of the tubular duct 8L was measured. As a result, as shown in FIG. 14, it can be understood that the vibration in the front-to-rear direction, that is, the amplitude amount in the front-to-rear direction, generated at the end part of the tubular duct 8L made of hard metal such as aluminum is also significantly large particularly at around 100 [Hz] or below.

Figure 15:
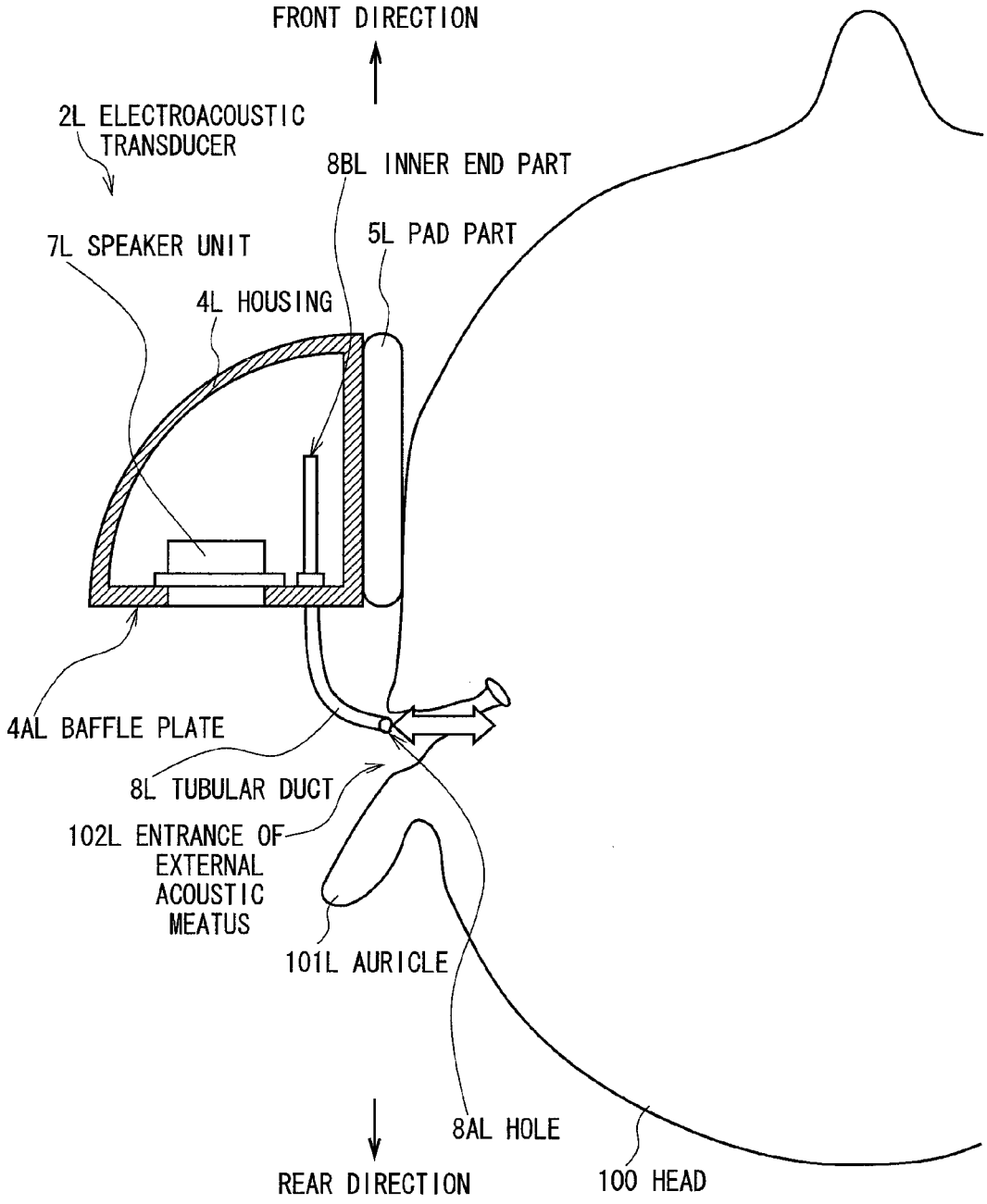
FIG. 15 is a schematic view showing a left-to-right amplitude direction.
Figure 16:
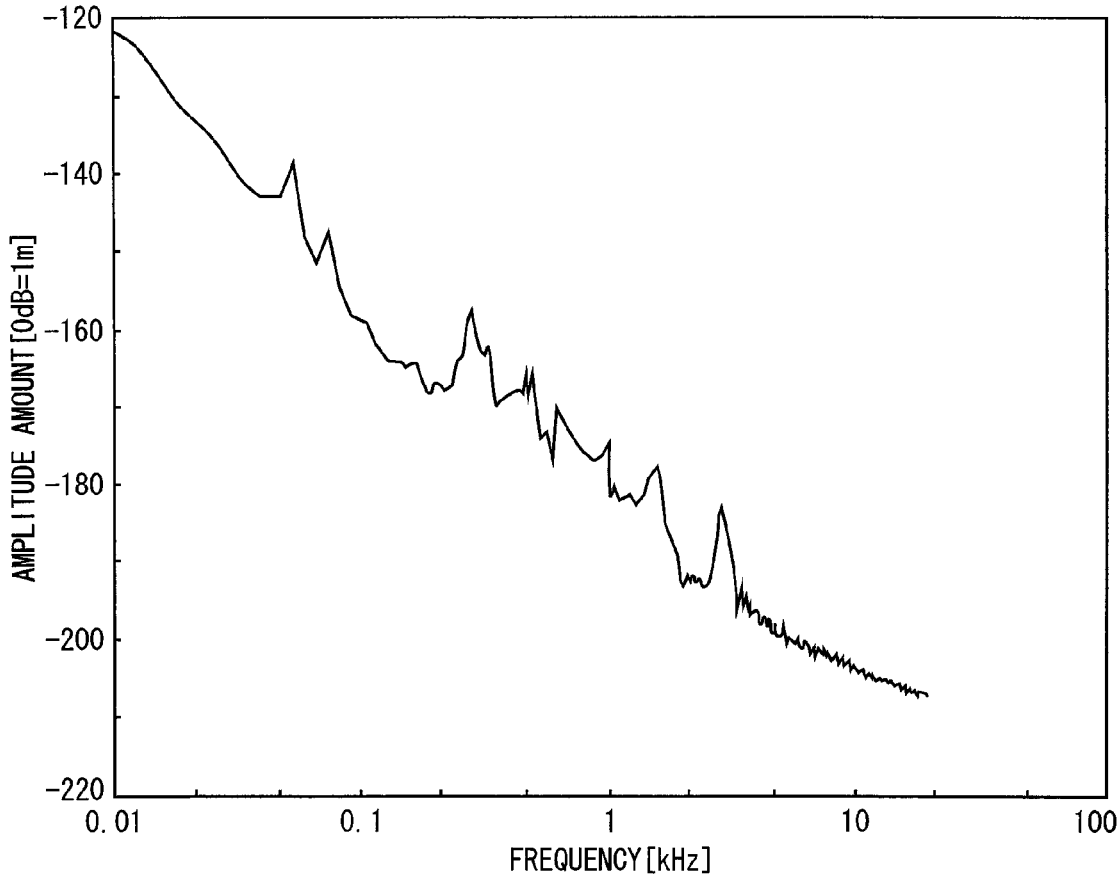
FIG. 16 is a characteristic curve showing the amplitude characteristic of low frequencies by the tubular duct.

Further, as shown in FIG. 15, an amplitude amount of a left-to-right direction (bold arrow) at the end part of the tubular duct 8L was measured. As a result, as shown in FIG. 16, it can be understood that the vibration in the left-to-right direction, that is, the amplitude amount in the left-to-right direction, generated at the end part of the tubular duct 8L made of hard metal such as aluminum is also significantly large particularly at around 100 [Hz] or below.

On the other hand, in a case where a tubular duct (not shown) formed by a soft material such as an elastomer is used in the ear speaker device 1, even if the tubular duct is made in contact with the vicinity of the entrance 102L of the external acoustic meatus, the vibration generated at an end of the tubular duct is not transmitted via the skin of the listener due to the soft material, and it is difficult to increase the sound pressure of the low-pitched sound particularly at around 100 [Hz] or below by the vibration generated at the end part of the tubular duct.

However, in the ear speaker device 1, the sound pressure level of the low-pitched sound at around 100 [Hz] or below is increased to some extent due to the tubular duct 8L working as the bass reflex duct, and therefore, the sound pressure does not drop much.

As described above, in the ear speaker device 1, the vibration in the top-to-bottom direction, the front-to-rear direction, and the left-to-right direction is largely generated with respect to the end part of the tubular duct 8L, and such vibration reaches to the eardrum 103L of the listener by the transmission via the skin of the listener. Therefore, the ear speaker device 1 is configured to make the listener capable of listening to the low-pitched sound at a sufficient level.

As described above, when the ear speaker device 1 is mounted on the head 100 of the listener, the speaker unit 7L is positioned away from the entrance 102L of the external acoustic meatus of the listener for some distance. Then, the middle-pitched and the high-pitched sounds of the reproduced sound is emitted from the speaker unit 7L, and also the low-pitched sound of the reproduced sound is emitted from the hole 8AL of the tubular duct 8L extended from the housing 4L to the vicinity of the entrance 102L of the external acoustic meatus and working as the bass reflex duct. In addition, the low-pitched sound is also transmitted to the listener mainly via the skin transmission action of the tubular duct 8L. In this manner, the ear speaker device 1 makes the listener capable of listening to the excellent reproduced sound including the sufficient low-pitched sound while providing the natural sound image localization.

(1-2) Configuration Example of Another Ear Speaker Device

As shown in FIGS. 1 to 4, the ear speaker device 1 according to the first embodiment is configured so as to mount the electroacoustic transducers 2L and 2R on the head 100 of the listener by the band part 3 as the mounting part. However, the electroacoustic transducers 2L and 2R may be mounted on the head 100 of the listener by using a variety of other mounting parts in place of the band part 3.

Hereinafter, description will be made by mainly taking the electroacoustic transducer 2L on the left side as an example as similar to the case of the ear speaker device 1 described above. With respect to the electroacoustic transducer 2R on the right side, a configuration is made in a manner symmetrical to the electroacoustic transducer 2L on the left side.

Figure 17:
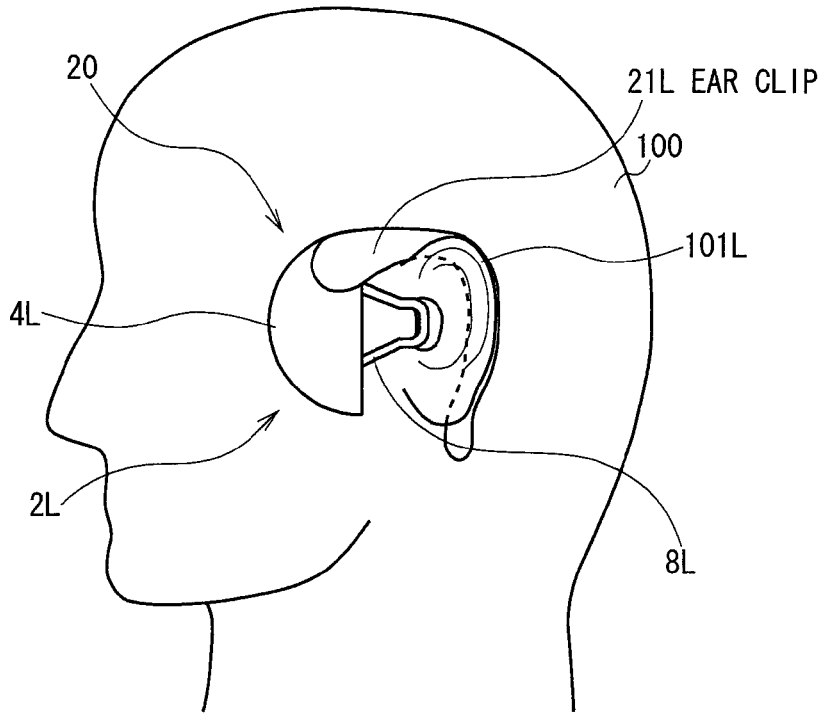
FIG. 17 is a schematic side view showing an example of a configuration and mounting of the ear speaker device according to the first embodiment.

For example, an ear speaker device 20 shown in FIG. 17 is configured as a so-called ear-clip type. In the ear speaker device 20, an ear clip 21L to be hung on an auricle 101L of the listener is attached to the housing 4L of the electroacoustic transducer 2L in place of the band part 3 in the ear speaker device 1 (FIGS. 1 to 4).

The ear speaker device 20 can have the electroacoustic transducer 2L mounted on the head 100 of the listener by hanging the ear clip 21L on the auricle 101L of the listener. In this manner, as similar to the ear speaker device 1, the ear speaker device 20 can make the listener capable of listening to the excellent reproduced sound including the sufficient low-pitched sound while providing the natural sound image localization.

Figure 18:
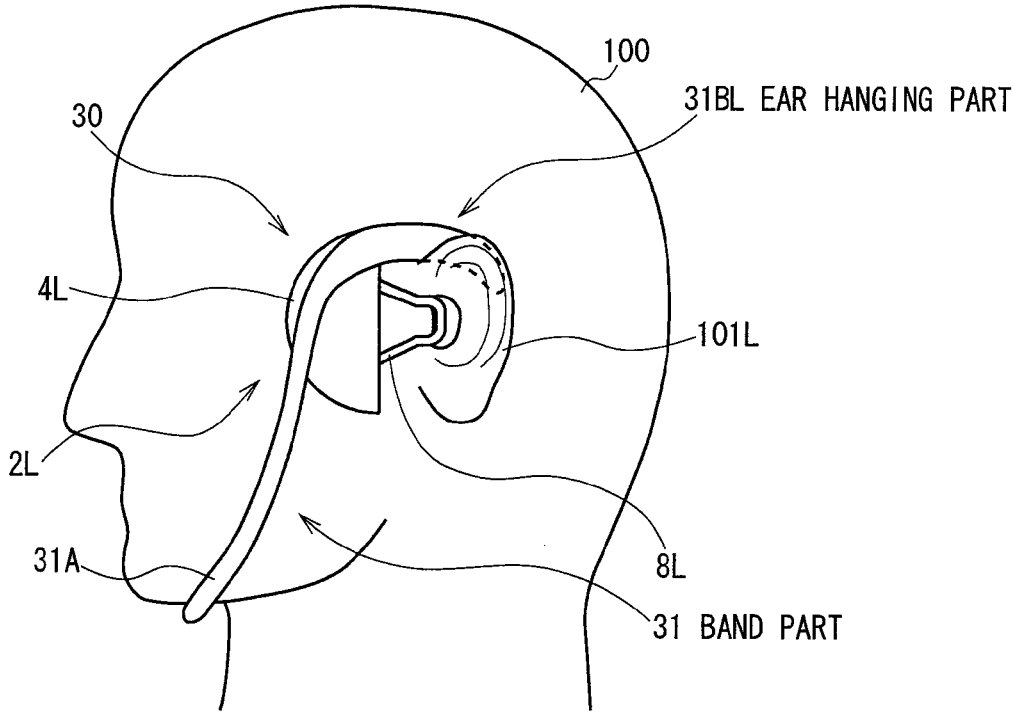
FIG. 18 is a schematic side view showing an example of the configuration and the mounting of the ear speaker device according to the first embodiment.

In addition, an ear speaker device 30 shown in FIG. 18 is configured as a so-called under-chin type. A band part 31 for connecting the electroacoustic transducers 2L and 2R on the left and the right and being hung on the auricle 101L of the listener is attached to the housing 4L in place of the band part 3 of the ear speaker device 1 (FIGS. 1 to 4). A center part 31A of the band part 31 is formed in a substantial arch shape like a U-shape, and premised to be positioned below the chin of the listener and connect the left and the right parts of the band part 31.

The ear speaker device 30 (FIG. 18) can have the electroacoustic transducer 2L mounted on the head 100 of the listener by an ear hanging part 31BL of the band part 31 being hung on the auricle 101L of the listener. As similar to the ear speaker device 1, the ear speaker device 30 can make the listener capable of listening to the excellent reproduced sound including the sufficient low-pitched sound while providing the natural sound image localization.

Figure 19:
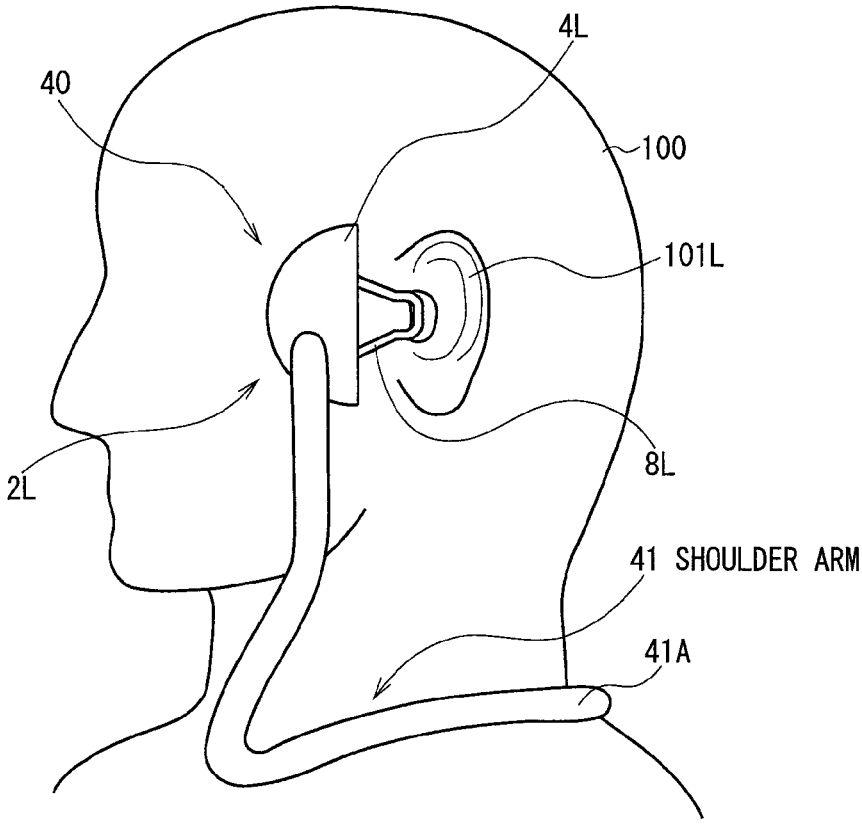
FIG. 19 is a schematic side view showing an example of the configuration and the mounting of the ear speaker device according to the first embodiment.

Further, an ear speaker device 40 shown in FIG. 19 is configured as a so-called shoulder-hold type. A shoulder arm 41 for connecting the electroacoustic transducers 2L and 2R on the left and the right and for supporting the ear speaker device 40 at a shoulder part of the listener is attached to the housing 4L in place of the band part 3 of the ear speaker device 1 (FIGS. 1 to 4). A center part 41A of the shoulder arm 41 is formed in a substantial arch shape curved around a rear side of the neck, and premised to be hung on an upper part of the shoulder from the rear side of the neck of the listener and connect the left and the right parts of the shoulder arm 41.

The ear speaker device 40 (FIG. 19) can have the electroacoustic transducer 2L mounted on the head 100 of the listener by being hung by extending to both shoulders of the listener. As similar to the ear speaker device 1, the ear speaker device 40 can make the listener capable of listening to the excellent reproduced sound including the sufficient low-pitched sound while providing the natural sound image localization.

Figure 20:
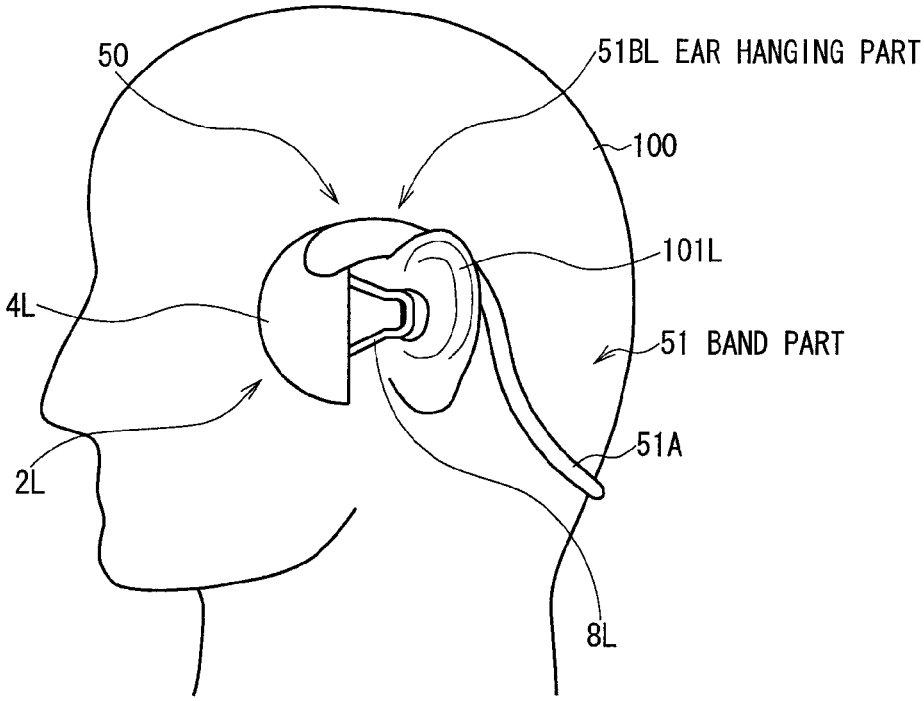
FIG. 20 is a schematic side view showing an example of the configuration and the mounting of the ear speaker device according to the first embodiment.

Further, an ear speaker device 50 shown in FIG. 20 is configured as a so-called neck-band type. A band part 51 for connecting the electroacoustic transducers 2L and 2R on the left and the right and for being hung on the auricle 101L of the listener is attached to the housing 4L in place of the band part 3 of the ear speaker device 1 (FIGS. 1 to 4). A center part 51A of the band part 51 is formed in a substantial arch shape so as to be curved around a rear side of the head, and premised to connect the left and the right parts of the band part 51 on a rear side of the back of the head of the listener.

The ear speaker device 50 (FIG. 20) can have the electroacoustic transducer 2L mounted on the head 100 of the listener by an ear hanging part 51BL of the band part 51 being hung on the auricle 101L of the listener. As similar to the ear speaker device 1, the ear speaker device 50 can make the listener capable of listening to the excellent reproduced sound including the low-pitched sound while providing the natural sound image localization.

Figure 21:
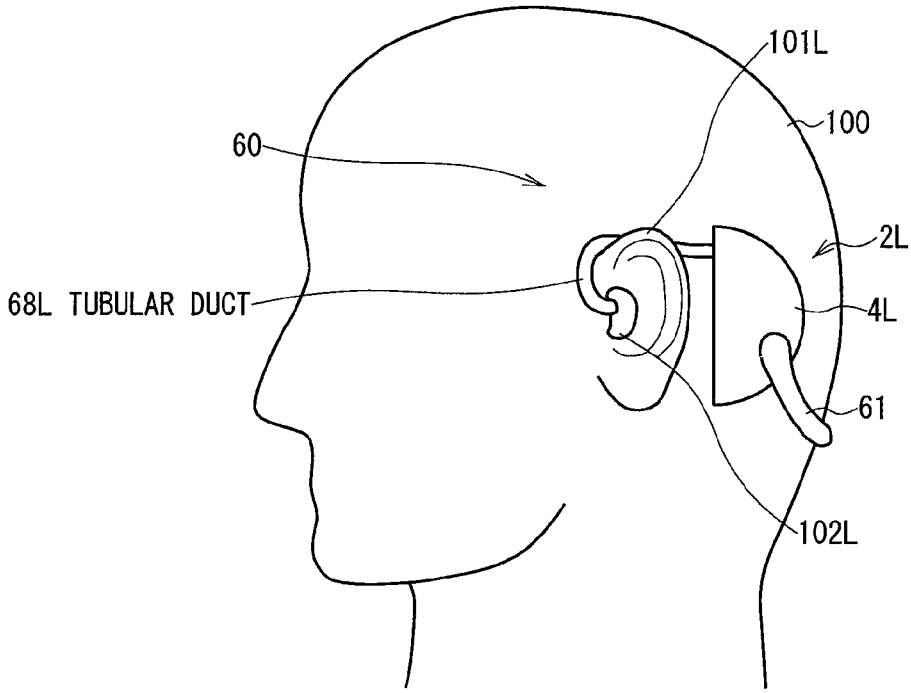
FIG. 21 is a schematic side view showing an example of the configuration and the mounting of the ear speaker device according to the first embodiment.

Further, an ear speaker device 60 shown in FIG. 21 positions the electroacoustic transducer 2L in the ear speaker device 50 shown in FIG. 20 to a position closer to the rear side than the auricle 101 of the listener. At the same time, a tubular duct 68L having a substantial L-shape extends from the housing 4L positioned on the rear side of the auricle 101 of the listener to the vicinity of the entrance 102L of the external acoustic meatus in place of the tubular duct 8L. In addition, a band part 61 positioned at the rear side of the neck of the listener connects the electroacoustic transducers 2L and 2R on the left and the right.

The ear speaker device 60 (FIG. 21) can have the electroacoustic transducer 2L mounted on the head 100 of the listener by the tubular duct 68L being hung on the auricle 101L of the listener. As similar to the ear speaker device 1, the ear speaker device 60 can make the listener capable of listening to the excellent reproduced sound including the sufficient low-pitched sound while providing the natural sound image localization.

Figure 22:
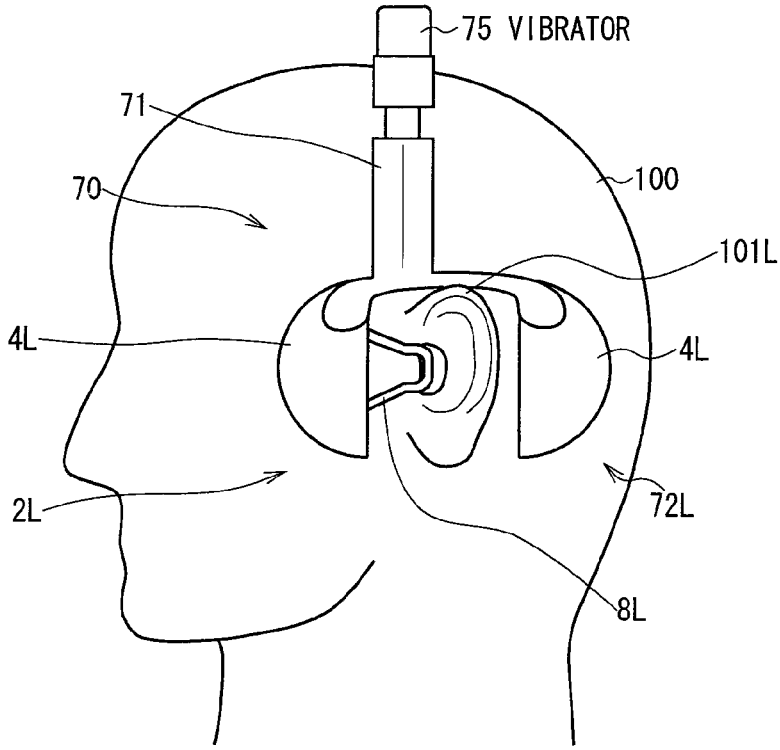
FIG. 22 is a schematic side view showing an example of the configuration and the mounting of the ear speaker device according to the first embodiment.

Further, an ear speaker device 70 shown in FIG. 22 has a rear electroacoustic transducer 72L having a similar configuration as the electroacoustic transducer 12L (FIG. 6) in addition to the electroacoustic transducer 2L. A band part 71 in place of the band part 3 in the ear speaker device 1 (FIGS. 1 to 4) positions the electroacoustic transducer 2L closer to the front than the auricle 101L, and at the same time, the band part 71 positions the rear electroacoustic transducer 72L closer to the rear side of the auricle 101L.

An audio signal for a rear channel in a multi-channel sound source such as 4-channel and 5.1-channel is configured to be supplied to the rear electroacoustic transducer 72L.

The ear speaker device 70 (FIG. 22) can have the electroacoustic transducer 2L and the rear electroacoustic transducer 72L mounted on the head 100 of the listener by being mounted on the head 100 of the listener. The ear speaker device 70 can make the listener capable of listening to the excellent reproduced sound (surround sound) including the sufficient low-pitched sound while providing the natural sound image localization in a state that the auricle 101L is sandwiched between the electroacoustic transducer 2L and the rear electroacoustic transducer 72L.

In addition, in the above case, the ear speaker device 70 (FIG. 22) may have a vibrator 75 attached to the band part 71, and vibration corresponding to a deep bass component in a 5.1-channel sound source may be generated on the head 100 of the listener, for example.

The ear speaker device 70 (FIG. 22) may have the tubular duct extended from the rear electroacoustic transducer 72L to the vicinity of the entrance 102L of the external acoustic meatus of the listener as similar to the ear speaker device 60 (FIG. 21), or may have the tubular duct extended from both the electroacoustic transducer 2L and the rear electroacoustic transducer 72L to the vicinity of the entrance 102L of the external acoustic meatus of the listener, in addition to having the tubular duct 8L extended from the electroacoustic transducer 2L to the vicinity of the entrance 102L of the external acoustic meatus of the listener.

Figure 23:
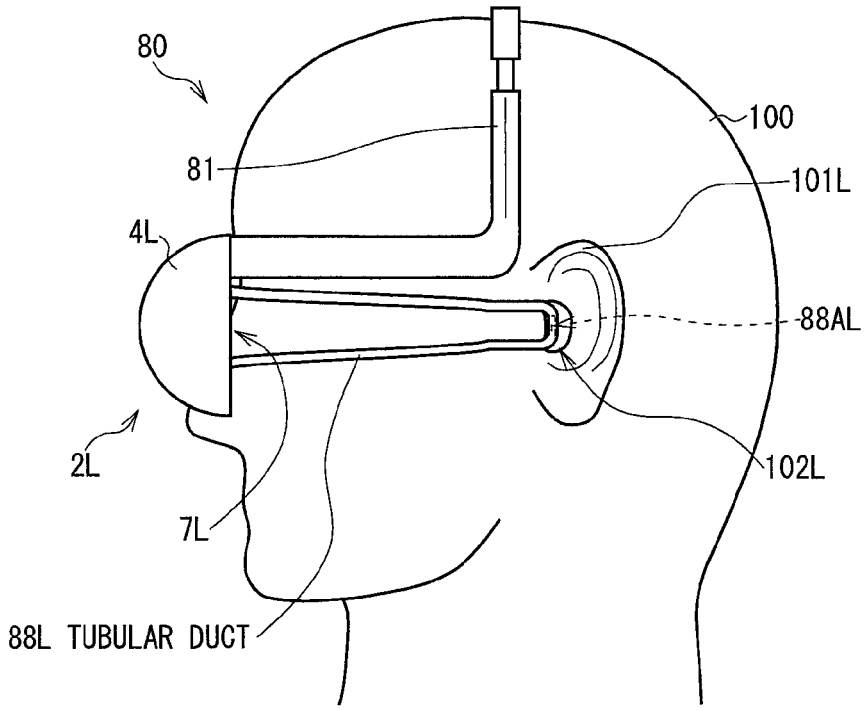
FIG. 23 is a schematic side view showing an example of the configuration and the mounting of the ear speaker device according to the first embodiment.

Further, an ear speaker device 80 shown in FIG. 23 has a band part 81 for connecting the electroacoustic transducers 2L and 2R on the left and the right and for positioning the electroacoustic transducers closer to the front than the cheeks of the listener attached to the housing 4L in place of the band part 3 of the ear speaker device 1 (FIGS. 1 to 4).

In addition, the housing 4L has a tubular duct 88L extended from the housing 4L to the vicinity of the entrance 102L of the external acoustic meatus of the listener provided thereto in place of the tubular duct 8L. The tubular duct 88L has its inner diameter, path length of a sound, and so on appropriately calculated so as to emit the excellent low-pitched sound of the reproduced sound from the hole 88AL.

The ear speaker device 80 (FIG. 23) can position the housing 4L closer to the front than the cheek of the listener by being mounted on the head 100 of the listener. In this case, the middle-pitched and the high-pitched sounds emitted from the speaker unit 7L have their characteristic changed by being reflected on the cheeks of the listener and so on. Therefore, the middle-pitched and the high-pitched sounds are made even closer to the sound emitted from the general stationary speaker as compared with the ear speaker device 1. In this manner, the ear speaker device 80 can make the listener capable of listening to the reproduced sound that can provide even more natural localization.

As described above, according to the present invention, the electroacoustic transducers 2L and 2R may be mounted on the head 100 of the listener by the mounting parts in a variety of modes such as the ear speaker devices 20 to 80 (FIGS. 17 to 23) in addition to the band part 3 (FIGS. 1 to 4) of the ear speaker device 1.

(1-3) Operation and Advantageous Effect of First Embodiment

In the above configuration, the ear speaker device 1 is mounted on the head 100 of the listener, thereby the speaker unit 7L provided to the housing 4L of the electroacoustic transducer 2L is positioned somewhat closer to the front than the entrance 102L of the external acoustic meatus of the listener. At the same time, the ear speaker device 1 outputs the reproduced sound based on the audio signal supplied from a predetermined amplifier in a state that the end part of the tubular duct 8L extended to the rear side from the housing 4L and working as the bass reflex duct is positioned in the vicinity of the entrance 102L of the external acoustic meatus.

At this time, with respect to the electroacoustic transducer 2L (FIG. 5) of the ear speaker device 1, the path length EL1 which the low-pitched sound emitted from the hole 8AL of the tubular duct 8L reaches the eardrum 103L of the listener is shorter than the path length EM which the middle-pitched and the high-pitched sounds after emitted from the speaker unit 7L reach the eardrum 103L. Therefore, the electroacoustic transducer 2L can allow the low-pitched sound having a comparatively higher sound pressure level as shown in the characteristic curve SL1 than the middle-pitched and the high-pitched sounds as shown in the characteristic curve SM (FIG. 7) to reach the eardrum 103L.

As described above, the electroacoustic transducer 2L of the ear speaker device 1 can allow the middle-pitched and the high-pitched sounds emitted from the speaker unit 7L to reach the eardrum 103L after being reflected by the cheek, the auricle 101L, and so on of the listener. Therefore, the electroacoustic transducer 2L can make the reproduced sound having a characteristic similar to the case where the reproduced sound is listened to via the general speaker, and in this manner the electroacoustic transducer 2L can provide a natural sense of localization as though the sound image is positioned outside the head.

Further, the electroacoustic transducer 2L of the ear speaker device 1 has the tubular duct 8L extended to the vicinity of the entrance 102L of the external acoustic meatus of the listener. In this manner, the electroacoustic transducer 2L can make the listener capable of listening to the excellent reproduced sound that has the comparatively excellent sound pressure level down to the low frequencies as shown in the characteristic curve SG1 (FIG. 9) and the characteristic curve SG11 (FIG. 10).

In this case, the electroacoustic transducer 2L of the ear speaker device 1 has the tubular duct 8L extended to the vicinity of the entrance 102L of the external acoustic meatus of the listener. Therefore, as compared with the low-pitched sound as shown in the characteristic curve SL2 (FIG. 7) output from the tubular ducts 18L and 19L in the bass-reflex type electroacoustic transducer 12L (FIG. 6) generally used, the ear speaker device 1 can allow the low-pitched sound having a high sound pressure level as shown in the characteristic curve SL1 (FIG. 7) to reach the eardrum 103L of the listener. As a result, the ear speaker device 1 can make the listener capable of listening to, at the sufficient sound pressure level, the low-pitched sound that tends to be insufficient due to reasons that the speaker unit 7L has a comparatively small diameter and is located somewhat distant from the entrance 102L of the external acoustic meatus.

Further, the ear speaker device 1 does not increase reproducing sound volume of the low-pitched sound, but puts the hole 8AL of the tubular duct 8L which is an emission aperture of the low-pitched sound closer to the eardrum 103L to allow the sufficient low-pitched sound to reach the eardrum 103L (FIG. 5) of the listener, and at the same time, transmit the low frequency component of the vibration generated at the end part of the tubular duct 8L to the auditory sense (brain) of the listener through the skin. Therefore, as compared with a case where the low-pitched sound is reproduced by using a speaker having a large diameter, a subwoofer, and so on, leakage of the low-pitched sound and vibration can be minimized.

Therefore, in a case that the listener listens to the reproduced sound via the ear speaker device 1 late at night, for example, the listener can enjoy the excellent reproduced sound including the sufficient low-pitched sound without too much caring about whether the neighbors and the surroundings are disturbed.

The tubular duct 8L does not block the entrance 102L of the external acoustic meatus of the listener. Therefore, the ear speaker device 1 can allow, without blocking, the surround sound generated around the listener to reach the eardrum 103L and can make the listener capable of listening to the surround sound together with the reproduced sound.

In the above manner, the ear speaker device 1 can make the listener capable of reliably listening to the surround sound in addition to the excellent reproduction sound even in a case where the listener needs to listen to the surround sound, such as when the listener is walking or playing some sports.

The ear speaker device 1 does not cover the auricle 101L and so on of the listener by the electroacoustic transducer 2L like a conventional closed-type headphone. Therefore, the ear speaker device 1 does not cause uncomfortableness such as a cooped-up feeling and sweatiness the listener feels when the listener wears the closed-type headphone. Further, the ear speaker device 1 does not form closed space, therefore the ear speaker device 1 does not generate a change of a resonance frequency in the external acoustic meatus which may be generated in a case of using the closed-type headphone, and does not make the listener uncomfortable.

In addition, the ear speaker device 1 can make the listener capable of listening to the low-pitched sound at the sufficient sound volume level by putting the hole 8AL of the tubular duct 8L which is the emission aperture of the low-pitched sound close to the eardrum 103L. Therefore, the diameter of the speaker unit 7L does not need to be made bigger than necessary, and size of the housing 4L can be limited to be minimum. In this manner, the entire size and mass of the speaker device 1 can be limited to be minimum, therefore troublesomeness caused by the size and the mass of the ear speaker device 1 when the listener wears the ear speaker device 1 can be restricted as much as possible.

According to the configuration described above, the ear speaker device 1 positions the speaker unit 7L of the electroacoustic transducer 2L somewhat closer to the front than the entrance 102L of the external acoustic meatus of the listener when the ear speaker device 1 is mounted on the head 100 of the listener. At the same time, the reproduced sound is output in a state that the hole 8AL of the tubular duct 8L is positioned in the vicinity of the entrance 102L of the external acoustic meatus. In this manner, the ear speaker device 1 can allow the low-pitched sound emitted from the hole 8AL of the tubular duct 8L working as the bass reflex duct to reach the eardrum 103 at the sufficient sound pressure level. Therefore, the ear speaker device 1 can make the listener capable of listening to the excellent reproduced sound having the sufficient sound pressure level down to the comparatively low frequencies while providing the natural sound image localization.

(1-4) Another Embodiment with Respect to First Embodiment

In the first embodiment described above, the description is made with respect to the case where the tubular duct 8L has a side surface formed in a substantial U-shape and is made to function as the two bass reflex ducts with the hole 8AL in the middle. However, the present invention is not limited thereto, and the tubular duct 8L may be configured with one or three or more tubular ducts.

Figure 24:
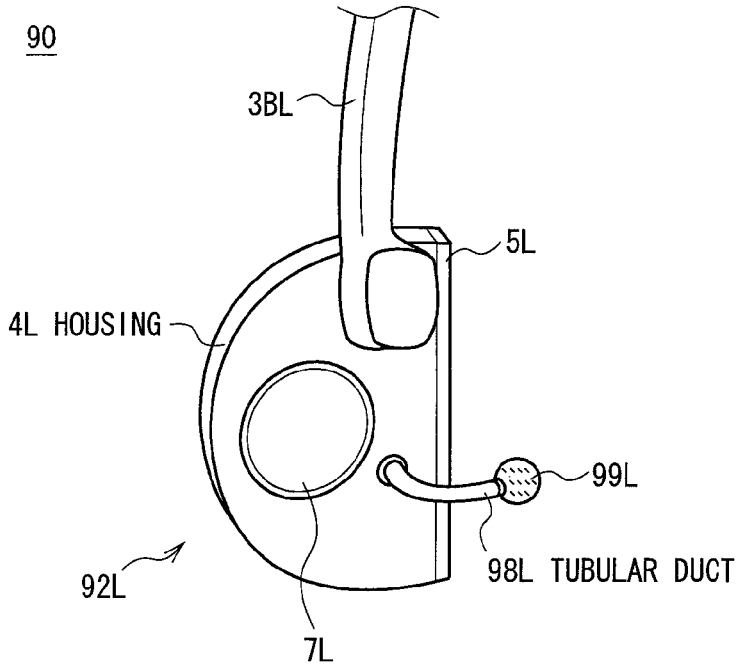
FIG. 24 is a schematic perspective view showing a configuration example of the tubular duct according to another embodiment.

For example, as shown in FIG. 24, in an electroacoustic transducer 92L of an ear speaker device 90, one tubular duct 98L functioning as the bass reflex duct may extend from the housing 4L to the rear direction. Further, a protective part 99L for protecting the entrance 102L of the external acoustic meatus of the listener may be attached to the end part of the tubular duct 98L. In this case, the protective part 99L is configured with a sponge member and the like through which a sound can easily pass through. Thereby, the surround sound is not blocked and can be listened to by the listener.

In addition, in the first embodiment, the description was made with respect to the case of using the tubular duct 8L made of a hard material such as metal. However, the present invention is not limited thereto, and the tubular duct 8L made of a soft material such as flexible resin may be used.

Further, in the first embodiment, the description was made with respect to the case that the tubular duct 8L is provided so as to pass through the baffle plate 4AL of the housing 4L. However, the present invention is not limited thereto, and the tubular duct 8L may be provided so as to pass through another side surface of the housing 4L.

Further, in the first embodiment, the description was made with respect to the case where the sound emitting surface of the speaker unit 7L is oriented to a substantially rear direction when the ear speaker device 1 is mounted on the head 100 (FIG. 4) of the listener. However, the present invention is not limited thereto, and for example, the sound emitting surface of the speaker unit 7L may be oriented somewhat to the inner side. What is important here is that the sound emitting surface of the speaker unit 7L needs to be directed to a substantial direction of the entrance 102L of the external acoustic meatus, and the middle-pitched and the high-pitched sounds being emitted need to be allowed to efficiently reach the eardrum 103L.

Further, in the first embodiment, the description was made with respect to the case where the ear speaker device 1 has the left and the right electroacoustic transducers 2L and 2R, and outputs the reproduced sound of two channels. However, the present invention is not limited thereto, and, for example, the ear speaker device 1 may have only the electroacoustic transducer 2L on the left side and output the reproduced sound of one channel.

Further, in the first embodiment, the description was made with respect to the case where the speaker unit 7L for the middle-pitched and the high-pitched sounds is provided in the housing 4L. However, the present invention is not limited thereto, and a plurality of speaker units may be provided in the housing 4L in a manner that, for example, two speaker units for the middle-pitched sound and the high-pitched sound are provided in the housing 4L to configure a two-way speaker.

Further, in the first embodiment, the description was made with respect to the case where the housing 4L having a shape of a ball being quartered in a vertical direction. However, the present invention is not limited thereto, and for example, the housing 4L may have any of a variety of shapes such as a cube shape and a cylinder shape. What is important here is that the housing 4L needs to have substantially closed space that can function as an enclosure of the bass reflex speaker in the inside.

Further, in the first embodiment, the description was made with respect to the case of the housing 4L in a state of having an edge remaining at an end part of an inner end part 8BL of the tubular duct 8L (FIG. 5). However, the present invention is not limited thereto, and the housing 4L having roundness of an R-shape formed with respect to the end part of the inner end part 8BL of the tubular duct 8L may be used. In this case, in the housing 4L, air pushed out from a rear surface side of the speaker unit 7L does not hit the edge to generate wind noise, and only the low-pitched sound without the noise can be emitted from the hole 8AL of the tubular duct 8L.

Further, in the first embodiment, the description was made with respect to the case where the tubular ducts 8L and 8R are attached to the housings 4L and 4R in an integrated manner. However, the present invention is not limited thereto, the tubular ducts 8L and 8R may be configured to be attachable and detachable.

Figure 25:
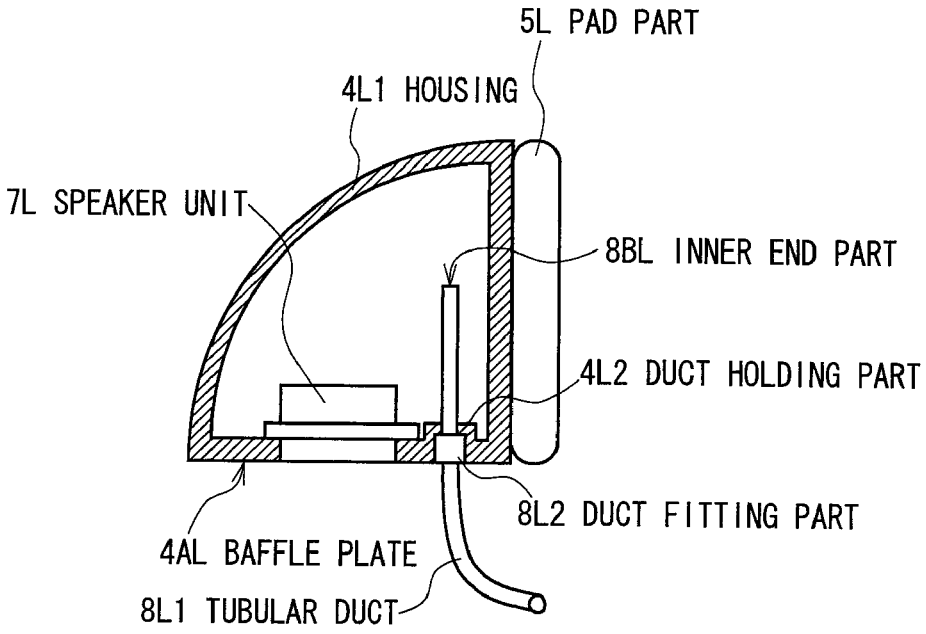
FIG. 25 is a schematic perspective view showing the configuration example of the tubular duct according to another embodiment.

For example, as shown in FIG. 25 in which a corresponding part is attached with the same numerical number as found in FIG. 5, in a housing 4L1, a duct fitting part 8L2 of the tubular duct 8L1 is fitted and attached to a duct holding part 4L2 having a concave shape formed on the baffle plate 4AL of the housing 4L1. In addition, by releasing the fitting state of the duct holding part 4L2 and the duct fitting part 8L2, the tubular duct 8L1 can be detached.

Further, in the first embodiment, the description was made with respect to the case of using the tubular duct 8L having duct length from the hole 8AL to both the inner end parts 8BL is set to be the same length. However, the present invention is not limited thereto, and a tubular duct having the duct length different from the other may be used.

Figure 26:
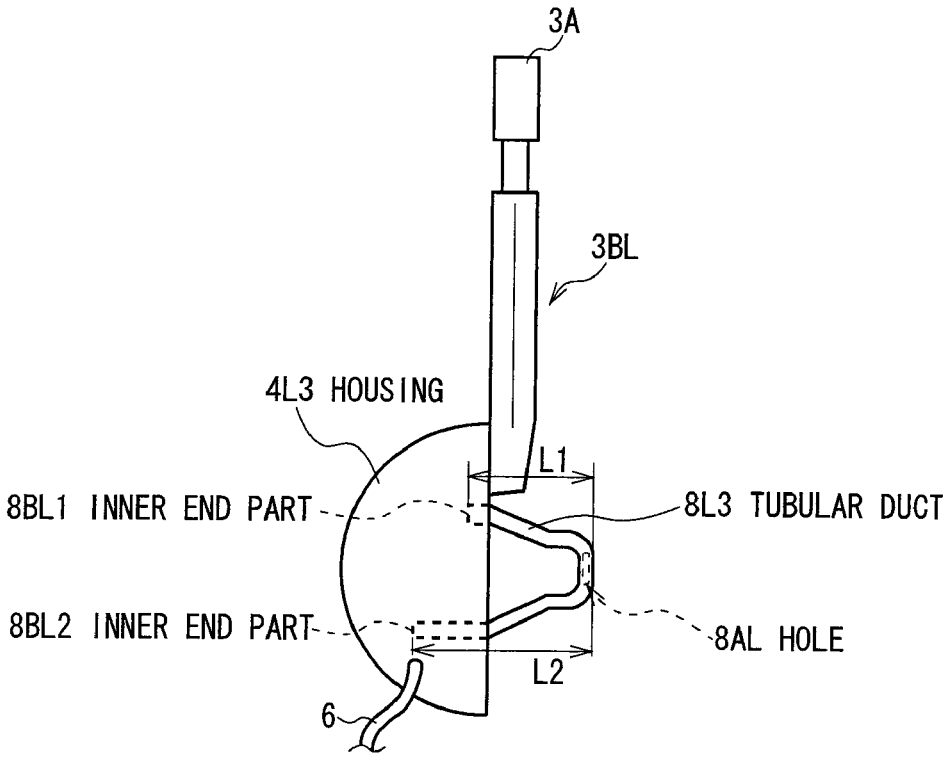
FIG. 26 is a schematic perspective view showing the configuration example of the tubular duct according to another embodiment.

For example, as shown in FIG. 26 in which a corresponding part is attached to with the same numerical number as found in FIG. 4, in a housing 4L3 provided with a tubular duct 8L3 having length L1 from the hold 8AL to an inner end part 8BL1 and length L2 from the hole 8AL to an inner end part 8BL2 which are different from each other, there is a phase shift of a resonant characteristic generated between a duct part of the length L1 and a duct part of the length L2. As a result, a frequency component of the middle-pitched and the high-pitched frequencies slightly output from the hole 8AL is cancelled, and only the low-pitched sound from which the middle-pitched and the high-pitched sounds are eliminated can be emitted from the hole 8AL of the tubular duct 8L3.

Further, in the first embodiment, the description was made with respect to the case where the housings 4L and 4R are held in a state that the pad parts 5L and 5R of the housings 4L and 4R are made in contact with the head of the listener by the elastic force of the band part 3. However, the present invention is not limited thereto, and the housings 4L and 4R may be held by having the ear hanger hung on an ear of the listener. In this case, the ends of the tubular ducts 8L and 8R are actively pressed to the vicinity of the entrance of the external acoustic meatus, and the low-pitched sound can be easily transmitted to the listener by the skin transmission action described above.

Figure 27:
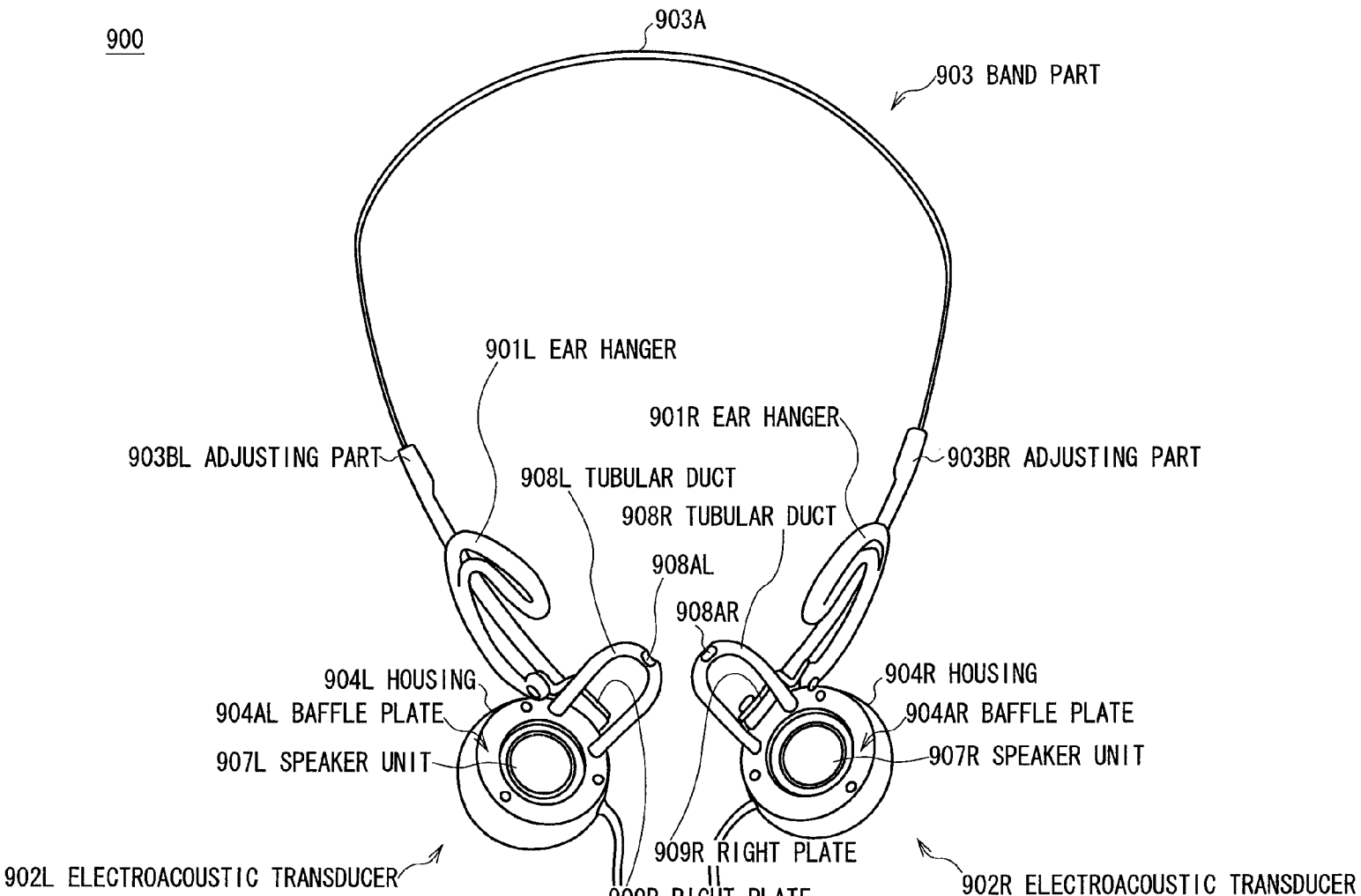
FIG. 27 is a schematic perspective view showing an entire configuration of the ear speaker device according to another embodiment.
Figure 28:
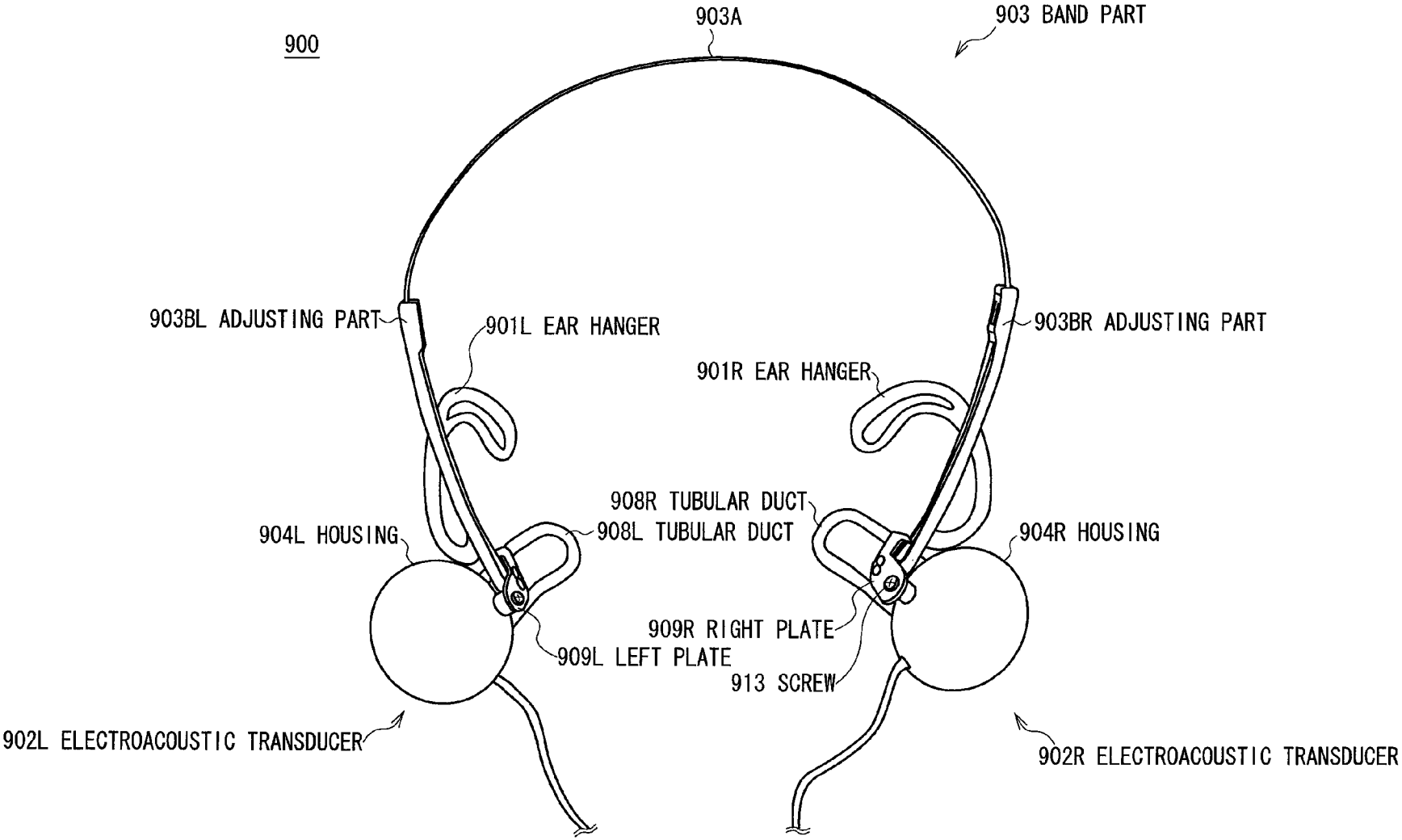
FIG. 28 is a schematic perspective view showing the entire configuration of the ear speaker device according to another embodiment.

More specifically, as shown in FIGS. 27 and 28, an ear speaker device 900 is configured with electroacoustic transducers 902L and 902R that convert the audio signal to the reproduced sound, and a band part 903 for mounting and fixing the electroacoustic transducers 902L and 902R on the head of the listener.

The electroacoustic transducers 902L and 902R have housings 904L and 904R having a hemispherical shape, and have speaker units 907L and 907R that convert the audio signal to the reproduced sound attached to baffle plates 904AL and 904AR which are plane surface parts of the housings 904L and 904R.

In addition, tubular ducts 908L and 908R made of metal such as aluminum having predetermined rigidity or plastic, resin, and so on having predetermined rigidity, and having a hollow member having predetermined thickness that is curved in a substantial U-shape on a side surface are attached to the baffle plates 904AL and 904AR of the housings 904L and 904R.

The tubular ducts 908L and 908R have their end parts curved to an inner side direction to the left or the right respectively. Further, holes 908AL and 908AR are provided on a substantial center of the respective end parts in a state of being oriented to an opposite direction of the entrance of the external acoustic meatus of the listener.

The band part 903 is formed in a substantial arch shape so as to surround an upper part of the head of a general human by centering on a center part 903A. At the same time, the entire length of the band part 903 is made adjustable by using adjusting parts 903BL and 903BR that can slide with respect to the center part 903A in an extendible manner.

In addition, the band part 903 is formed in the arch shape having a diameter smaller than the shape of the head of the general human being and also has elastic force. Therefore, when the ear speaker device is mounted on the listener while the housings 904L and 904R are extended to the left and the right, respectively, the band part 903 tends to return to the normal shape by action of the elastic force after the mounting. In this manner, the housings 904L and 904R are held at a position on the front of the auricle of the listener.

At this time, in the ear speaker device 900, ear hangers 901L and 901R are attached to the adjusting parts 903BL and 903BR of the band part 903 with a left plate 909L and a right plate 909R interposed therebetween, respectively.

Next, description will be made with respect to a state that the ear hangers 901L and 901R are attached to the adjusting parts 903BL and 903BR. A state that the ear hanger 901L is attached to the adjusting part 903BL and a state that the ear hanger 901R is attached to the adjusting part 903BR are similar to each other. Therefore, for convenience, description will be made only with respect to the state that the ear hanger 901R is attached to the adjusting part 903BR.

Figure 29:
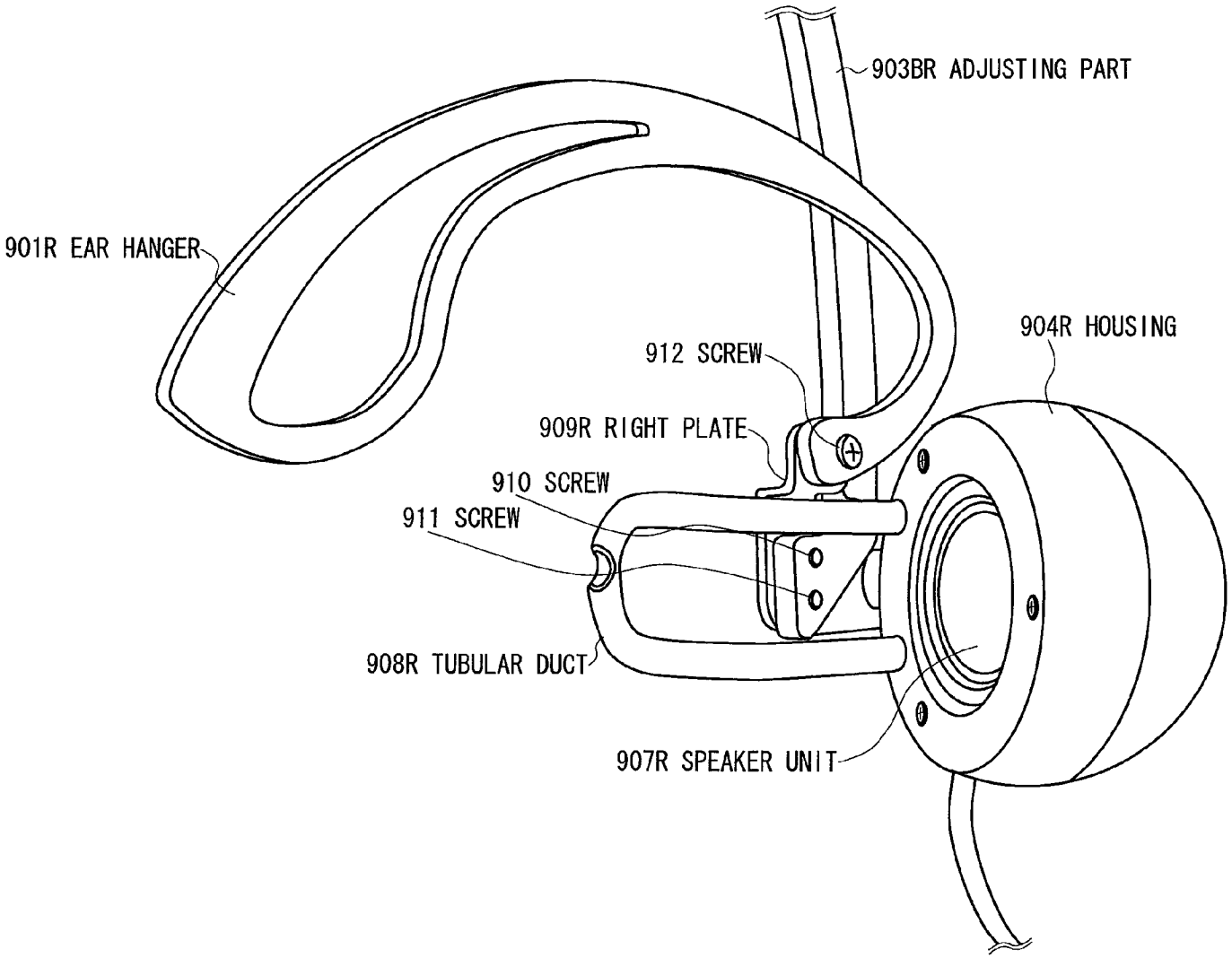
FIG. 29 is a schematic perspective view showing a mounting state of an ear hanger.
Figure 30:
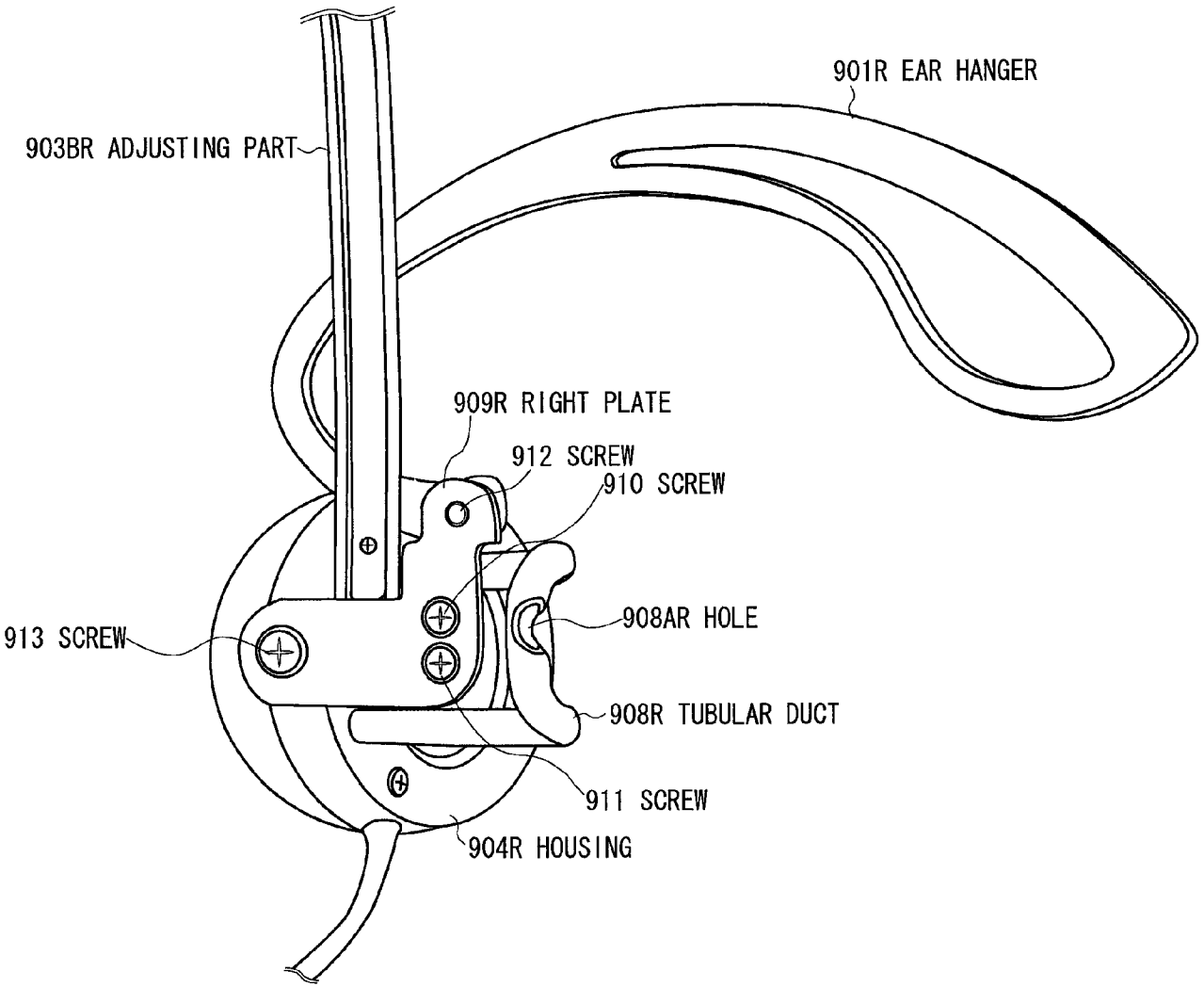
FIG. 30 is a schematic perspective view showing the mounting state of the ear hanger.
Figure 31:
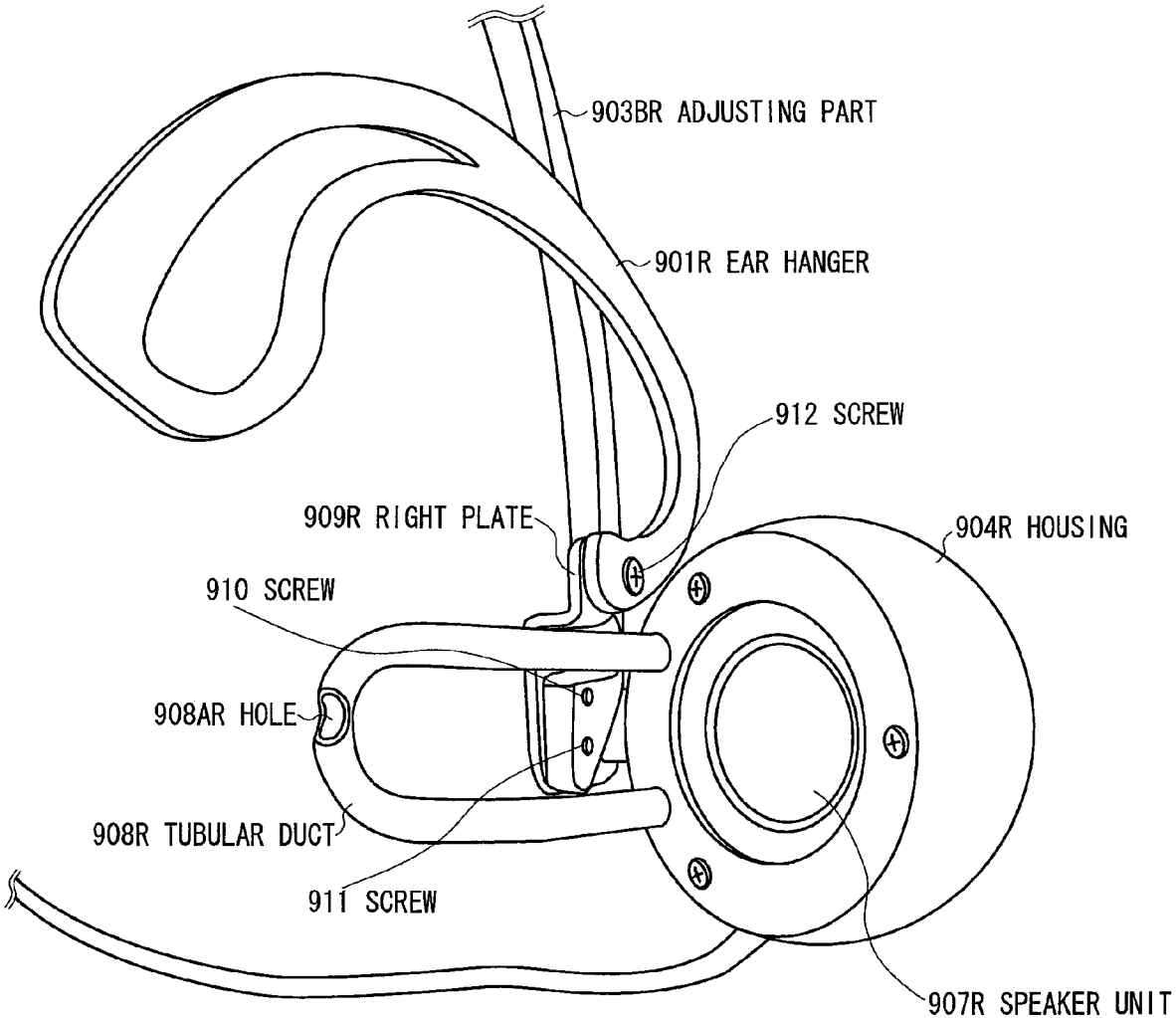
FIG. 31 is a schematic perspective view showing the mounting state of the ear hanger.

As shown in FIGS. 29 to 31, the right plate 909R is attached to the housing 904R with a screw 913. At the same time, the right plate 909R is attached to an end of the adjusting part 903BR by screws 910 and 911. In this state, the ear hanger 901R having a curved shape so as to be able to be hung along a shape of the auricle is attached to the end part of the right plate 909R positioned at an outer position than the adjusting part 903BR with a screw 912.

Therefore, the ear speaker device 900 is configured such that, when the ear hangers 901L and 901R attached to the adjusting parts 903BL and 903BR of the band part 903 are hung on the auricles of the listener, the housing parts 904L and 904R can be held at the position in front of the auricles by action of holding the auricles of the listener by the ear hangers 901L and 901R. At the same time, the ends of the tubular ducts 908L and 908R are kept pressed against the vicinity of the entrance of the external acoustic meatus.

In the above manner, the ear speaker device 900 can effectively exert the skin transmission action by the tubular ducts 908L and 908R described above, and makes the listener capable of sufficiently listening to the low-pitched sound output from the holes 908AL and 908AR of the tubular ducts 908L and 908R.

The tubular ducts 908L and 908R have their ends formed in a substantial U-shape. Therefore, although the tubular ducts 908L and 908R are kept pressed against the vicinity of the entrance of the external acoustic meatus of the listener, the tubular ducts do not enter the inside of the external acoustic meatus. In the above manner, the ear speaker device 900 is configured to be able to prevent that the tubular ducts 908L and 908R hurt the inside of the external acoustic meatus in error when the listener wears the ear speaker device 900.

In the ear speaker device 900, the holes 908AL and 908AR of the tubular ducts 908L and 908R are oriented to the opposite direction of the entrance of the external acoustic meatuses of the listener. However, since the low-pitched sound emitted from the holes 908AL and 908AR of the tubular ducts 908L and 908R does not have directivity, the low-pitched sound can ensure to be allowed to reach the external acoustic meatus of the listener. On the other hand, the middle-pitched and the high-pitched sounds slightly leaked and emitted from the holes 908AL and 908AR hardly reach the external acoustic meatus of the listener, since the holes 908AL and 908AR of the tubular ducts 908L and 908R are oriented to the opposite direction of the entrance of the external acoustic meatuses and the middle-pitched and the high-pitched sounds have directivity.

Therefore, the ear speaker device 900 outputs the middle-pitched and the high-pitched sounds of the reproduced voice from the speaker units 907L and 907R and allows these sounds to reach the entrance of the external acoustic meatuses of the listener. At the same time, the ear speaker device 900 allows only the low-pitched sound of the reproduced voice from the hole 908AL and 908AR of the tubular ducts 908L and 908R to reach the entrance of the external acoustic meatuses of the listener. On the other hand, since the middle-pitched and the high-pitched sounds slightly leaked are output from the holes 908AL and 908AR oriented to the opposite directions of the entrance of the external acoustic meatus of the listener in a state of having directivity. Therefore, the middle-pitched and the high-pitched sounds being leaked do not reach the entrance of the external acoustic meatus of the listener, and do not apply an adverse effect to the sound image localization of the listener that the middle-pitched and the high-pitched sounds mainly act on.

In the above manner, the ear speaker device 900 makes the listener capable of listening to the low-pitched sound at a sufficient level via the holes 908AL and 908AR of the tubular ducts 908L and 908R while providing the natural sound image localization by the middle-pitched and the high-pitched sounds output from the speaker units 907L and 907R.

The positions of the holes 908AL and 908AR are not limited to the positions described above. The holes 908AL and 908AR may be positioned at any place on the tubular ducts 908L and 908R as long as the holes are oriented to the opposite directions of the entrances of the external acoustic meatuses of the listener.

Further, in the first embodiment, the description was made with respect to the case where the electroacoustic transducers 2L and 2R as the electroacoustic transducers are configured with the housings 4L and 4R as the housing, the speaker units 7L and 7R as the speaker unit, and the tubular ducts 8L and 8R as the tubular duct. However, the present invention is not limited thereto, and the electroacoustic transducer may be configured with the housing, the speaker unit, and the tubular duct, which have a variety of other configurations.

Further, in the first embodiment, the description was made with respect to the case where the ear speaker device 1 as the ear speaker device is configured with the housings 4L and 4R as the housing, the speaker units 7L and 7R as the speaker unit, the band part 3 as the mounting part, and the tubular ducts 8L and 8R as the tubular duct. However, the present invention is not limited thereto, and the ear speaker device may be configured with the housing, the speaker unit, the mounting part, and the tubular duct, which have a variety of other configurations.

(2) Second Embodiment (2-1) Configuration of Ear Speaker Device

Figure 32:
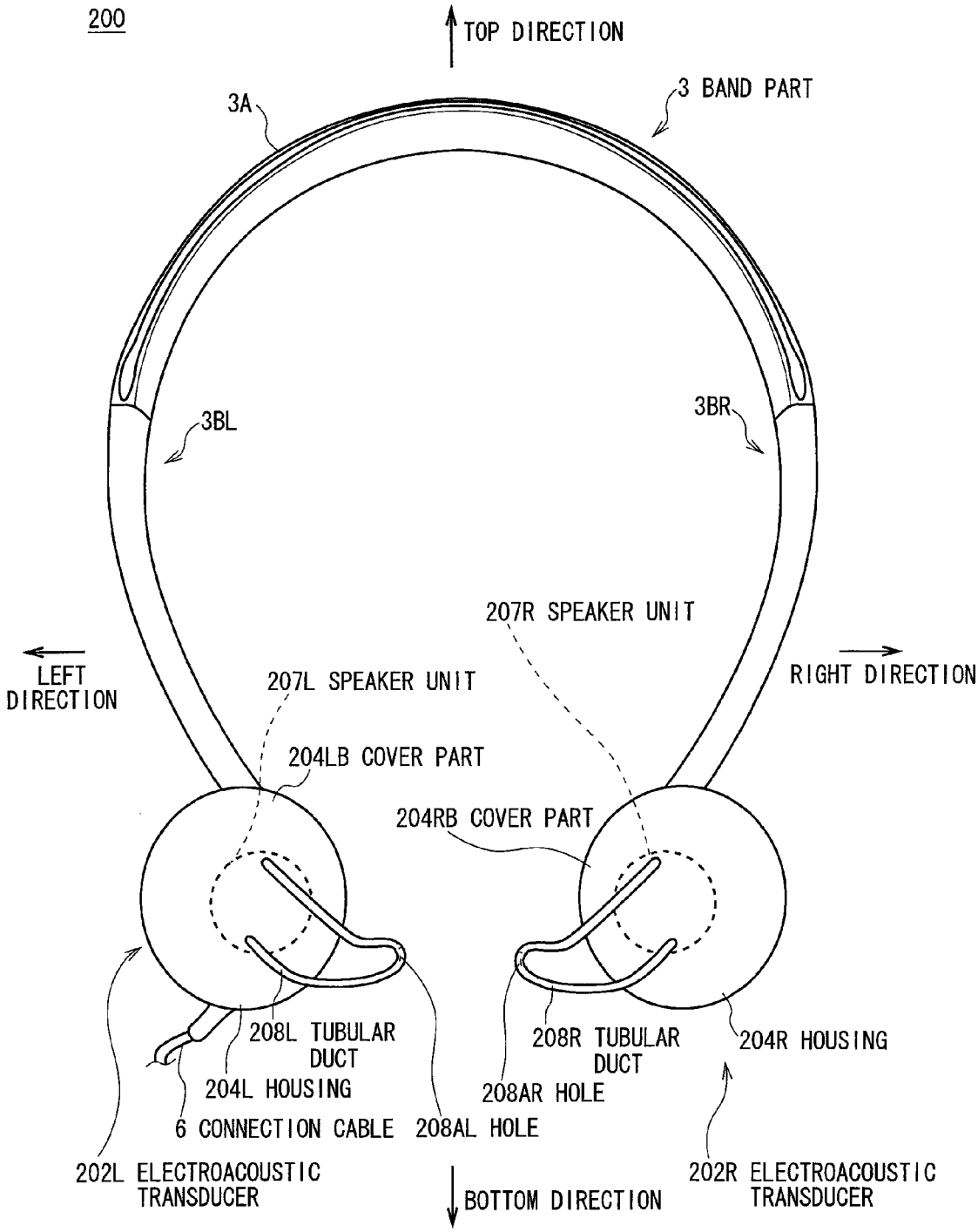
FIG. 32 is a schematic perspective view showing an entire configuration of the ear speaker device according to a second embodiment.
Figure 33:
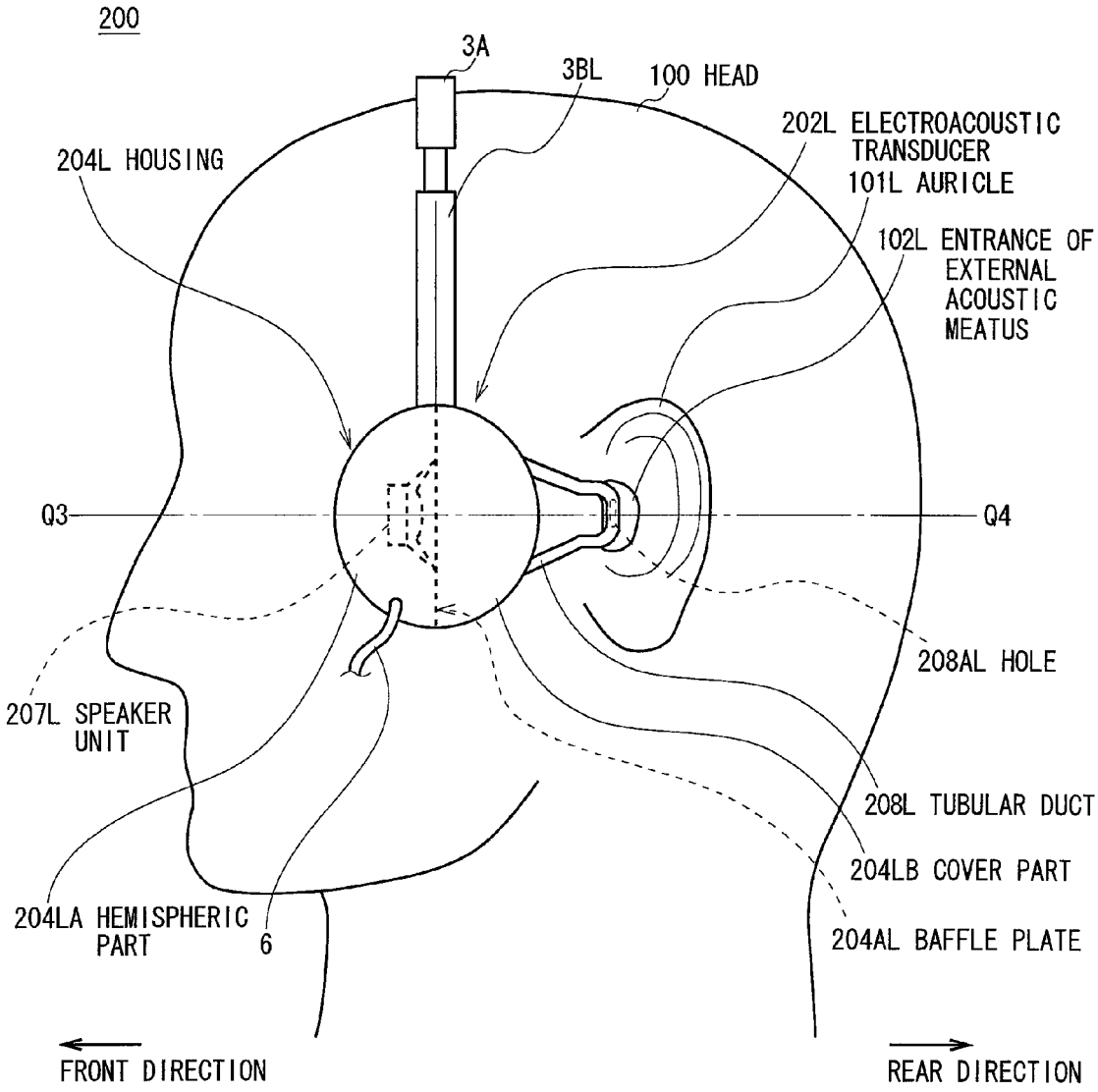
FIG. 33 is a schematic side view showing a mounting state of the ear speaker device according to the second embodiment.

In FIGS. 32 and 33 in which a corresponding part is attached with the same numerical number as found in FIG. 1, the numerical number 200 shows the entire ear speaker device according to the second embodiment. The ear speaker device 200 converts the audio signal generated by reproduction processing, and so on of a portable CD player and a DMP to the reproduced sound, and makes the listener capable of listening to the reproduced sound.

The ear speaker device 200 is also premised to be mounted on the head of the listener as similar to a normal headphone device unlike a general box-type speaker device. The ear speaker device 200 is configured with electroacoustic transducers 202L and 202R that convert the audio signal to the reproduced sound and the band part 3 that mounts and fixes the electroacoustic transducers 202L and 202R on the head of the listener, as a rough classification.

The electroacoustic transducers 202L and 202R are configured centering on housings 204L and 204R having an entire shape as a substantial ball shape, and the speaker units 207L and 207R are provided inside the housings 204L and 204R, respectively.

The housing 204L (FIG. 33) is divided into a hemispheric part 204LA positioned on a front direction side and a cover part 204LB positioned on a rear direction side with the speaker unit 207L interposed therebetween. The speaker unit 207L that converts the audio signal to the reproduced sound is attached to a baffle plate 204AL of the hemispheric part 204LA.

The speaker unit 207L mainly emits the middle-pitched and the high-pitched sounds by vibrating the diaphragm in accordance with the audio signal supplied from the portable CD player, the DMP, and so on via the connection cable 6.

The cover part 204LB (FIG. 33) has a hemispheric shape that has space in the inside. The cover part 204LB covers front space of the baffle plate 204AL. Also, a tubular duct 208L made of metal such as aluminum having predetermined rigidity or plastic, resin, and so on having predetermined rigidity, and having the hollow member having predetermined thickness being curved in a U-shape on a side is attached to a substantial center of a surface of the cover part 204LB.

The tubular ducts 208L and 208R (FIG. 32) have their external end parts being curved to the inner sides on the left and the right, respectively. Further, holes 208AL and 208AR are formed on a substantial center of the external end parts, respectively.

The band part 3 is formed in a substantial arch shape so as to surround an upper part of the head of a general human being centering on a center part 3A. At the same time, the entire length of the band part 3 is made adjustable by using adjusting parts 3BL and 3BR that can slide with respect to the center part 3A in an extendible manner.

In addition, the band part 3 is formed in the arch shape having a diameter smaller than the shape of the head of the general human being and also has elastic force. Therefore, when the ear speaker device is mounted on the listener while the housings 204L and 204R are extended to the left and the right, the band part 3 tends to return to the normal shape by action of the elastic force after the mounting. In this manner, the housings 204L and 204R are held in the state that the housings contact the head of the listener.

The ear speaker device 200 is configured in substantial symmetry. Therefore, the electro acoustic transducer 202L on the left side will be mainly described hereinafter.

In practice, the ear speaker device 200 (FIG. 33) is mounted on the head 100 of the listener after length of the band part 3 is adjusted, thereby the electroacoustic transducer 202L attached to the lower end side of the adjusting part 3BL is positioned somewhat closer to the front than an auricle 101L on the head of the listener.

In the above manner, when the electroacoustic transducer 202L is mounted on the listener in a normal manner via the band part 3, the speaker unit 207L of the housing 204L is positioned somewhat closer to the front than the auricle 101L and the entrance 102L of the external acoustic meatus, and the hole 208AL of the tubular duct 208L of the cover part 204LB is positioned in the vicinity of the entrance 102L of the external acoustic meatus.

Therefore, the ear speaker device 200 can allow mainly the middle-pitched and the high-pitched sounds emitted from the speaker unit 207L to reach the inside of the external acoustic meatus of the listener directly via the cover part 204LB and the tubular duct 208L. In this manner, the ear speaker device 200 can provide the natural sound image localization in a state of less sound leakage of the middle-pitched and the high-pitched sounds than when the sounds are listened to via the general stationary speaker.

The tubular duct 208L has its end part formed in a substantial U-shape on its side surface, and therefore is configured so as to be put in contact with the entrance 102L of the external acoustic meatus of the listener and not to enter into the inside of the external acoustic meatus. In this manner, the ear speaker device 200 is configured so as to be able to prevent the end part of the tubular duct 208L from hurting the inside of the external acoustic meatus in error when the listener mounts the ear speaker device 200, and so on.

Figure 34:
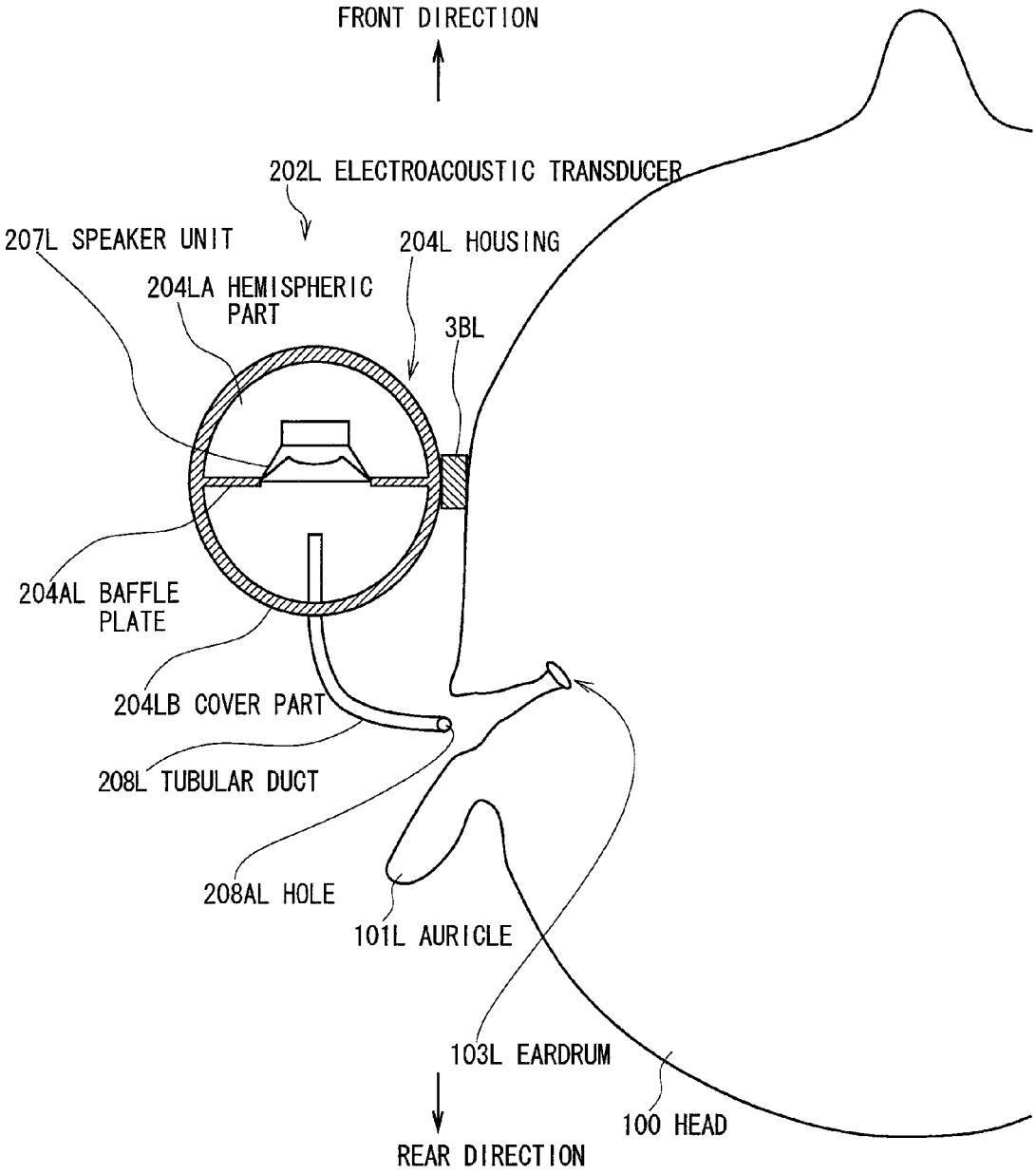
FIG. 34 is a schematic cross-sectional top view showing the mounting state of the ear speaker device according to the second embodiment.

Here, as a cross section cut along the line Q3-Q4 in FIG. 33 is shown in FIG. 34, the housing 204L of the electroacoustic transducer 202L has the front space of the speaker unit 207L forming closed space excluding the hole 208AL of the tubular duct 208L. The cover part 204LB and the tubular duct 208L form a resonant circuit with respect to the speaker unit 207L.

In addition, the tubular duct 208L reaches the vicinity of the entrance 102L of the external acoustic meatus of the listener via the cover part 204LB of the housing 204L from the inside of the housing 204L. In practice, the electroacoustic transducer 202L gathers mainly the middle-pitched and the high-pitched sounds emitted from a front surface of the speaker unit 207L via the cover part 204LB and the tubular duct 208L, and allows the middle-pitched and the high-pitched sounds to directly reach the eardrum 103 of the listener from the hole 208AL of the tubular duct 208L. In this manner, the middle-pitched and the high-pitched sounds at an sufficient sound level can be listened to by the listener in a state where there is little sound leakage.

The tubular duct 208L is formed in a substantial U-shape on its side surface. Therefore, effective length of the tubular duct 208L can be set shorter as compared with a case where one tubular duct is used. Also, design and safety of the tubular duct 208L can be significantly improved.

As shown in FIGS. 32 and 33, although the electroacoustic transducer 202L makes the end part of the tubular duct 208L in contact with the vicinity of the entrance 102L of the external acoustic meatus of the listener, the electroacoustic transducer 202L does not completely block the entrance 102L of the external acoustic meatus.

In the above manner, the electroacoustic transducer 202L can allow a sound (hereinafter referred to as the surround sound) generated around the listener and also the reproduced sound emitted from the speaker unit 207L via the hole 208AL of the tubular duct 208L to reach the eardrum 103L (FIG. 34) of the listener without blocking these sounds, and make the listener capable of listening to these sounds.

The electroacoustic transducer 202L has the tubular duct 208L made of metal such as aluminum having predetermined rigidity or plastic, resin, and so on having predetermined rigidity, and the end part of the tubular duct 208L is made in contact with the vicinity of the entrance 102L of the external acoustic meatus. In this manner, the electroacoustic transducer 202L can allow the vibration component of low frequencies generated at the end part of the tubular duct 208L to reach the eardrum 103L of the listener by transmission mainly via the skin, and make the listener capable of listening to the sound.

In particular, a sense of the low-pitched sound can be experienced by the listener in a manner that the skin of the human being vibrates due to vibration of low frequencies generated at the end part of the tubular duct 208L since the tubular duct 208L is made in contact with the vicinity of the entrance 102L of the external acoustic meatus, and then the vibration is transmitted to the brain from a nerve of the skin.

As shown in FIG. 11, the above is shown in a result of measuring an amplitude amount of an top-to-bottom direction (bold arrow) at the end part of the tubular duct 208L. As shown in FIG. 12, vibration in the top-to-bottom direction, that is, the amplitude amount in the top-to-bottom direction generated at the end part of the tubular duct 208L made of hard metal such as aluminum is significantly large and is around 100 [Hz] or below in particular.

In addition, as shown in FIG. 13, an amplitude amount in a front-to-rear direction (bold arrow) at the end part of the tubular duct 208L was measured. As a result, as shown in FIG. 14, vibration in the front-to-rear direction, that is, the amplitude amount in the front-to-rear direction generated at the end part of the tubular duct 208L made of hard metal such as aluminum is also significantly large and is around 100 [Hz] or below in particular.

Further, as shown in FIG. 15, an amplitude amount in a left-to-right direction (bold arrow) at the end part of the tubular duct 208L was measured. As a result, as shown in FIG. 16, vibration in the left-to-right direction, that is, the amplitude amount in the left-to-right direction generated at the end part of the tubular duct 208L made of hard metal such as aluminum is also significantly large and is around 100 [Hz] or below in particular.

In the above manner, in the ear speaker device 200, large vibration is generated in the top-to-bottom direction, the front-to-rear direction, and the left-to-right direction at the end part of the tubular duct 8L. The vibration reaches the eardrum 103L of the listener by transmission via the skin of the listener. Therefore, not only the middle-pitched and the high-pitched sounds, but also the low-pitched sound to some extent can be listened by the listener.

As described above, the ear speaker device 200 positions the speaker unit 207L at a location somewhat distant from the entrance 102L of the external acoustic meatus of the listener when the ear speaker device 200 is mounted on the head 100 of the listener. The ear speaker device 200 emits the middle-pitched and the high-pitched sounds from the speaker unit 207L via the tubular duct 208L. At the same time, the ear speaker device 200 allows the vibration component of low frequencies generated at the end part of the tubular duct 208L extended to the vicinity of the entrance 102L of the external acoustic meatus from the housing 204L to reach the eardrum 103L of the listener by transmission mainly via the skin. In this manner, the ear speaker device 200 can make the listener capable of listening to the excellent reproduced sound including the low-pitched sound to some extent while providing the natural sound image localization.

(2-2) Configuration Example of Another Ear Speaker Device

As shown in FIGS. 32 to 34, the ear speaker device 200 in the second embodiment has the electroacoustic transducers 202L and 202R mounted on the head 100 of the listener by the band part 3 as the mounting part. However, the electroacoustic transducers 202L and 202R may be mounted on the head 100 of the listener by using a variety of other mounting parts in place of the band part 3.

Hereinafter, as similar to the case of the ear speaker device 200 described above, description will be made by taking mainly the electroacoustic transducer 202L on the left side as an example. The electroacoustic transducer 202R on the right side is configured in a symmetrical manner as the electroacoustic transducer 202L on the left side.

Figure 35:
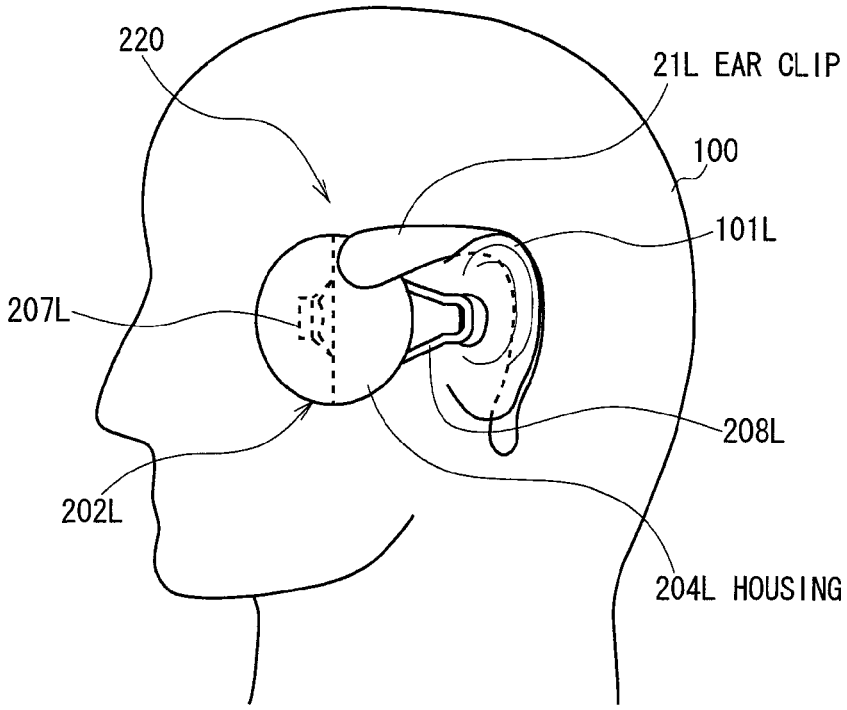
FIG. 35 is a schematic side view showing an example of a configuration and mounting of the ear speaker device according to the second embodiment.

For example, as shown in FIG. 35 in which a corresponding part is attached with the same numerical number as found in FIG. 17, a so-called ear-clip type ear speaker device 220 having the ear clip 21L to be hung on the auricle 101L of the listener attached to the housing 204L of the electroacoustic transducer 202L in place of the band part 3 of the ear speaker device 200 (FIGS. 32 to 34) in the second embodiment can be considered.

The ear speaker device 220 (FIG. 35) in the above case allows mainly the middle-pitched and the high-pitched sounds emitted from the speaker unit 207L to directly reach the inside of the external acoustic meatus of the listener via the cover part 204LB and the tubular duct 208L. Therefore, the ear speaker device 220 can provide the natural sound image localization in a state that there is less sound leakage of the middle-pitched and the high-pitched sounds than when the sounds are listened to via the general stationary speaker.

Figure 36:
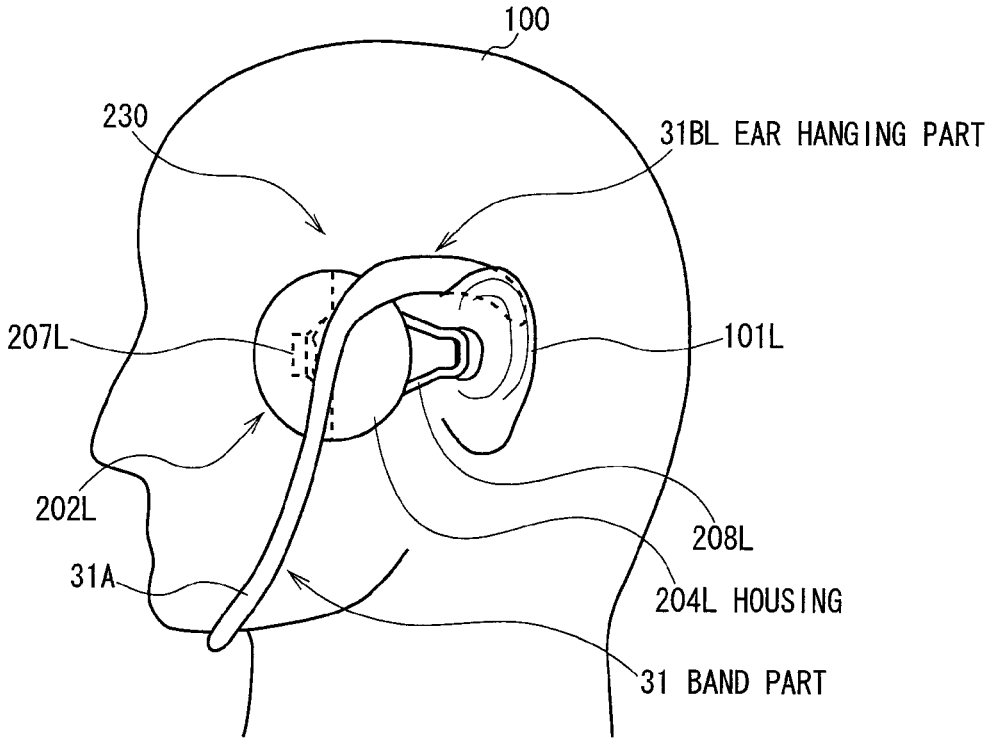
FIG. 36 is a schematic side view showing an example of the configuration and the mounting of the ear speaker device according to the second embodiment.

In addition, as shown in FIG. 36 in which a corresponding part is attached with the same numerical number as found in FIG. 18, a so-called under-chin type ear speaker device 230 having a band part 31 for connecting the electroacoustic transducers 202L and 202R on the left and right of the ear speaker device 200 (FIGS. 32 to 34) in the second embodiment and being hung on the auricle 101L of the listener attached to the housing 204L of the electroacoustic transducer 202L in place of the band part 3 of the ear speaker device 200 can be considered.

The ear speaker device 230 (FIG. 36) in the above case can also allow mainly the middle-pitched and the high-pitched sounds emitted from the speaker unit 207L to directly reach the inside of the external acoustic meatus of the listener via the cover part 204LB and the tubular duct 208L. Therefore, the ear speaker device 230 can provide the natural sound image localization in a state that there is less sound leakage of the middle-pitched and the high-pitched sounds than when the sounds are listened to via the general stationary speaker.

Figure 37:
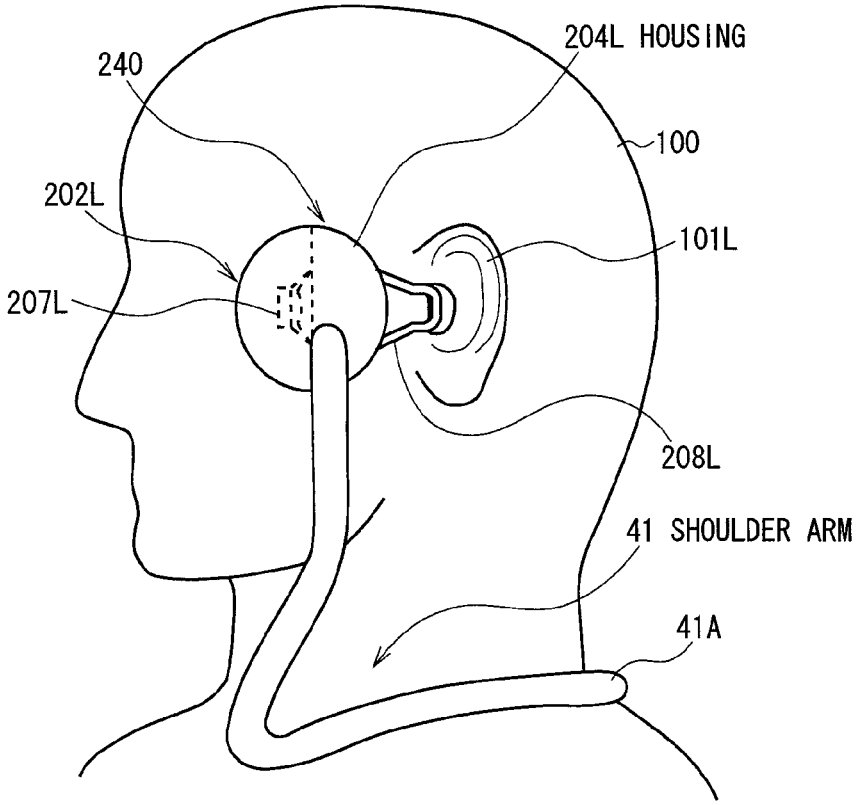
FIG. 37 is a schematic side view showing an example of the configuration and the mounting of the ear speaker device according to the second embodiment.

Further, as shown in FIG. 37 in which a corresponding part is attached with the same numerical number as found in FIG. 19, a so-called shoulder-hold type ear speaker device 240 can be considered. In the shoulder-hold type ear speaker device 240, a shoulder arm 41 for connecting the electroacoustic transducers 202L and 202R on the left and right of the ear speaker device 200 (FIGS. 32 to 34) in the second embodiment is attached to the housing 204L of the electroacoustic transducer 202L in place of the band part 3 of the ear speaker device 200.

The ear speaker device 240 (FIG. 37) in the above case can also allow mainly the middle-pitched and the high-pitched sounds emitted from the speaker unit 207L to directly reach the inside of the external acoustic meatus of the listener via the cover part 204LB and the tubular duct 208L. Therefore, the ear speaker device 240 can provide the natural sound image localization in a state that there is less sound leakage of the middle-pitched and the high-pitched sounds than when the sounds are listened to via the general stationary speaker.

Figure 38:
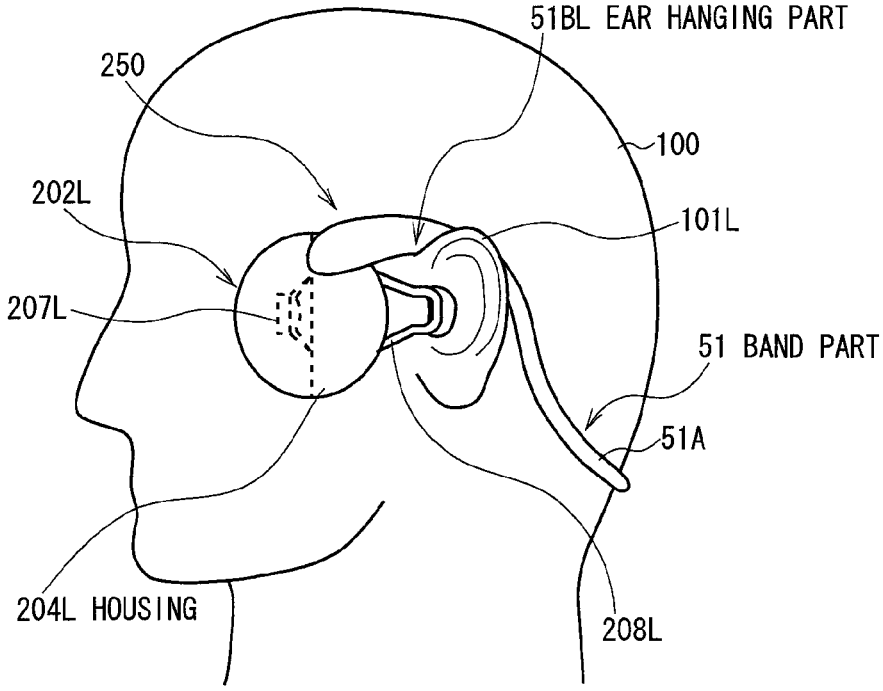
FIG. 38 is a schematic side view showing an example of the configuration and the mounting of the ear speaker device according to the second embodiment.

Further, as shown in FIG. 38 in which a corresponding part is attached to with the same numerical number as found in FIG. 20, a so-called neck-band type ear speaker device 250 can be considered. In the neck-band type ear speaker device 250, a band part 51 for connecting the electroacoustic transducers 202L and 202R on the left and right of the ear speaker device 200 (FIGS. 32 to 34) in the second embodiment and being hung on the auricle 101L of the listener is attached to the housing 204L in place of the band part 3 of the ear speaker device 200.

The ear speaker device 250 (FIG. 38) in the above case can also allow mainly the middle-pitched and the high-pitched sounds emitted from the speaker unit 207L to directly reach the inside of the external acoustic meatus of the listener via the cover part 204LB and the tubular duct 208L. Therefore, the ear speaker device 250 can provide the natural sound image localization in a state that there is less sound leakage of the middle-pitched and the high-pitched sounds than when the sounds are listened to via the general stationary speaker.

Figure 39:
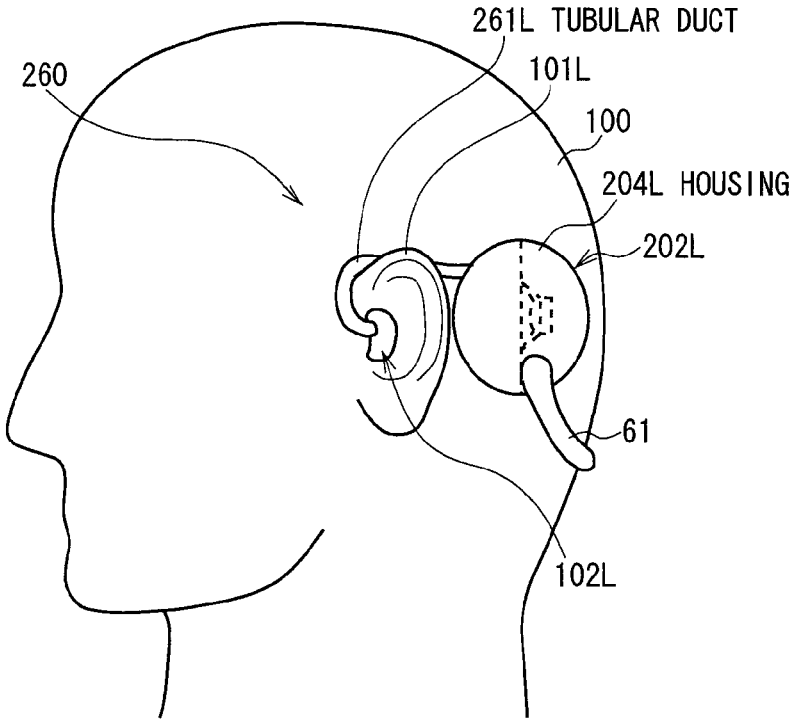
FIG. 39 is a schematic side view showing an example of the configuration and the mounting of the ear speaker device according to the second embodiment.

Further, as shown in FIG. 39 in which a corresponding part is attached to with the same numerical number as found in FIG. 21, an ear speaker device 260 can be considered. The ear speaker device 260 has a configuration in which the electroacoustic transducer 202L of the ear speaker device 200 (FIGS. 32 to 34) in the second embodiment is positioned closer to the rear side than the auricle 101 of the listener, and also a tubular duct 261L having a substantial L-shape extends from the housing 204L positioned in a rear side of the auricle 101L of the listener to the vicinity of the entrance 102L of the external acoustic meatus in place of the tubular duct 208L.

The ear speaker device 260 (FIG. 39) in the above case can also allow mainly the middle-pitched and the high-pitched sounds emitted from the speaker unit 207L to directly reach the inside of the external acoustic meatus of the listener via the cover part 204LB and the tubular duct 208L. Therefore, the ear speaker device 260 can provide the natural sound image localization in a state that there is less sound leakage of the middle-pitched and the high-pitched sounds than when the sounds are listened to via the general stationary speaker.

Figure 40:
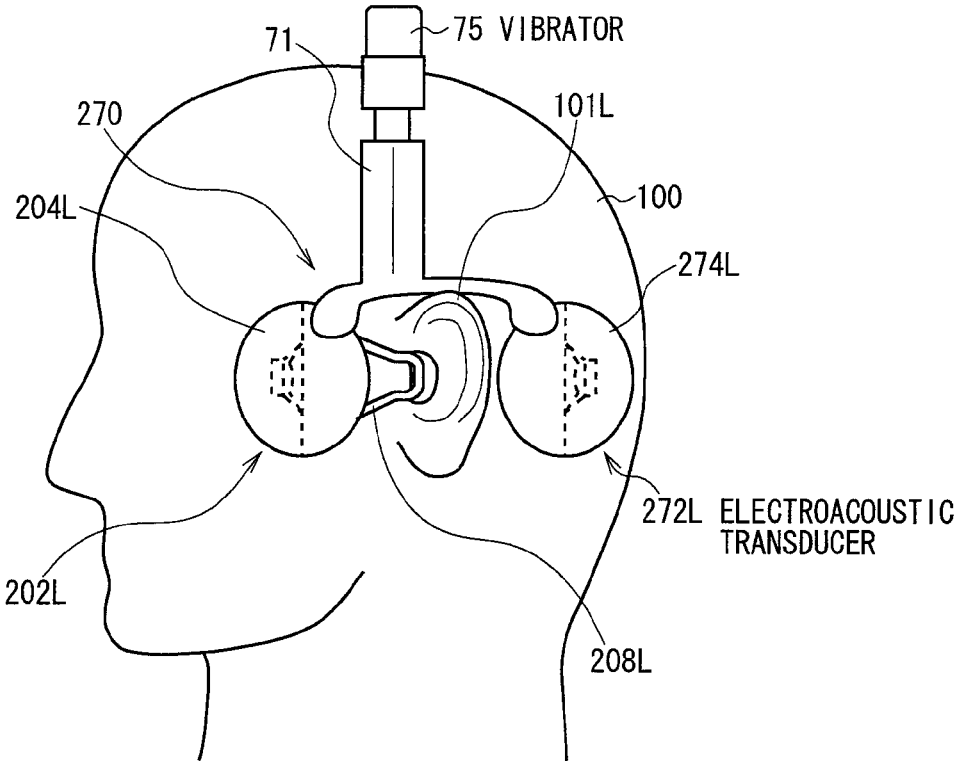
FIG. 40 is a schematic side view showing an example of the configuration and the mounting of the ear speaker device according to the second embodiment.

Further, as shown in FIG. 40 in which a corresponding part is attached with the same numerical number as found in FIG. 22, a rear electroacoustic transducer 272L having a similar configuration as the electroacoustic transducer 202L is included in addition to the electroacoustic transducer 202L of the ear speaker device 200 (FIGS. 32 to 34) in the second embodiment. The band part 71 provided in place of the band part 3 in the ear speaker device 200 (FIGS. 32 to 34) positions the electroacoustic transducer 202L in front of the auricle 101L, and the electroacoustic transducer 272L in the rear of the auricle 101L.

The rear electroacoustic transducer 272L is supplied with the audio signal for the rear channel in the multi-channel sound source such as the 4-channel and the 5.1-channel.

This ear speaker device 270 (FIG. 40) can mount the electroacoustic transducer 202L and the rear electroacoustic transducer 272L on the head 100 of the listener by being mounted on the head 100 of the listener. The ear speaker device 270 can make the listener capable of listening to the excellent reproduced sound made of a surround sound and including the sufficient low-pitched sound while providing the natural sound image localization in a state that the auricle 101L is sandwiched by the electroacoustic transducer 202L and the rear electroacoustic transducer 272L.

In addition, in the above case, the ear speaker device 270 (FIG. 40) may have the vibrator 75 attached to the band part 71 to generate, for example, vibration corresponding to the deep bass component in the 5.1-channel sound source to transmit the vibration to the head 100 of the listener.

In the ear speaker device 270 (FIG. 40), apart from that the tubular duct 208L is extended from the electroacoustic transducer 202L to the vicinity of the entrance 102L of the external acoustic meatus of the listener, a tubular duct may be extended from the rear electroacoustic transducer 272L to the vicinity of the entrance 102L of the external acoustic meatus of the listener as similar to the ear speaker device 260 (FIG. 39). Alternatively, a tubular duct may be extended from both the electroacoustic transducer 202L and the rear electroacoustic transducer 272L to the entrance 102L of the external acoustic meatus of the listener.

Figure 41:
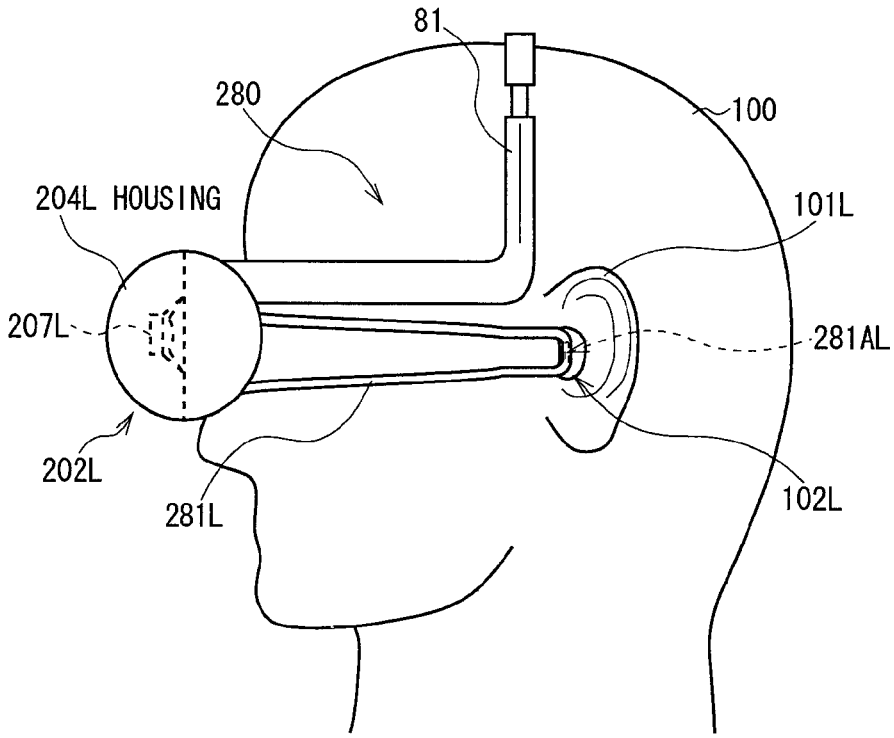
FIG. 41 is a schematic side view showing an example of the configuration and the mounting of the ear speaker device according to the second embodiment.

Further, as shown in FIG. 41 in which a corresponding part is attached with the same numerical number as found in FIG. 23, an ear speaker device 280 can be considered. In the ear speaker device 280, a band part 81 that positions the electroacoustic transducer 202L of the ear speaker device 200 (FIGS. 32 to 34) in the second embodiment closer to the front side than the cheek of the listener is attached to the housing 204L.

In addition, the housing 204L is provided with a tubular duct 281L extending from the housing 204L to the vicinity of the entrance 102L of the external acoustic meatus of the listener in place of the tubular duct 208L. The tubular duct 281L has its inner diameter, path length of the sound, and so on appropriately calculated to emit the excellent low-pitched sound in the reproduced sound from a hole 281AL.

The ear speaker device 280 (FIG. 41) can position the housing 204L closer to the front than the cheek of the listener by being mounted on the head 100 of the listener. In this case, the middle-pitched and the high-pitched sounds emitted from the speaker unit 207L have their characteristics changed by being reflected on the cheek of the listener, and so on. Therefore, as compared with the case of the ear speaker device 200, the middle-pitched and the high-pitched sounds are made even closer to the sound emitted from the general stationary speaker. In this manner, the ear speaker device 280 can make the listener capable of listening to the reproduced sound that can provide better natural localization.

As described above, in the present invention, the electroacoustic transducers 202L and 202R may be mounted on the head 100 of the listener by the mounting parts in a variety of modes such as ear speaker devices 220 to 280 (FIGS. 35 to 41), other than the band part 3 (FIGS. 32 to 34) in the ear speaker device 200.

(2-3) Operation and Advantageous Effect in Second Embodiment

In the above configuration, the ear speaker device 200 gathers mainly the middle-pitched and the high-pitched sounds emitted from the speaker unit 207L provided on the housing 204L of the electroacoustic transducer 202L via the cover part 204LB to the tubular duct 208L by being mounted on the head 100 of the listener. Then, the ear speaker device 200 outputs the middle-pitched and the high-pitched sounds from the hole 208AL of the tubular duct 208L positioned in the vicinity of the entrance 102L of the external acoustic meatus.

Therefore, the electroacoustic transducer 202L of the ear speaker device 200 can allow the middle-pitched and the high-pitched sounds emitted from the speaker unit 207L to directly reach the eardrum 103L only from the hole 208AL of the tubular duct 208L. Therefore, the electroacoustic transducer 202L can make the listener capable of listening to the reproduced sound having a characteristic similar to the case of making the listener listening to the sound via the general speaker, without sound leakage, and can provide a sense of the natural localization as though the sound image is localized outside the head.

In addition, the ear speaker device 200 only positions the hole 208AL of the tubular duct 208L in the vicinity of the entrance 102L of the external acoustic meatus, and does not block the entrance 102L of the external acoustic meatus unlike a closed-type headphone. Therefore, the ear speaker device 200 can allow not only the reproduced sound output from the hole 208AL of the tubular duct 208L, but also the surround sound without being blocked, to reach the eardrum 103. In this manner, the ear speaker device 200 can make the listener capable of listening to the reproduced sound via the tubular duct 208L and also to the surround sound outside.

In the above manner, the ear speaker device 200 can ensure to make the listener listen to the surround sound in addition to the reproduced sound output from the hole 208AL of the tubular duct 208L, even in a case where the listener needs to listen to the surround sound such as when the listener is walking and playing some sport.

In addition, the ear speaker device 200 does not cover the auricle 101L, and so on of the listener with the electroacoustic transducer 202L. Therefore, the ear speaker device 200 never causes uncomfortableness such as a sense of closeness and sweatiness the listener feels when the listener wears the general headphone. Further, the ear speaker device 200 does not form closed space, therefore the ear speaker device 200 does not generate a change of a resonance frequency in the external acoustic meatus which may be generated in a case of using the closed-type headphone, and does not make the listener uncomfortable.

In addition, the ear speaker device 200 can make the listener capable of listening to the middle-pitched and the high-pitched sounds at the sufficient sound volume level by making the hole 208AL of the tubular duct 208L which is an emitting aperture of the reproduced sound closer to the eardrum 103L. At the same time, the ear speaker device 200 can make the listener capable of listening to the low-pitched sound to some extent by vibration in low frequencies generated at the end part of the tubular duct 208L. Therefore, a diameter of the speaker unit 207L does not need to be made large unnecessarily, and size of the housing 204L can be minimized.

In this manner, the entire size and weight of the ear speaker device 200 can be limited to be minimum, therefore troublesomeness caused by the size and the weight of the ear speaker device 200 when the listener wears the ear speaker device 200 can be restricted as much as possible.

According to the configuration described above, the ear speaker device 200 positions the speaker unit 207L of the electroacoustic transducer 202L somewhat closer to the front than the entrance 102L of the external acoustic meatus of the listener when the ear speaker device 200 is mounted on the head 100 of the listener. Also, the ear speaker device 200 gathers mainly the middle-pitched and the high-pitched sounds emitted from the speaker unit 207L via the cover part 204LB to the tubular duct 208L without leaking to the outside, and outputs the reproduced sound based on the sound signal from the hold 208AL of the tubular duct 208L positioned in the vicinity of the entrance 102L of the external acoustic meatus. In this manner, the ear speaker device 200 can allow the middle-pitched and the high-pitched sounds emitted from the hole 208AL of the tubular duct 208L to reach the eardrum 103 at the sufficient sound pressure level. Therefore, the ear speaker device 200 can make the listener capable of listening to the excellent reproduced sound at the sufficient sound pressure level while providing the natural sound image localization.

(2-4) Another Embodiment with Respect to Second Embodiment

In the second embodiment described above, the description was made with respect to the case where the tubular duct 208L is formed in a substantial U-shape on its side surface, and is configured with two tubular ducts with the hole 208AL located on a border therebetween. However, the present invention is not limited thereto, and the tubular duct 208L may be configured with one or three or more tubular ducts.

Figure 42:
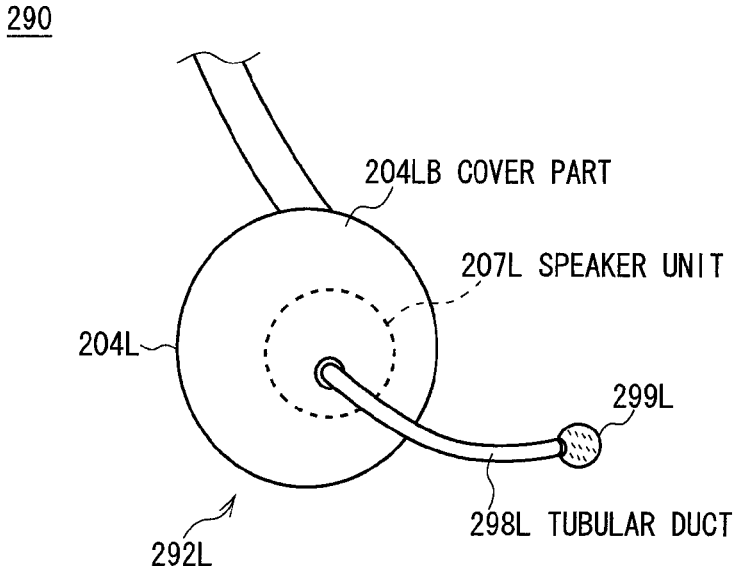
FIG. 42 is a schematic perspective view showing a configuration example of the tubular duct according to another embodiment.

For example, as shown in FIG. 42, in an electroacoustic transducer 292L of an ear speaker device 290, one tubular duct 298L may be extended to a rear side from a surface of the cover part 204LB of the housing 204L. Further, a protective part 299L for protecting the entrance 102L of the external acoustic meatus of the listener may be attached to an end part on a rear side of the tubular duct 298L. In this case, the protective part 299L can make the listener capable of listening to the surround sound without being blocked by being configured with a sponge member that can easily pass a sound.

In addition, in the second embodiment, the description was made with respect to the case where the tubular duct 208L made of a hard material such as metal is used. However, the present invention is not limited thereto, and the tubular duct 208L made of a soft material such as flexible resin may be used. In this case, the inner diameter and the path length are desirably set in consideration of a difference of materials of the tubular duct 208L.

Further, in the second embodiment, the description was made with respect to the case where the sound emitting surface of the speaker unit 207L is oriented to a substantial rear direction when the ear speaker device 200 is mounted on the head 100 (FIG. 33) of the listener. However, the present invention is not limited thereto, and, for example, the sound emitting surface of the speaker unit 207L may be oriented to a somewhat inner side. What is important here is that the sound emitting surface of the speaker unit 207L is roughly oriented to a direction of the entrance 102L of the external acoustic meatus, and the middle-pitched and the high-pitched sounds being emitted are allowed to efficiently reach the eardrum 103L.

Further, in the second embodiment, the description was made with respect to the case where the ear speaker device 200 has the electroacoustic transducers 202L and 202R on the left and the right, and outputs the reproduced sound of two channels. However, the present invention is not limited thereto, and, for example, the ear speaker device 200 may have only the electroacoustic transducer 202L on the left and output the reproduced sound of one channel.

Further, in the second embodiment, the description was made with respect to the case where the speaker unit 207L for the middle-pitched and the high-pitched sounds is provided in the housing 204L. However, the present invention is not limited thereto, and, for example, a plurality of speaker units may be provided in the housing 204L in such a manner as providing two speaker units for the middle-pitched sound and the high-pitched sound in the housing 204L to make the two-way speaker.

Further, in the second embodiment, the description was made with respect to the case where the cover part 204LB having a hemispheric shape is used. However, the present invention is not limited thereto, and, for example, the cover part 204LB may have a quadrangular pyramid or a triangular pyramid shape. What is important here is that the cover part 204LB needs to have a configuration that can gather the middle-pitched and the high-pitched sounds output from the speaker unit 207L and does not allow such sounds to leak to the outside.

Figure 43:
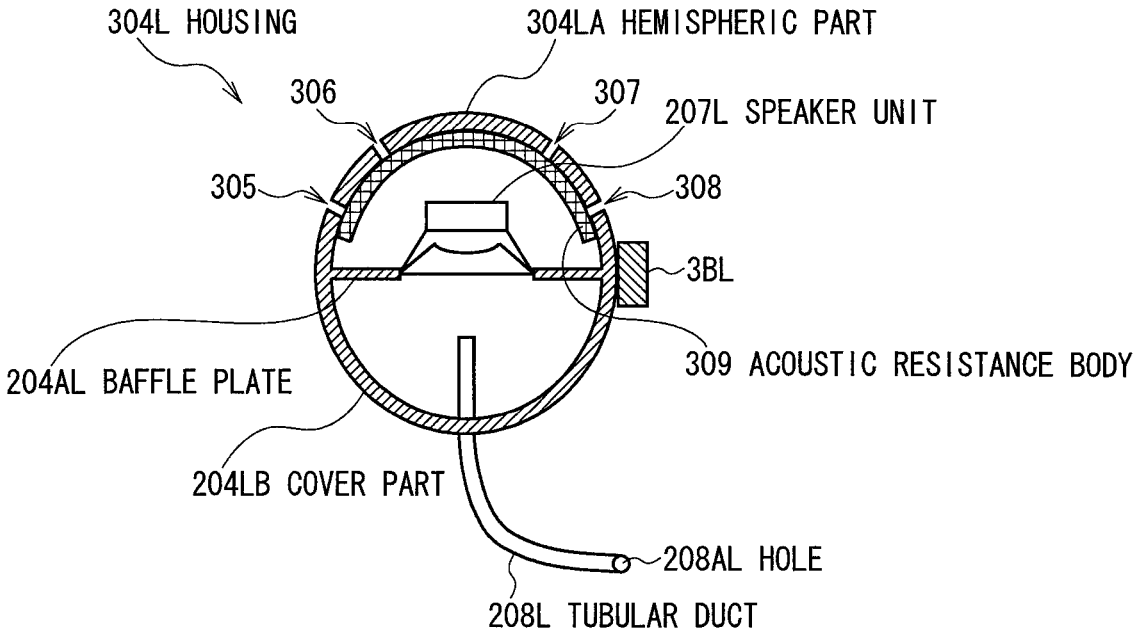
FIG. 43 is a schematic cross-sectional view showing a configuration example of a housing according to another embodiment.

Further, in the second embodiment, the description was made with respect to the case where the housing 204L in which a hemispheric part 204LA configured to block a rear part of the speaker unit 207L is used. However, the present invention is not limited thereto, and as shown in FIG. 43, a housing 304L including a hemispheric part 304LA which has through holes 305 to 308 formed thereon in the rear of the speaker unit 207L, and at the same time, an acoustic resistance body 309 made of sponge and so on attached thereto in a manner as blocking the through holes 305 to 308 from an inner side thereof may be used.

In the housing 304L (FIG. 43) in the above case, the diaphragm of the speaker unit 207L easily complies with the audio signal by a rear side of the speaker unit 207L being opened by the through holes 305 to 308. At the same time, lowering of sound quality due to the forming of the through holes 305 to 308 can be prevented by the acoustic resistance body 309. In this manner, the middle-pitched and the high-pitched sounds with high quality can be emitted from the hole 208AL of the tubular duct 208L.

In the housing 304L (FIG. 43), the acoustic resistance body 309 does not need to be provided. The acoustic resistance body 309 can be attached as needed, and the sound quality can be adjusted by attaching the acoustic resistance body 309 with its length and thickness changed.

Figure 44:
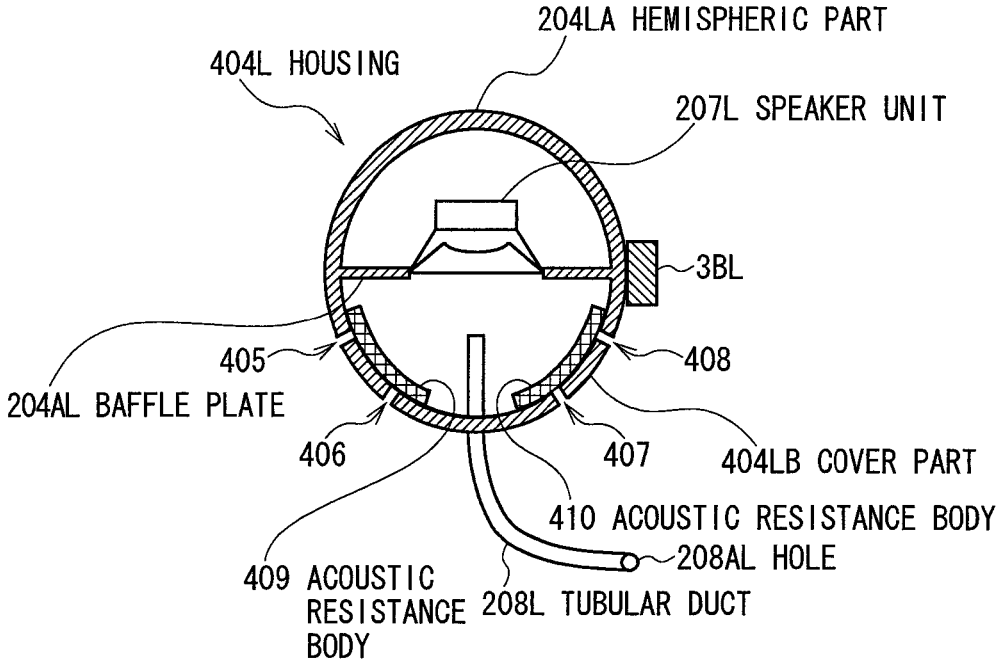
FIG. 44 is a schematic cross-sectional view showing a configuration example of the housing according to another embodiment.

Further, in the second embodiment, the description was made with respect to the case where the housing 204L in which the hemispheric part 204LA configured to block the rear part of the speaker unit 207L. However, the present invention is not limited thereto, and as shown in FIG. 44, a housing 404L including a cover part 404LB which has through holes 405 to 408 formed thereon in the front of the speaker unit 207L, and at the same time, acoustic resistance bodies 409 and 410 made of sponge and so on attached thereto in a manner as blocking the through holes 405 to 408 from an inner side thereof may be used.

In the housing 404L (FIG. 44) in the above case, the diaphragm of the speaker unit 207L easily complies with the audio signal by the front side of the speaker unit 207L being opened by the through holes 405 to 408. At the same time, lowering of sound quality due to the forming of the through holes 405 to 408 can be prevented by the acoustic resistance bodies 409 and 410. In this manner, the middle-pitched and the high-pitched sounds with high quality can be emitted from the hole 208AL of the tubular duct 208L.

In the housing 404L (FIG. 44) as well, the acoustic resistance bodies 409 and 410 do not need to be provided. The acoustic resistance bodies 409 and 410 can be attached as needed, and the sound quality can be adjusted by attaching the acoustic resistance bodies 409 and 410 with their length and thickness changed.

Figure 45:
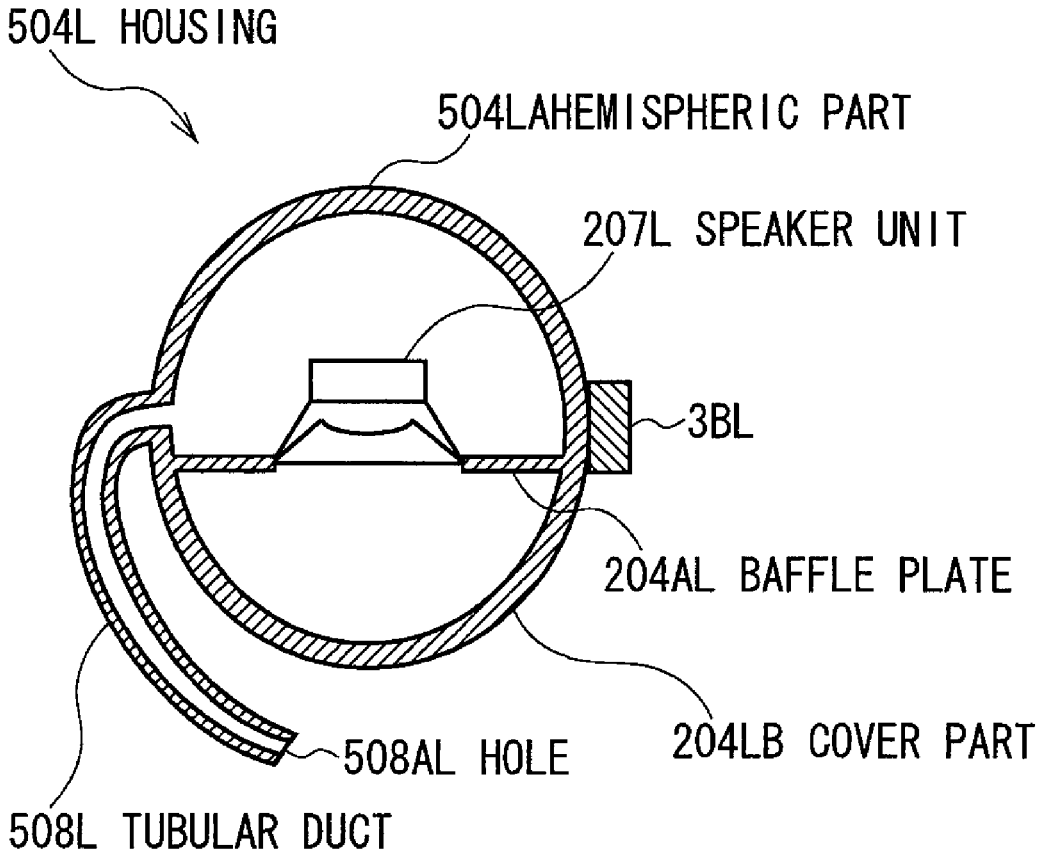
FIG. 45 is a schematic cross-sectional view showing a configuration example of the housing according to another embodiment.

Further, in the second embodiment, the description was made with respect to the case where the housing 204L having the tubular duct 208L provided on a surface of the cover part 204LB is used. However, the present invention is not limited thereto, and as shown in FIG. 45, a housing 504L having a tubular duct 508L provided on a surface of a hemispheric part 504LA in an integrated manner may be used.

In the above case, the housing 504L (FIG. 45) has a similar configuration as a so-called Kelton-type speaker device. The housing 504L traps the middle-pitched and the high-pitched sounds in space in the front of the speaker unit 207L, and also can emit only the low-pitched sound in a predetermined frequency band from a rear side of the speaker unit 207L via a hole 508AL of the tubular duct 508L.

The configuration of the housing 504L (FIG. 45) is not limited to the above. The housing 504L can consider to be configured as the Kelton-type by blocking the rear space of the speaker unit 207L with a hemispheric part, and providing a tubular duct at any part of the surface of the cover part 204LB.

Figure 46:
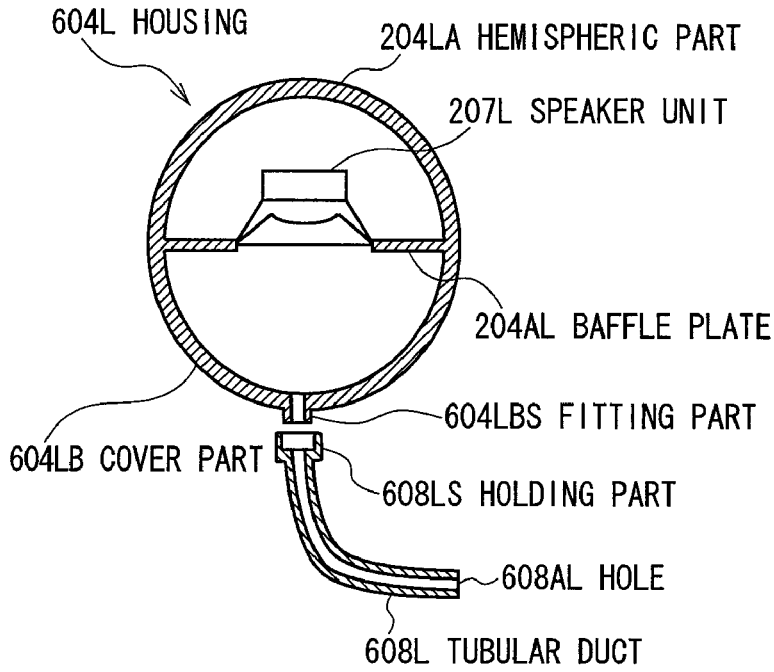
FIG. 46 is a schematic perspective view showing a configuration of the tubular duct according to another embodiment.

Further, in the second embodiment, the description was made with respect to the case where the housing 204L having the tubular duct 208L formed on the surface of the cover part 204LB in an integrated state is used. However, the present invention is not limited thereto, and as shown in FIG. 46, a housing 604L having a configuration where a tubular duct 608L is provided on a cover part 604LB in a detachable manner in a manner that a fitting part 604LBS formed on the cover part 604LB and a holding part 608LS formed on one end of the tubular duct 608L fit to each other.

In the above manner, the housing 604L (FIG. 46) is used in a state where the tubular duct 608L is attached only when the tubular duct 608L is needed by the listener, and is used in a state where the tubular duct 608L is detached when the tubular duct 608L is not necessary for the listener. Therefore, usability of the listener can be improved significantly.

Figure 47:
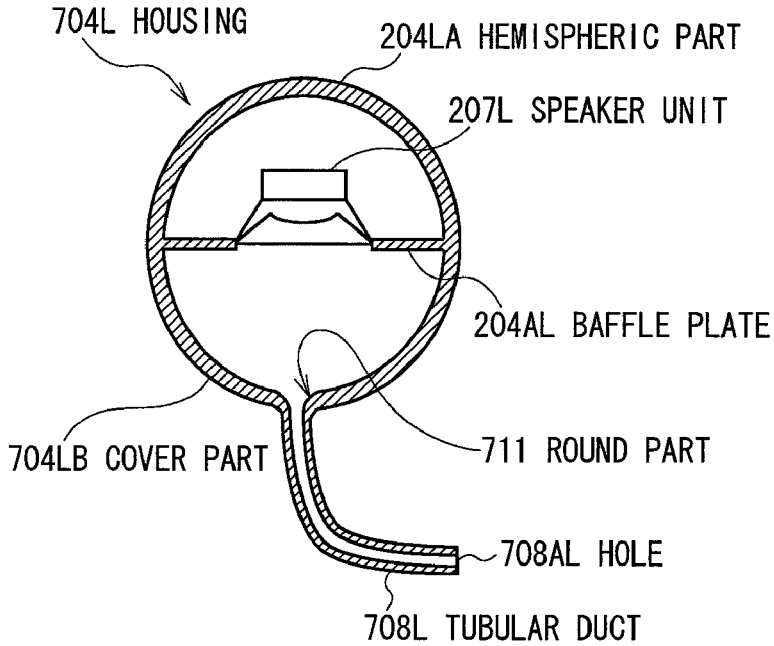
FIG. 47 is a schematic perspective view showing a configuration of the tubular duct according to another embodiment.

Further, in the second embodiment, the description was made with respect to the case where the housing 204L (FIG. 34) in a state that an edge part remains in the inner side of the cover part 204LB and at a base part of the tubular duct 208L is used. However, the present invention is not limited thereto, and as shown in FIG. 47, a housing 704L having a round part 711 having an R-shape formed in an inner side of a cover part 704LB, and at a base part of the tubular duct 708L may be used.

In the housing 704L, air pushed out from a front surface side of the speaker unit 207L does not hit the edge part to generate wind noise, and only the middle-pitched and the high-pitched sounds of high quality can be emitted from a hole 708AL of the tubular duct 708L.

Further, in the second embodiment, the description was made with respect to the case where the housing 204L having the tubular duct 208L formed on the surface of the cover part 204LB in an integrated state. However, the present invention is not limited thereto, and a housing having a configuration where a tubular duct formed in a tubular shape with thinner diameter as it goes to an end in a form of covering the front surface side of the speaker unit 207L is attached to the baffle plate 204AL may be used without discriminating the cover part 204LB and the tubular duct 208L.

Further, in the second embodiment, the description was made with respect to the case where the tubular duct 208L having duct length from the hole 208AL to the surface of the cover part 204LB set to be the same length in both ways is used. However, the present invention is not limited thereto, and a tubular duct set to have different duct length between the both ways may be used.

Figure 48:
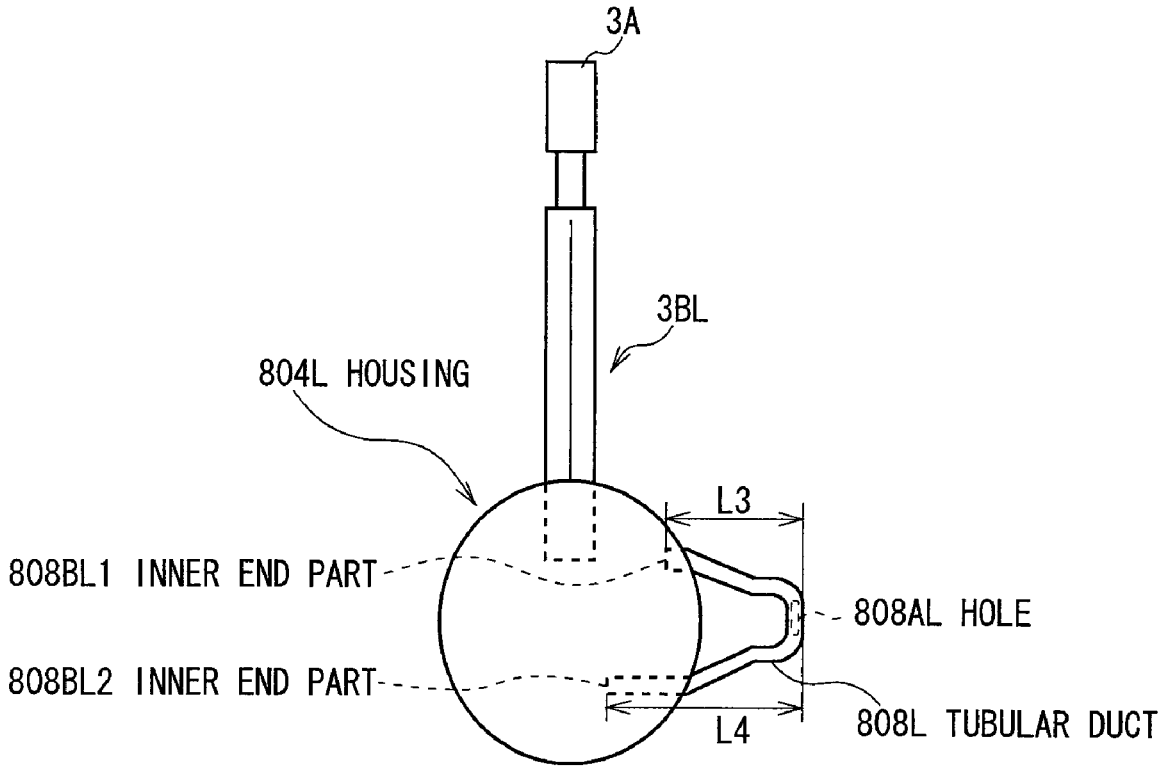
FIG. 48 is a schematic perspective view showing a configuration of the tubular duct according to another embodiment.

For example, as shown in FIG. 48 in which a corresponding part is attached with the same numerical number as found in FIG. 26, in a housing 804L provided with a tubular duct 808L having length L3 from a hole 808AL to an inner end part 808BL1 and length L4 from a hole 808AL to an inner end part 808BL2 different from each other, a phase shift of a resonance characteristic between a duct part of the length L3 and a duct part of the length L4 is generated. As a result, a frequency component of middle and high frequencies slightly output from the hole 808AL is cancelled, and only the low-pitched sound obtained by canceling the middle-pitched and the high-pitched sounds can be emitted from the hole 808AL of the tubular duct 208L2.

Further, in the second embodiment, the description was made with respect to the case where the electroacoustic transducers 202L and 202R as the electroacoustic transducer are configured with the housings 204L and 204R as the housing, the speaker units 207L and 207R as the speaker unit, and the tubular ducts 208L and 208R as the tubular duct. However, the present invention is not limited thereto, and the electroacoustic transducer may be configured with a housing, a speaker unit, and a tubular duct having a variety of other configurations.

Further, in the second embodiment, the description was made with respect to the case where the ear speaker device 1 as the ear speaker device is configured with the housings 204L and 204R as the housing, the speaker units 207L and 207R as the speaker unit, the band part 3 as the mounting part, and the tubular ducts 208L and 208R as the tubular duct. However, the present invention is not limited thereto, and the ear speaker device may be configured with a housing, a speaker unit, a mounting part, and a tubular duct having a variety of other configurations.

Industrial Applicability

The present invention can be utilized for a variety of ear speaker devices that mount a speaker device including a back load horn type and so on having a variety of ducts, in addition to the bass reflex type speaker, on the head of the listener.

Explanation of Reference Symbols

1, 20, 30, 40, 50, 60, 70, 80, 90, 200, 220, 230, 240, 250, 260, 270, 280, 290, 900 . . . EAR SPEAKER DEVICE, 2L, 2R, 72L, 92L, 202L, 202R, 902L, 902R . . . ELECTRO ACOUSTIC TRANSDUCER, 3, 31, 51, 61, 71, 81 . . . BAND PART, 4L, 4L1, 4L3, 4R, 204L, 204R, 304L, 404L, 504L, 604L, 704L, 804L, 904L, 904R . . . HOUSING, 7L, 7R, 207L, 207R, 907L, 907R . . . SPEAKER UNIT, 8L, 8R, 208L, 208R, 261L, 281L, 298L, 308L, 608L, 708L, 808L, 908L, 908R . . . TUBULAR DUCT, 8AL, 8AR, 208AL, 208AR, 908AL, 908AR . . . HOLE, 100 . . . HEAD, 101L . . . AURICLE, 102L . . . ENTRANCE OF EXTERNAL AC0 USTIC MEATUS, 103L . . . EARDRUM, 901L, 901R . . . EAR HANGER, 910 TO 913 . . . SCREW

The invention claimed is:

1. An electroacoustic transducer characterized by comprising:

a housing mounted at a predetermined position of the head of a listener;

a speaker unit that is mounted in the housing, and is positioned away from an entrance of an external acoustic meatus of the listener for a predetermined distance when the housing is mounted on the head of the listener; and a tubular duct that is extended so as to allow a sound generated by the housing to reach the vicinity of the entrance of the external acoustic meatus of the listener, wherein the tubular duct is formed in a substantial U-shape such that the tubular duct extends from the housing to the vicinity of the entrance of the external acoustic meatus of the listener and then returns to the housing again, and has a hole for emitting sound provided in the vicinity of the entrance of the external acoustic meatus of the listener.

2. The electroacoustic transducer according to claim 1, characterized in that the tubular duct transmits vibration carried from the speaker unit via the housing to the listener mainly by conduction via skin.

3. The electroacoustic transducer according to claim 1, characterized in that the tubular duct has a protective part provided thereon for preventing an end part positioned in the vicinity of the entrance of the external acoustic meatus from entering into the inside of the external acoustic meatus of the listener.

4. The electroacoustic transducer according to claim 1, characterized in that the housing orients a sound emitting surface of the speaker unit to a substantial direction of the entrance of the external acoustic meatus of the listener when the housing is mounted on the head of the listener.

5. An ear speaker device, characterized by comprising:

an electroacoustic transducer including a housing mounted at a predetermined position of the head of a listener, a speaker unit that is mounted in the housing, and is positioned away from an entrance of an external acoustic meatus of the listener for a predetermined distance when the housing is mounted on the head of the listener, and a tubular duct that is extended so as to allow a sound generated by the housing to reach the vicinity of the entrance of the external acoustic meatus of the listener; and a mounting part that is used for mounting the electroacoustic transducer on the head of the listener in a manner that the predetermined distance is provided between the speaker unit and the entrance of the external acoustic meatus of the listener, wherein the tubular duct is formed in a substantial U-shape such that the tubular duct extends from the housing to the vicinity of the entrance of the external acoustic meatus of the listener and then returns to the housing again, and has a hole for emitting sound provided in the vicinity of the entrance of the external acoustic meatus of the listener.

6. The ear speaker device according to claim 5, characterized in that the tubular duct transmits vibration carried from the speaker unit via the housing to the listener mainly by conduction via skin.

7. The ear speaker device according to claim 5, characterized in that the tubular duct has a protective part provided thereon for preventing an end part positioned in the vicinity of the entrance of the external acoustic meatus from entering into the inside of the external acoustic meatus of the listener.

8. The ear speaker device according to claim 5, characterized in that the housing orients a sound emitting surface of the speaker unit to a substantial direction of the entrance of the external acoustic meatus of the listener when the housing is mounted on the head of the listener.

9. An electroacoustic transducer characterized by comprising:

a housing mounted at a predetermined position of the head of a listener;

a speaker unit that is mounted on one surface of the housing, and is positioned away from an entrance of an external acoustic meatus of the listener for a predetermined distance when the housing is mounted on the head of the listener; and a tubular duct that is extended so as to allow a sound generated in inside space of the housing to reach the vicinity of the entrance of the external acoustic meatus of the listener, wherein the tubular duct is formed in a substantial U-shape such that the tubular duct extends from the housing to the vicinity of the entrance of the external acoustic meatus of the listener and then returns to the housing again, and has a hole for emitting sound provided in the vicinity of the entrance of the external acoustic meatus of the listener.

10. The electroacoustic transducer according to claim 9, characterized in that the tubular duct transmits vibration carried from the speaker unit via the housing to the listener mainly by conduction via skin.

11. The electroacoustic transducer according to claim 9, characterized in that the tubular duct acts as a duct of a bass reflex speaker.

12. The electroacoustic transducer according to claim 9, characterized in that the tubular duct has a protective part provided thereon for preventing an edge positioned in the vicinity of the entrance of the external acoustic meatus from entering into the inside of the external acoustic meatus of the listener.

13. The electroacoustic transducer according to claim 9, characterized in that the housing orients a sound emitting surface of the speaker unit to a substantial direction of the entrance of the external acoustic meatus of the listener when the housing is mounted on the head of the listener.

14. An ear speaker device, characterized by comprising:

an electroacoustic transducer including a housing mounted at a predetermined position of the head of a listener, a speaker unit that is mounted on one surface of the housing, and is positioned away from an entrance of an external acoustic meatus of the listener for a predetermined distance when the housing is mounted on the head of the listener, and a tubular duct that is extended so as to allow a sound generated in inside space of the housing to reach the vicinity of the entrance of the external acoustic meatus of the listener; and a mounting part that is used for mounting the electroacoustic transducer on the head of the listener in a manner that the predetermined distance is provided between the speaker unit and the entrance of the external acoustic meatus of the listener, wherein the tubular duct is formed in a substantial U-shape such that the tubular duct extends from the housing to the vicinity of the entrance of the external acoustic meatus of the listener and then returns to the housing again, and has a hole for emitting sound provided in the vicinity of the entrance of the external acoustic meatus of the listener.

15. The ear speaker device according to claim 14, characterized in that the tubular duct transmits vibration carried from the speaker unit via the housing to the listener mainly by conduction via skin.

16. The ear speaker device according to claim 14, characterized in that the tubular duct acts as a duct of a bass reflex speaker.

17. The ear speaker device according to claim 14, characterized in that the tubular duct has a protective part provided thereon for preventing an end part positioned in the vicinity of the entrance of the external acoustic meatus from entering into the inside of the external acoustic meatus of the listener.

18. The ear speaker device according to claim 14, characterized in that the housing orients a sound emitting surface of the speaker unit to a substantial direction of the entrance of the external acoustic meatus of the listener when the housing is mounted on the head of the listener.

19. The ear speaker device according to claim 14, characterized in that the mounting part positions the speaker unit closer to the front side than the entrance of the external acoustic meatus of the listener when the electroacoustic transducer is mounted on the head of the listener, and also comprises a rear side housing provided with a predetermined rear side speaker unit that is to be positioned closer to the rear side than the entrance of the external acoustic meatus of the listener.

20. The ear speaker device according to claim 14, characterized in that the mounting part comprises a predetermined vibrator mounted in the mounting part for generating vibration to the head of the listener, in addition to the housing.

21. An electroacoustic transducer characterized by comprising:

a housing mounted at a predetermined position of the head of a listener;

a speaker unit that is mounted on one surface of the housing, and is positioned away from an entrance of an external acoustic meatus of the listener for a predetermined distance when the housing is mounted on the head of the listener; and a tubular duct that is extended so as to allow a sound generated by a front surface of the speaker unit to reach the vicinity of the entrance of the external acoustic meatus of the listener, wherein the tubular duct is formed in a substantial U-shape such that the tubular duct extends from the housing to the vicinity of the entrance of the external acoustic meatus of the listener and then returns to the housing again, and has a hole for emitting sound provided in the vicinity of the entrance of the external acoustic meatus of the listener.

22. The electroacoustic transducer according to claim 21, characterized in that the tubular duct transmits vibration carried from the speaker unit via the housing to the listener mainly by conduction via skin.

23. The electroacoustic transducer according to claim 21, characterized in that the tubular duct has a protective part provided. thereon for preventing an end part positioned in the vicinity of the entrance of the external acoustic meatus from entering into the inside of the external acoustic meatus of the listener.

24. The electroacoustic transducer according to claim 21, characterized in that the housing orients a sound emitting surface of the speaker unit to a substantial direction of the entrance of the external acoustic meatus of the listener when the housing is mounted on the head of the listener.

25. An ear speaker device, characterized by comprising:

an electroacoustic transducer including a housing mounted at a predetermined position of the head of a listener, a speaker unit that is mounted on one surface of the housing, and is positioned away from an entrance of an external acoustic meatus of the listener for a predetermined distance when the housing is mounted on the head of the listener, and a tubular duct that is extended so as to allow a sound generated by the front surface of the speaker unit to reach the vicinity of the entrance of the external acoustic meatus of the listener; and a mounting part that is used for mounting the electroacoustic transducer on the head of the listener in a manner that the predetermined distance is provided between the speaker unit and the entrance of the external acoustic meatus of the listener, wherein the tubular duct is formed in a substantial U-shape such that the tubular duct extends from the housing to the vicinity of the entrance of the external acoustic meatus of the listener and then returns to the housing again, and has a hole for emitting sound provided in the vicinity of the entrance of the external acoustic meatus of the listener.

26. The ear speaker device according to claim 25, characterized in that the tubular duct transmits vibration carried from the speaker unit via the housing to the listener mainly by conduction via skin.

27. The ear speaker device according to claim 25, characterized in that the tubular duct has a protective part provided thereon for preventing an end part positioned in the vicinity of the entrance of the external acoustic meatus from entering into the inside of the external acoustic meatus of the listener.

28. The ear speaker device according to claim 25, characterized in that the housing orients a sound emitting surface of the speaker unit to a substantial direction of the entrance of the external acoustic meatus of the listener when the housing is mounted on the head of the listener.

29. The ear speaker device according to claim 25, characterized in that the mounting part positions the speaker unit closer to the front side than the entrance of the external acoustic meatus of the listener when the electroacoustic transducer is mounted on the head of the listener, and also comprises a rear side housing provided with a predetermined rear side speaker unit that is to be positioned closer to the rear side than the entrance of the external acoustic meatus of the listener.

30. The ear speaker device according to claim 25, characterized in that the mounting part comprises a predetermined vibrator mounted in the mounting part for generating vibration to the head of the listener, in addition to the housing.

* * * * *